US007332265B2

(12) United States Patent
Matsumoto et al.

(10) Patent No.: US 7,332,265 B2
(45) Date of Patent: Feb. 19, 2008

(54) SILVER HALIDE COLOR PHOTOGRAPHIC LIGHT-SENSITIVE MATERIAL, AND IMAGE-FORMING METHOD

(75) Inventors: Jun Matsumoto, Minami-ashigara (JP); Shinichi Nakahira, Minami-ashigara (JP); Hidekazu Sakai, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 285 days.

(21) Appl. No.: 10/703,163

(22) Filed: Nov. 7, 2003

(65) Prior Publication Data

US 2004/0157175 A1 Aug. 12, 2004

(30) Foreign Application Priority Data

Nov. 8, 2002 (JP) ..... 2002-325513
Nov. 8, 2002 (JP) ..... 2002-325525
Nov. 8, 2002 (JP) ..... 2002-325544

(51) Int. Cl.

| | |
|---|---|
| ***G03C 1/46*** | (2006.01) |
| ***G03C 5/18*** | (2006.01) |
| ***G03C 5/26*** | (2006.01) |
| ***G03C 1/06*** | (2006.01) |
| ***G03C 1/08*** | (2006.01) |

(52) U.S. Cl. ..... 430/505; 430/502; 430/503; 430/504; 430/605; 430/599; 430/604; 430/449; 430/567

(58) Field of Classification Search ..... 430/505, 430/502, 503, 504, 605, 599, 604, 449, 567
See application file for complete search history.

(56) References Cited

U.S. PATENT DOCUMENTS 6,235,455 B1 5/2001 Ito et al.
6,521,384 B2 * 2/2003 Szajewski ..... 430/566

FOREIGN PATENT DOCUMENTS

| | | |
|---|---|---|
| JP | 2000-227638 | 8/2000 |
| JP | 2000-352795 | 12/2000 |
| JP | 2001-249433 | 9/2001 |

* cited by examiner

*Primary Examiner*—Geraldina Visconti
(74) *Attorney, Agent, or Firm*—Sughrue Mion, Pllc.

(57) ABSTRACT

A silver halide color photographic light-sensitive material, having at least one yellow dye image-forming layer, at least one magenta dye image-forming layer, and at least one cyan dye image-forming layer, each provided on a transparent support, which shows 3.0 or more maximum transmission densities for the respective layers upon area exposure with an exposure time of $10^{-4}$ sec, and shows a transmission density in a range of 0.95 to 1.05 when color development is started in 30 minutes after exposure with an exposure amount that gives a density of 1.0, when the light-sensitive material is subjected to color development started in 5 minutes after exposure; and an image-forming-method using the same.

24 Claims, No Drawings

SILVER HALIDE COLOR PHOTOGRAPHIC LIGHT-SENSITIVE MATERIAL, AND IMAGE-FORMING METHOD

FIELD OF THE INVENTION

The present invention relates to a silver halide color photographic light-sensitive material and an image-forming method using the same, and more specifically to a silver halide color photographic light-sensitive material and an image-forming method using the same that provide high density and high image quality, and little fluctuation of density resulting from variation of time period ranging from after exposure up to color-development processing, thereby realizing stable quality and enhanced productivity.

Further, the present invention relates to a silver halide color photographic light-sensitive material for scanning exposure, capable of forming an image by color development after scanning exposure according to an image-information; and to an image-forming method using the same. More particularly, the present invention relates to a silver halide color photographic light-sensitive material for a display, by which high saturation and high color density can be stably obtained and loss of letter- or image-edge definition (sharpness) has been improved; and to an image-forming method using the same.

Further, the present invention relates to a silver halide color display material and an image-forming method using the same. Particularly, the present invention relates to a silver halide color display material that is excellent in image display incorporating a character(s) with high density; and to an image-forming method using the same.

BACKGROUND OF THE INVENTION

Recently, the number of display (exhibition) advertisements, such as large-scale color photographic prints and ink jet prints, is increasing. The exhibiting methods includes, for example, a method of viewing an image formed on a support by light irradiated from the side of the image (reflection system), and a method of viewing the image by light irradiated from the back side of the image (transmission system). It is known that under particular conditions, such as the interior of a room and outdoors at night, the latter transmission system can provide a more vivid image than the former reflection system. Transmission-type image-forming materials/methods that are used for the aforementioned purpose include a printing system, an ink jet system, and a silver salt system. The printing system has an advantage in mass production. However, in the field of display advertisements that exhibit a variety—but a relatively small quantity—of images, an ink jet system or a silver salt system is preferable to the printing system. The ink jet system is becoming popular because of its convenience. On the other hand, the silver salt color photographic print remains superior in the art of advertising, because the silver salt system provides high image quality performance, owing, for example, to high contrast and rich gradation reproduction, and excellent stability of the image.

On the other hand, owing to the recent advancement of computer technologies, image processing in which image digitized reading, by means of a scanner, and the like, is processed on a computer, has been relatively easy to carry out. As a method to expose a light-sensitive material according to digitized image information, an image-forming method in which scanning exposure is carried out using a light source of high light intensity such as a laser or LED, has been rapidly gaining popularity. Resulting from the recent popularization of laser printers and digital prints, the above-said image-forming method has been common. Accordingly, there has been a continual need for a light-sensitive material having characteristics suitable for laser exposure and digital exposure. As print for a display advertisement, higher image density is requested, because a vivid image must be provided from its purpose of use.

Because the larger a display advertisement scale is, the greater the advertising effect is, a large-sized light-sensitive material is demanded for display advertising. According to the size of a light-sensitive material, a fair-sized exposing machine is also inevitably used. However, there is a size limit because of restriction on the size of the light-sensitive material. Therefore, if a large size exceeding the limit size is needed for display, the current practice is to put together two or more sheets of the light-sensitive material. Further, a high-quality image with higher density is requested for the transmission-type light-sensitive material. However, it has been found that, if two or more sheets of light-sensitive material providing a high quality image with high density as mentioned above, are put together to prepare an advertising medium of large size exceeding the above-mentioned limit size of the light-sensitive material, the continuity of the image at the connecting part is too poor to obtain an impressive advertisement of large size. JP-A-2000-249433 ("JP-A" means unexamined published Japanese patent application) discloses that a vivid image can be provided from making the image density higher, but it says nothing about such a problem as the lack of jointing suitability (change of chromaticness at the jointing part) and resolution of the problem.

In these transmission-type light-sensitive materials, two or more of which are put together for the particular use of a large-sized display advertisement, as mentioned above, the performance of the conventional light-sensitive materials is inadequate to keep high image quality with high density, and also inadequate to lessen the change of chromaticness resulting from plural light-sensitive materials that are put together as mentioned above. Therefore, improvement of the transmission-type light-sensitive material has been desired.

Recently, in the field of silver halide printing material for direct view, such as a silver halide color printing paper and a silver halide color display, in addition to a conventional area (plane) exposure system, a so-called scanning exposure system, in which scanning exposure is performed using lasers such as a semiconductor or gas laser, in accordance with digitized image-information, has been rapidly popularized accompanying the progress of computer technology, the popularization of digital cameras, and the progress of exposure technology. It is known that some of the performances that are not so important in a conventional silver halide photographic light-sensitive material for area exposure are becoming important in the aforementioned silver halide photographic light-sensitive material that is used for scanning exposure in accordance with digitized image-information. For instance, demands for the following performances exist:

To obtain sufficient color density even in a scanning exposure in which the exposure time per pixel (picture element) is extremely shorter than the conventional area exposure, a silver halide photographic light-sensitive material with less high illumination intensity reciprocity law failure, is requested. To reduce color-edge definition loss or unpreferable density fluctuation of images adjacent to and considerably different from each other in density or hue, such as narrow lines (for example, letters) and a geometrical pattern, sharpness of the exposure wavelength in each color must be sufficiently high and balance excellent, and further, sensitivity in the high-density region should be sufficiently high. To prevent so-called "tone-jump," in which density and color look strangely discontinuous on an image with gradation, gradation should not be extremely hard.

On the other hand, among the silver halide color printing materials for direct view, particularly in the color-display silver halide color photographic light-sensitive material having a coating on a transmission support or a semi-transmission support, it is general that the coating amounts of a silver halide and a coupler are larger than those of a silver halide color printing paper having a coating on a reflection-type support, in order to obtain sufficiently high density in the view through a transmission light. The color-developing time of the color-display silver halide photographic light-sensitive material is generally longer than that for color printing papers so that a sufficient color density can be obtained under the conditions of the large coating amount of a silver halide and a coupler, and increased film thickness resulting from the large coating amount. Also in such color display material, a photosensitive material that provides higher vividness and that is suitable to scanning exposure is demanded, accompanying the recent popularization of the scanning exposure system in accordance with digitized image-information. Recently, in particular, ink jet materials have been used for a color display. This situation further increases the demand for a color-display silver halide photosensitive material providing both higher density and high saturation, so that a display material of a silver salt system can keep its superiority to compete with commercial products of the aforementioned other system. However, the present inventors, having studied keenly, have found that an increase in coating amounts of both silver halide and a coupler, to thereby obtain a color-display silver halide photosensitive material providing both higher density and high saturation, causes the problem that fluctuation of image quality resulting from variation of processing is apt to occur. In other words, it has been found that the above-mentioned method has a defect that, resulting from variation of processing compositions and processing conditions, color murkiness occurs in the high-density region; a change in density of the unexposed portion, such as a white character or letter portion on a colored background, is apt to occur, and loss of letter- or image-edge definition is apt to occur.

Hitherto, a technique of a photosensitive material that provides a color density of 2.5 or more, as a printing material using a transmission support, is disclosed in, for example, JP-A-2000-249433. However, these photosensitive materials are unsatisfactory in the point of letter image-edge definition loss. Further, hitherto, a technique of a photosensitive material that is defined by a point gamma on the maximum color density at the time of calibration, is disclosed in, for example, JP-A-2000-227638. However, these photosensitive materials are also unsatisfactory in the point of letter image-edge definition loss. Further, hitherto, a technique to improve loss of letter image-edge definition by gradation control is also disclosed in, for example, JP-A-2000-352795 and JP-A-2001-324783. However, these two publications do not discuss transmission-type photosensitive material and the high-density region that is needed by the above-said photosensitive materials, and the photosensitive materials disclosed in these two publications are unsatisfactory against variation of processing compositions, processing conditions, and the like.

Accordingly, in the field of a color display material for scanning exposure, there is demand for a silver halide photographic light-sensitive material by which both high density and high saturation are obtained stably, even in variation of processing solution compositions and processing conditions, and loss of letter- and image-edge definition is reduced, and also the density of an unexposed portion is stable.

As means for showing many and unspecified persons various images, display methods that use self-emitting images so readily attract public attention that they are prominent (powerful) as an advertising media, in particular. These methods are classified into a method of displaying dynamic picture images by means of electronic display devices, represented by a cathode-ray tube and a plasma display panel, and a method of displaying stationary images by a combination of a transmission-type image-forming material and a light source (a so-called light box). The latter, economically practicable in comparison, is spreading widely. As the transmission-type image-forming method used for the afore-mentioned purpose, there are, for example, a printing system, an ink jet system, and a silver salt system. The printing system is characterized in that it has advantages in mass production and display of the same image. However, in the field of display advertising that produces a variety—but a relatively small quantity—of images, an ink jet system and a silver salt system, which can effectively produce a variety of images, are preferable to the printing system.

Comparing the ink jet system with the silver salt system, they have differing characteristics, as described below. The ink jet system can form images conveniently by means of a relatively economical apparatus. However, this system still leaves unsatisfactory results in image quality, such as contrast. On the other hand, the silver salt system, despite requiring a relatively expensive apparatus and relatively much time and labor for image formation, can provide images of high quality owing to high contrast and rich gradation reproduction. Accordingly, the silver salt system, characterized by end-products with high image quality, is in great demand in the field of advertising media, as a main field.

Further, the images displayed in such media are often formed by superimposing characters or symbols on natural images, such as landscape and figures, and by computer graphics. Recently, even the work of superimposing characters on natural images, as mentioned above, is mostly processed on a computer. Therefore, the image-forming material to be used in the above purpose must display images outputted from a computer.

A scan-exposing apparatus is used to output a computer-outputted image onto a light-sensitive material of the silver salt system. This is an apparatus for recording images, by scan-exposing a light-sensitive material with beams, such as a laser or LED, as a light source, in combination with a polygon mirror, an optical fiber, or the like according to image information. In the scanning exposure system, the exposure time is substantially about $10^{-4}$ sec per pixel, to shorten the exposing time required for the entire image, from the viewpoint of enhancing operating efficiency. Therefore, the scan-exposure time is extremely shorter than the exposure time (1/10 to 10 sec) of a conventional exposing apparatus.

Printing materials for scanning exposure that can be used for such short exposure have been sold commercially. However, these materials are not yet satisfactory in the point of forming images with high quality resulting from high contrast and rich gradation reproduction—the primary characteristic of the silver salt system. Particularly, this tendency is remarkable in the transmission-type printing material having a transparent or semitransparent support, in which high contrast has an effect on image quality.

Further, some scan-exposure apparatuses have such functions as that users can set a target density, and the apparatus can determine exposure conditions according to the target density set by the users. Such determination of exposure conditions is hereinafter referred to as calibration. If a conventional light-sensitive material is subjected to an exposure process setting at high density by means of the above-mentioned apparatus, color development does not exceed a limited level of density, or, even though colors develop, loss of color definition to another color different from the original color occurs, primarily in the character image, so that the resultant image becomes useless.

SUMMARY OF THE INVENTION

The present invention resides in a silver halide color photographic light-sensitive material, having at least one yellow dye image-forming layer, at least one magenta dye image-forming layer, and at least one cyan dye image-forming layer, each of which is provided on a transparent support, which shows 3.0 or more of maximum transmission densities for the respective layers upon area (or plane) exposure with an exposure time of $10^{-4}$ sec, and shows a transmission density in a range of 0.95 to 1.05 when color development is started in 30 minutes after exposure with an exposure amount that gives a transmission density of 1.0 when the light-sensitive material is subjected to color development started in 5 minutes after exposure.

Further, the present invention resides in an image-forming method, which comprises:

subjecting the silver halide color photographic light-sensitive material described above to scanning exposure to a light beam; and processing the exposed light-sensitive material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset maximum transmission density being 2.8 or more.

Further, the present invention resides in a silver halide color photographic light-sensitive material, which is suitable for scanning exposure, and is capable of forming an image by color development after scanning exposure according to image-information, wherein the silver halide color photographic light-sensitive material has a transmission support, and at least one yellow color developable light-sensitive silver halide emulsion layer, at least one magenta color developable light-sensitive silver halide emulsion layer, at least one cyan color developable light-sensitive silver halide emulsion layer, and at least one light-insensitive hydrophilic colloid layer that develops no color, each of which is provided on the transmission support, and wherein the silver halide color photographic light-sensitive material satisfies condition (A), and at least one of conditions (B) and (C):

Condition (A)

$0.30<\Delta EY(3.0)<0.65$,
$0.30<\Delta EM(3.0)<0.65$ and
$0.30<\Delta EC(3.0)<0.65$ Condition (B)

$0.50<\Delta EY(0.05)<0.80$,
$0.50<\Delta EM(0.06)<0.80$ and
$0.50<\Delta EC(0.05)<0.80$ Condition (C)

$94\leqq L^*$, $-0.2\leqq a^*\leqq 0.3$, and $-0.2\leqq b^*\leqq 0.8$ wherein, as to condition (A), ΔEY(3.0), ΔEM(3.0) and ΔEC(3.0) each represent a difference between an exposure amount necessary to give a transmission density of 1.0, and an exposure amount necessary to give a transmission density of 3.0, regarding yellow, magenta, and cyan, respectively, on characteristic curves that are obtained by color development of the light-sensitive material after exposure with an exposure time of $10^{-4}$ seconds; and, as to condition (B), ΔEY(0.05) and ΔEC(0.05) each represent a difference between an exposure amount necessary to give a transmission density of 1.0, and an exposure amount necessary to give a transmission density of 0.05, regarding yellow and cyan, respectively, on the characteristic curves that are obtained by color development of the light-sensitive material after exposure with an exposure time of $10^{-4}$ seconds; and, ΔEM(0.06) represents a difference between an exposure amount necessary to give a transmission magenta density of 1.0, and an exposure amount necessary to give a transmission magenta density of 0.06, on the characteristic curve that is obtained by color development of the light-sensitive material after exposure with an exposure time of $10^{-4}$ seconds; and, as to condition (C), L*, a* and b* each represent chromaticity of the light-sensitive material that is obtained by color development of said light-sensitive material after exposure with an exposure amount lower by 0.8 than the exposure amount necessary to give a transmission density of 1.0 regarding yellow, magenta and cyan, respectively, on the characteristic curves that are obtained by color development of said light-sensitive material after exposure with an exposure time of $10^{4}$ seconds.

Further, the present invention resides in an image-forming method, which comprises:

scan-exposing, according to image information, a silver halide color photographic light-sensitive material having a transmission support, and at least one yellow color developable light-sensitive silver halide emulsion layer, at least one magenta color developable light-sensitive silver halide emulsion layer, at least one cyan color developable light-sensitive silver halide emulsion layer, and at least one light-insensitive hydrophilic colloid layer that develops no color, each of which is provided on the transmission support; and processing the exposed light-sensitive material to color-develop, thereby obtaining an image, wherein said silver halide color photographic light-sensitive material satisfies the condition (A), and at least one of the conditions (B) and (C).

Further, the present invention resides in a silver halide color display material, having, on a transparent or semi-transparent support, at least one blue-sensitive silver halide emulsion layer, at least one green-sensitive silver halide emulsion layer, and at least one red-sensitive silver halide emulsion layer, wherein, when a neutral gray image is formed by area exposure with an exposure time of $10^{-4}$ sec to the display material, through an optical wedge using a xenon flash light source, a difference in density between the maximum color developed area and a non-color developed area of a respective dye image of cyan, magenta, or yellow, is 3.0 or more; and wherein, on a point gamma of the respective dye image at a density of 90% as much as the lowest density among the maximum developed color densities of the respective dye image, the relation between Pγmax and Pγmin is represented by formula (B):

$$P\gamma\min/P\gamma\max \geqq 0.60 \quad \text{Formula (B)}$$

in which Pγmax represents the maximum point gamma, and Pγmin represents the minimum point gamma.

Further, the present invention resides in an image-forming method, which comprises:

subjecting the silver halide color display material described above to scanning exposure to a light beam; and processing the exposed display material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset density being 3.0 or more.

Other and further features and advantages of the invention will appear more fully from the following description.

DETAILED DESCRIPTION OF THE INVENTION

According to the present invention, there are provided the following means:

(1) A silver halide color photographic light-sensitive material, having at least one yellow dye image-forming layer, at least one magenta dye image-forming layer, and at least one cyan dye image-forming layer, each of which is provided on a transparent support, which shows 3.0 or more of maximum transmission densities for the respective layers upon area exposure with an exposure time of $10^{-4}$ sec, and shows a transmission density in a range of 0.95 to 1.05 when color development is started in 30 minutes after exposure with an exposure amount that gives a transmission density of 1.0 when the light-sensitive material is subjected to color development started in 5 minutes after exposure.

(2) The silver halide color photographic light-sensitive material as described in the above item (1), wherein at least one silver halide emulsion layer contains silver halide emulsion grains having a silver chloride content of 95 mol % or more, and having incorporated therein at least one metal complex represented by formula (A):

$$[MX^I_nL^I_{(6-n)}]^m \quad \text{Formula (A)}$$

wherein M represents Cr, Mo, Re, Fe, Ru, Os, Co, Rh, Pd, or Pt; $X^I$ represents a halogen ion; $L^I$ represents an arbitrary ligand differing from $X^I$; n represents 3, 4, 5, or 6; and m represents 4−, 3−, 2−, 1−, 0, or 1+.

(3) An image-forming method, comprising:

subjecting the silver halide color photographic light-sensitive material according to the above item (1) or (2) to scanning exposure to a light beam; and processing the exposed light-sensitive material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset maximum transmission density being 2.8 or more.

(Hereinafter, a first embodiment of the present invention means to include the silver halide color photographic light-sensitive materials described in the items (1) and (2) above, and the image-forming method described in the item (3) above.)

(4) A silver halide color photographic light-sensitive material, which is suitable for scanning exposure, and is capable of forming an image by color development after scanning exposure according to image-information, wherein the silver halide color photographic light-sensitive material has a transmission support, and at least one yellow color developable light-sensitive silver halide emulsion layer, at least one magenta color developable light-sensitive silver halide emulsion layer, at least one cyan color developable light-sensitive silver halide emulsion layer, and at least one light-insensitive hydrophilic colloid layer that develops no color, each of which is provided on the transmission support, and wherein the silver halide color photographic light-sensitive material satisfies condition (A), and at least one of conditions (B) and (C):

Condition (A)

$0.30<\Delta EY(3.0)<0.65$,
$0.30<\Delta EM(3.0)<0.65$ and
$0.30<\Delta EC(3.0)<0.65$ Condition (B)

$0.50<\Delta EY(0.05)<0.80$,
$0.50<\Delta EM(0.06)<0.80$ and
$0.50<\Delta EC(0.05)<0.80$ Condition (C)

$94 \leqq L^*$, $-0.2 \leqq a^* \leqq 0.3$, and $-0.2 \leqq b^* \leqq 0.8$ wherein, as to condition (A), ΔEY(3.0), ΔEM(3.0), and ΔEC(3.0) each represent a difference between an exposure amount necessary to give a transmission density of 1.0, and an exposure amount necessary to give a transmission density of 3.0, regarding yellow, magenta, and cyan, respectively, on characteristic curves that are obtained by color development of the light-sensitive material after exposure with an exposure time of $10^{-4}$ seconds;

as to condition (B), ΔEY(0.05) and ΔEC(0.05) each represent a difference between an exposure amount necessary to give a transmission density of 1.0, and an exposure amount necessary to give a transmission density of 0.05, regarding yellow and cyan, respectively, on the characteristic curves that are obtained by color development of the light-sensitive material after exposure with an exposure time of $10^{-4}$ seconds; and, ΔEM(0.06) represents a difference between an exposure amount necessary to give a transmission magenta density of 1.0, and an exposure amount necessary to give a transmission magenta density of 0.06, on the characteristic curve that is obtained by color development of the light-sensitive material after exposure with an exposure time of $10^{-4}$ seconds; and as to condition (C), L*, a* and b* each represent chromaticity of the light-sensitive material that is obtained by color development of said light-sensitive material after exposure with an exposure amount lower by 0.8 than the exposure amount necessary to give a transmission density of 1.0 regarding yellow, magenta and cyan, respectively, on the characteristic curves that are obtained by color development of said light-sensitive material after exposure with an exposure time of $10^{-4}$ seconds.

(5) The silver halide color photographic light-sensitive material according to item (4), which satisfies the condition (A) and the condition (B).

(6) The silver halide color photographic light-sensitive material according to item (4), which satisfies the condition (A) and the condition (C).

(7) The silver halide color photographic light-sensitive material according to item (4), which satisfies the condition (A), the condition (B) and the condition (C).

(8) An image-forming method, comprising:

scan-exposing, according to image information, a silver halide color photographic light-sensitive material having a transmission support, and at least one yellow color developable light-sensitive silver halide emulsion layer, at least one magenta color developable light-sensitive silver halide emulsion layer, at least one cyan color developable light-sensitive silver halide emulsion layer, and at least one light-insensitive hydrophilic colloid layer that develops no color, each of which is provided on the transmission support; and processing the exposed light-sensitive material to color-develop, thereby obtaining an image, wherein said silver halide color photographic light-sensitive material satisfies the condition (A) described in item (4), and at least one of the conditions (B) and (C) described in item (4).

(9) The image-forming method according to item (8), wherein the silver halide color photographic light-sensitive material satisfies the condition (A) and the condition (B).

(10) The image-forming method according to item (8), wherein the silver halide color photographic light-sensitive material satisfies the condition (A) and the condition (C).

(11) The image-forming method according to item (8), wherein the silver halide color photographic light-sensitive material satisfies the condition (A), the condition (B) and the condition (C).

(Hereinafter, a second embodiment of the present invention means to include the silver halide color photographic light-sensitive materials described in the items (4), (5), (6) and (7) above, and the image-forming methods described in the items (8), (9), (10) and (11) above.)

(12) A silver halide color display material, having, on a transparent or semitransparent support, at least one blue-sensitive silver halide emulsion layer, at least one green-sensitive silver halide emulsion layer, and at least one red-sensitive silver halide emulsion layer, wherein, when a neutral gray image is formed by area exposure with an exposure time of $10_{-4}$ sec to the display material, through an optical wedge using a xenon flash light source, a difference in density between the maximum color developed area and a non-color developed area of a respective dye image of cyan, magenta, or yellow, is 3.0 or more; and wherein, on a point gamma of the respective dye image at a density of 90% as much as the lowest density among the maximum developed color densities of the respective dye image, the relation between Pγmax and Pγmin is represented by formula (B):

$$P\gamma\min/P\gamma\max \geqq 0.60 \qquad \text{Formula (B)}$$

in which Pγmax represents the maximum point gamma, and Pγmin represents the minimum point gamma.

(13) An image-forming method, comprising:

subjecting the silver halide color display material according to the above item (12) to scanning exposure to a light beam; and processing the exposed display material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset density being 3.0 or more.

(14) The silver halide color display material according to the above item (12), wherein, on the point gamma of the respective dye image of cyan, magenta, or yellow at the maximum developed color density area of an image for calibration in the silver halide color display material, the relation between Pγmax and Pγmin is represented by formula (B):

$$P\gamma\min/P\gamma\max \geqq 0.60 \qquad \text{Formula (B)}$$

in which Pγmax represents the maximum point gamma and Pγmin represents the minimum point gamma, wherein the image for calibration is obtained, by carrying out calibration using a scanning exposure apparatus for outputting said image for calibration that is used for calibrating exposure conditions for obtaining both a preset transmission density by densitometric measurement of the image for calibration, and a gray gradation up to the density, the preset density being 3.0 or more.

(15) The silver halide color display material according to the above item (12) or (14), wherein a molar ratio of silver halide to a dye-forming coupler in each of silver halide emulsion layers, except for the silver halide emulsion layer closest to the support, that is expressed by a ratio of an amount of substance silver halide/an amount of substance dye-forming coupler per unit area, is 4.7 or less.

(16) The image-forming method described in the above item (15), wherein the silver halide color display material described in the above item (13) is used.

(Hereinafter, a third embodiment of the present invention means to include the silver halide color display materials described in the items (12), (14) and (15) above, and the image-forming methods described in the items (13) and (16) above.)

Herein, the present invention means to include all of the above first, second and third embodiments, unless otherwise specified.

The present inventors have found that, when a light-sensitive material is exposed at the identical conditions, instability in the performance of the light-sensitive material to fluctuation factors after exposure is much more remarkable compared with previous light-sensitive materials/processing, when aiming to obtain an image having high density, particularly a high density of 3.0 or more. Further, in recent large-sized laser printers, often a roll-like light-sensitive material is continuously scan-exposed over several meters. After the exposed light-sensitive material is rewound, color development processing is carried out, initially from the exposure-terminating side of the light-sensitive material. Consequently, the time period from exposure to development processing may vary in the range of from several minutes to several tens of minutes in one operation. The present inventors have found that, fluctuation of the performance on this occasion is large when aiming to obtain an image having high density, particularly a high density of 3.0 or more; and when images are connected, the fluctuation results in a large change of chromaticness at a joint of the images.

The present inventors have also found that, to obtain a silver halide color display material by which high density can be attained upon scanning exposure, it is essentially necessary for high density to also be attained upon a conventional area exposure, and moreover, the relation of point gamma of three colors in the high density region is important.

The present inventors of the present invention have further studied intensively based on, for example, these findings, and, as a result, we have completed the present invention.

The present invention is explained in detail below.

First, the exposure is explained.

In the present invention, preferably in the first and third embodiments of the present invention, the term "area exposure with an exposure time of $10^{-4}$ sec" for use in measurement of the (maximum) transmission density means that exposure is given for an exposure time of $10^{-4}$ sec (herein, $1\times10^{-4}$ sec is referred to as $10^{-4}$ sec) per area (or plane). In other words, this term means that, using a xenon flash light source that is adjusted for an exposure time of $10^{-4}$ sec, and combined with an optical wedge and a color filter, an exposure necessary to obtain densities ranging from the minimum density to the maximum density is given to a light-sensitive material. At this time, the image obtained by color development processing described below contains densities ranging from the minimum density to the maximum density, and the status A transmission densities of yellow, magenta, and cyan are each adjusted to be 1.0 in the same exposure amount using a CC filter (color correction filter), if necessary. Thus, a gray image can be obtained.

Next, the transmission density is explained.

In the present invention, measurement of the transmission density is performed by a processing method of extending a color developing time to 110 sec, using CP-45X (color-development processing process for color papers, trade name, manufactured by Fuji Photo Film Co., Ltd.). As the processor, CSR24100 processor (trade name) manufactured by Noritsu was used. The state of a developing solution fluctuates with various factors. So, it is difficult to keep a definite condition of the developing solution. In view of the above, the processing was performed in a state of the running processing in which a transmission display film being also a color paper is processed in the rate of 40 to 60 $m^2$ a day, and in a state that a processing solution is replenished according to the recommended value of Technical Information published by Fuji Photo Film Co., Ltd. Color-development processing of the transmission-type color display film in the present invention was carried out under the following conditions.

Processing process for Fuji color papers CP-45X

| Processing steps | Processing temperature | Processing time | Replenishment rate |
|---|---|---|---|
| Color-development | 35 ± 0.3° C. | 110 sec | 370 ml/$m^2$ |
| Bleach-fixing | 33 to 37° C. | 110 sec | 494 ml/$m^2$ |
| Rinse | 24 to 34° C. | 220 sec | 3 to 10 L/$m^2$ |
| Drying | 50 to 70° C. | 3 min | |

The status A transmission densities of yellow, magenta and cyan of the processed sample is measured. Measurement was conducted using X-rite 310 (trade name) manufactured by X-rite Corporation.

It is necessary to previously set such condition that an image obtained by exposure through an optical wedge and development processing has a density ranging from the minimum density to the maximum density. Thereby the characteristic curve showing a transmission density to an exposure amount can be made so as to contain a density ranging from the minimum density to the maximum density. The highest density obtained in the characteristic curve is referred to as the maximum transmission density (which may be also referred to as the highest transmission density) according to the present invention.

When a light-sensitive material is subjected to a gray area exposure of an exposure time of $10^{-4}$ sec using xenon flash light source combined with an optical wedge, the maximum transmission density of each layer of the light-sensitive material is generally 3.0 or more in the present invention, preferably in the first embodiment of the present invention. The maximum transmission density of each layer is preferably in the range of 3.0 to 4.0, more preferably in the range of 3.2 to 4.0, and further preferably in the range of 3.3 to 3.8. If the maximum transmission density is too low, it is difficult to obtain a satisfactory image quality in black depth, etc. On the other hand, even if the maximum transmission density is too high, a further improvement effect on the image quality is small, but rather it is not preferable to increase the maximum transmission density too higher, because problems such as delay of development in the lower layer(s) and unevenness in processing arise since the coating amounts of emulsions and dye-forming couplers are necessarily to be considerably increased so as to obtain a high density.

In an exposure amount (exposure) to give a transmission density of 1.0 when the light-sensitive material of the present invention, preferably of the first embodiment of the present invention, is subjected to color-development started in 5 minutes after the exposure, a transmission density obtained when said light-sensitive material is subjected to color-development started in 30 minutes after the exposure is generally in the range of from 0.95 to 1.05, preferably in the range of from 0.97 to 1.03, more preferably in the range of from 0.99 to 1.01.

When a large-sized advertisement is prepared jointing plural light-sensitive materials having high density, a feeling of unnaturalness in image at the jointing area can be diminished by the adjustment of transmission density as mentioned above.

The scanning exposure to a light beam is generally carried out by a combination of a linear exposure to a light beam (raster exposure: main scan), and a relative shifting (sub scan) of a light-sensitive material in the direction perpendicular to the linear exposure direction. The term "scanning exposure to a light beam" used herein means exposure using such beams as a laser or LED as a light source. For example, the dram system and the polygon system, as described below, are often used. Namely, the dram system performs, simultaneously, both a main scan, conducted by a method of setting a light-sensitive material on the outer periphery or inner periphery of a cylindrical dram, and rotating the dram with irradiation of a light beam, and a sub scan, conducted by a method of shifting a light source in the direction perpendicular to the rotation direction of the dram. Further, the polygon system performs both a main scan, conducted by a method of irradiating a light beam on a rotating polygon mirror, and scanning the resultant reflection beam in the direction horizontal to the rotation direction of the polygon mirror, and a sub scan, conducted by a method of conveying a light-sensitive material in the direction perpendicular to the rotation direction of the polygon mirror. Further, when using an exposure apparatus in which plural light sources extending the width, or wider, of a light-sensitive material to be exposed thereto, are arranged in an array form, it is understood that the step corresponding to the main scan is substituted by the above-mentioned array-like light sources. Therefore, the array-like light sources are embraced in the category of the scanning exposure that can be used in the present invention.

A system in which using a mirror attached to a voice coil or the like, light beams are controlled by two axes of horizontal or vertical, to carry out scan-exposure of an immobilized light-sensitive material, may be considered to be included in the scan-exposure that can be used in the present invention. This is because the sweep direction of any one of the light beams may be taken as a main scanning direction, and a direction perpendicular to the main scanning direction as a sub-scanning direction. Further, there is a system in which using a device, which controls output light intensity based on digital information, such as a DMD and D-ILA, the quantity of light from a light source is controlled based on the digitized image information, to irradiate a light-sensitive material with the light. Although this system is not a scan-exposure system in the strict sense of the word, this system is also included in the scan-exposure apparatus that can be used in the present invention, from the viewpoint that digitized image information can be recorded in the light-sensitive material.

Next, the calibration is explained.

The calibration that can be used in the present invention means not only functions with which a scan-exposure apparatus can determine exposure conditions according to the target density set by a user in the scan-exposure apparatus, but also operations for determining the exposure conditions. The term "image for calibration" is an image in which gray patches with different densities are contained, in order to obtain information necessary for calibration.

As the scan-exposing apparatus that can be used for calibration in the present invention, for example, use can be made of commercially available ones, such as a laser printer Lambda 76 (trade name) manufactured by Durst Co.

The present inventors have found that the characteristic values of the image that are obtained by area exposure in an exposure time of $10^{-4}$ sec that is used to measure the maximum density, followed by color-development processing, are similar to those of the image obtained by scanning exposure to a light beam, followed by development processing, and are mutually well related to the characteristic properties of image quality obtained by scanning exposure to a light beam.

Next, the metal complex represented by the following formula (A) that can be preferably used in the present invention is explained.

$$[MX^I_nL^I_{(6-n)}]^m \qquad \text{Formula (A)}$$

In formula (A), M represents Cr, Mo, Re, Fe, Ru, Os, Co, Rh, Pd, or Pt; $X^I$ represents a halogen ion; $L^I$ represents an arbitrary ligand differing from $X^I$; n represents 3, 4, 5, or 6; and m represents 4−, 3−, 2−, 1−, 0, or 1+.

$X^I$ is preferably a fluoride ion, a chloride ion, a bromide ion or an iodide ion. Of these ions, chloride ion and bromide ion are more preferable.

$L^I$ may be inorganic ligands or organic ligands, each of which may or may not have a charge, with non-charged inorganic ligands being preferred. $L^I$ is preferably $H_2O$, OH, O, NO or NS, more preferably $H_2O$, NO or NS.

Of these metal complexes represented by formula (A), those represented by the following formula (IA) are preferred:

$$[M^{IA}X^{IA}_nL^{IA}_{(6-n)}]^m \qquad \text{Formula (IA)}$$

wherein $M^{IA}$ represents Re, Ru, Os, or Rh; $X^{IA}$ represents a halogen ion; $L^{IA}$ represents NO or NS, when $M^{IA}$ is Re, Ru, or Os, while $L^{IA}$ represents $H_2O$, OH, or O, when $L^{IA}$ is Rh; n represents 3, 4, 5, or 6; and m represents 4−, 3−, 2−, 1−, 0, or 1+. $X^{IA}$ has the same meaning as $X^I$ of formula (A), and a preferable range of $X^{IA}$ is also the same as $X^I$ in formula (A).

Preferable specific examples of the metal complexes represented by formula (A) are shown below. However, the present invention is not limited to these complexes.

$[ReCl_6]^{2-}$
$[ReCl_5(NO)]^{2-}$
$[RuCl_6]^{2-}$
$[RuCl_5]^{3-}$
$[RuCl_5(NO)]^{2-}$
$[RuCl_5(NS)]^{2-}$
$[RuBr_5(NS)]^{2-}$
$[OsCl_6]^{3-}$
$[OsCl_5(NO)]^{2-}$
$[OsBr_5(NS)]^{2-}$
$[RhCl_6]^{2-}$
$[RhCl_5(H_2O)]^{2-}$
$[RhCl_4(H_2O)_2]^{31}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

Of these compounds, $[OsCl_5(NO)]^{2-}$ and $[RhBr_6]^{3-}$ are particularly preferable.

The foregoing metal complexes are anionic ions. When these are formed into salts with cationic ions, counter cationic ions are preferably those easily soluble in water. Preferable examples thereof include an alkali metal ion such as a sodium ion, a potassium ion, a rubidium ion; a cesium ion and a lithium ion; an ammonium ion, and an alkyl ammonium ion. These metal complexes can be used being dissolved in water or in a mixed solvent of water and an appropriate water-miscible organic solvent (such as alcohols, ethers, glycols, ketones, esters and amides). These metal complexes of formula (A) are added in amounts of, preferably $1\times10^{-11}$ mole to $1\times10^{-6}$ mole, particularly preferably $1\times10^{-9}$ mole to $1\times10^{-7}$ mole, per mole of silver, during grain formation.

In the present invention, the above-mentioned metal complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, it is also preferable to employ a method in which the metal complex is doped into a silver halide grain, by preparing the fine particles doped with the complex in advance and adding the fine particles for carrying out physical ripening. Further, it is also preferable that these methods may be combined, to incorporate the complex into the inside of the silver halide grains.

In case where these metal complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having the metal complexes incorporated therein to modify the grain surface phase. Further, these methods may be used in combination. Two or more kinds of complexes may be incorporated in the inside of an individual silver halide grain. There is no particular restriction on the halogen composition at the location where the above-mentioned metal complexes are incorporated, and therefore they are preferably incorporated in any layer selected from a silver chloride layer, a silver chlorobromide layer, a silver bromide layer, a silver iodochloride layer and a silver iodobromide layer.

The metal complex represented by formula (A) is preferably used in combination with the following iridium complex.

In the present invention, preferably in the second embodiment of the present invention, the transmission density of each of yellow, magenta and cyan is defined in terms of yellow, magenta and cyan densities measured as status A.

In the present invention, the characteristic curves can be obtained, by color development, after exposure through color filters and an optical wedge for sensitometry for the exposure time of $10^{-4}$ second, using a xenon flash light source, followed by measurement of the thus-obtained transmission densities of yellow, magenta and cyan. In this time, the exposure must be controlled so that an exposure amount necessary to give the status-A transmission density of 1.0 after color development becomes the same exposure amount among yellow, magenta and cyan. Further, the developing process must be performed under the above-described conditions using CP-45X (processing process for color papers, manufactured by Fuji Photo Film Co., Ltd.).

In the present invention, preferably in the second embodiment of the present invention, the values L*, a*, and b* of the silver halide photographic light-sensitive material refer to L*, a*, and b* defined by CIE 1976 L* a* b* calorimetric color space. In the present invention, the tristimulus values X, Y, and Z that are used for measurement of L*, a*, and b* are defined as the values obtained by the following measurement:

A light-sensitive material processed by the above-described Processing process for Fuji color papers, CP-45X, is irradiated from its back-side using a genuine fluorescent lamp for color appraisal FL40S•N-EDL (trade name, manufactured by TOSHIBA LIGHTING & TECHNOLOGY CORPORATION), and the resulting transmitted light is measured, according to the method of the condition f, as described in JIS Z 8722 determining the method of measuring a reflection and transmission object color.

In the present invention, all exposure amounts are shown by logarithmic expression. For example, a difference in an exposure amount between two exposures in which the exposure time is same, but exposure intensity of illumination differs from each other by 10 times, is defined as 1.0 in the present invention. The silver halide photographic light-sensitive material of the present invention, preferably of the second embodiment of the present invention, preferably satisfies the condition (A).

Condition (A)

$0.30<\Delta EY(3.0)<0.65$, $0.30<\Delta EM(3.0)<0.65$ and $0.30<\Delta EC(3.0)<0.65$ In the condition (A), each of ΔEY(3.0), ΔEM(3.0) and ΔEC(3.0) represents the difference between an exposure amount necessary to give a transmission density of 1.0, and an exposure amount necessary to give a transmission density of 3.0, regarding each of yellow, magenta, and cyan, on the characteristic curves that are obtained by color development of the light-sensitive material after exposure in an exposure time of $10^{-4}$ seconds.

In the afore-mentioned condition (A), too small values of ΔEY(3.0), ΔEM(3.0) and ΔEC(3.0) are not preferable, because change of density resulting from fluctuation of the processing conditions becomes larger, and further under the condition of a scanning method of determining the maximum exposure amount by calibration, the calibration does not tend to stably converge. On the other hand, too large values of ΔEY(3.0), ΔEM(3.0) and ΔEC(3.0) are also not preferable, because loss of letter- and image-edge definition becomes conspicuous. It is more preferable that the values of ΔEY(3.0), ΔEM(3.0) and ΔEC(3.0) according to the present invention satisfy the following condition (A)-2.

Condition (A)-2

$0.35<\Delta EY(3.0)<0.60$, $0.35<\Delta EM(3.0)<0.60$ and $0.35<\Delta EC(3.0)<0.60$ One mode of the present invention, preferably of the second embodiment of the present invention, is that the silver halide photographic light-sensitive material of the present invention satisfies not only the afore-mentioned condition (A) but also the condition (B).

Condition (B)

$0.50<\Delta EY(0.05)<0.80$, $0.50<\Delta EM(0.06)<0.80$ and $0.50<\Delta EC(0.05)<0.80$ In the condition (B), each of ΔEY(0.05) and ΔEC(0.05) represents the difference between an exposure amount necessary to give a transmission density of 1.0, and an exposure amount necessary to give a transmission density of 0.05, regarding each of yellow and cyan, on the characteristic curves that are obtained by color development of the light-sensitive material after exposure in an exposure time of $10^{-4}$ seconds; and, ΔEM(0.06) represents the difference between an exposure amount necessary to give a transmission magenta density of 1.0, and an exposure amount necessary to give a transmission magenta density of 0.06, on the characteristic curve that is obtained by color development of the light-sensitive material after exposure in an exposure time of $10^{-4}$ seconds.

Too small values of ΔEY(0.05), ΔEM(0.06) and ΔEC (0.05) are not preferable, because change of density resulting from fluctuation of the processing conditions becomes larger, and a so-called "tone-jump" in which a density looks strangely discontinuous on the image with gradation becomes apt to occur. On the other hand, too large values of ΔEY(0.05), ΔEM(0.06) and ΔEC(0.05) are not preferable, because fluctuation of saturation of the image having both high density and high saturation (gradation) becomes apt to occur owing to variation of the processing, and loss of letter- and image-edge definition also becomes apt to occur.

It is more preferable that the values of ΔEY(0.05), ΔEM (0.06) and ΔEC(0.05) according to the present invention satisfy the following condition (B) −2.

Condition (B)-2

$0.55<\Delta EY(0.05)<0.70$, $0.55<\Delta EM(0.06)<0.70$ and $0.55<\Delta EC(0.05)<0.70$ Another mode of the present invention, preferably of the second embodiment of the present invention, is that the silver halide photographic light-sensitive material of the present invention satisfies not only the aforementioned condition (A) but also the following condition (C).

Condition (C)

$94 \leqq L^*$, $-0.2 \leqq a^* \leqq 0.3$, and $-0.2 \leqq b^* \leqq 0.8$

In the condition (C), L*, a*, and b* each represent chromaticity of the light-sensitive material that is obtained by color development of said light-sensitive material after exposure with an exposure amount lower by 0.8 (log E) than the exposure amount necessary to give a transmission density of 1.0 regarding each of yellow, magenta and cyan on the characteristic curves that are obtained by color development of said light-sensitive material after exposure in an exposure time of $10^{-4}$ seconds. To examine whether the afore-mentioned condition (C) is satisfied or not, measurement may be carried out using any chromaticity-measuring apparatus capable of measuring chromaticity on the CIE 1976 L* a* b* colorimetric color space.

Further, it is more preferable in the present invention that the values of L*, a* and b* satisfy the following condition (C)-2.

Condition (C)-2

$95 \leqq L^*$, $-0.1 \leqq a^* \leqq 0.2$, and $0.0 \leqq b^* \leqq 0.5$

Further, in the present invention, preferably in the second embodiment, it is also preferable that the light-sensitive material satisfies all of the conditions (A), (B) and (C), at the same time.

In the present invention, the values of ΔEY(0.05), ΔEM (0.06) and ΔEC(0.05) defined by the afore-mentioned condition (B) and/or the values of L*, a* and b* defined by the afore-mentioned condition (C), are affected by so many factors such as sensitivity, gradation and fog of the light-sensitive material, remaining dyes after processing, and adsorption of soil that is generated in a processing solution. In order to stabilize the values of ΔEY(0.05), ΔEM(0.06) and ΔEC(0.05) and/or the values of L*, a* and b*, it is preferable that the silver halide photographic light-sensitive material of the present invention, preferably of the second embodiment of the present invention, contains a compound represented by any one of the following formulae (I) to (III):

Formula (I)

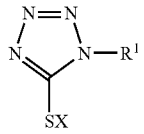

Formula (II)

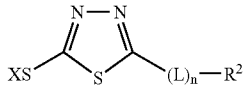

Formula (III)

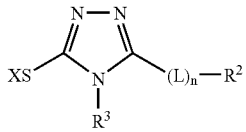

wherein, in the formulas (I), (II) and (III), $R^1$, $R^2$ and $R^3$ each independently represent a hydrogen atom, an alkyl group, an alkenyl group, or an aryl group; X represents a hydrogen atom, an alkali metal atom, an. ammonium group, or a precursor; L represents a divalent connecting group; and n is 1 or 0.

Each group will be hereinafter explained in detail.

In X, the alkali metal atom is, for example, a sodium atom or a potassium atom; the ammonium group is, for example, a tetramethylammonium group or a trimethylbenzylammonium group. Also, the precursor is a group capable of taking the form X=H or X=an alkali metal under alkali condition, and it represents, for example, an acetyl group, a cyanoethyl group, or a methanesulfonylethyl group.

In $R^1$, $R^2$ and $R^3$, the alkyl group and the alkenyl group include an unsubstituted body and a substituted body, and further include alicyclic groups (namely, a cycloalkyl group and cycloalkenyl group). Examples of a substituent on the substituted alkyl group include a halogen atom, nitro group, cyano group, hydroxyl group, alkoxy group, aryl group, acylamino group, alkoxycarbonylamino group, ureido group, amino group, heterocyclic group, acyl group, sulfamoyl group, sulfonamido group, thioureido group, carbamoyl group, alkylthio group, arylthio group, heterocyclic thio group, and further, carboxylic acid group, sulfonic acid group, and salts of these groups. The above ureido group, thioureido group, sulfamoyl group, carbamoyl group, and amino group each include an unsubstituted one, N-alkyl substituted one, and N-aryl substituted one. Examples of a substituent on the substituted alkenyl group include those exemplified as the substituent of the above substituted alkyl group.

In $R^1$ to $R^3$, examples of the aryl group include a phenyl group and a substituted phenyl group, and examples of a substituent include an alkyl group and the examples on the substituent of the alkyl group exemplified above.

Specific examples of the divalent connecting group represented by L include —N($R^4$)—, —N($R^4$)—CO—, —N($R^4$)—$SO_2$—, —N($R^4$)—CO—N($R^5$)—, —S—, —CH($R^4$)—, —C($R^4$)($R^5$)—, —CS—, or a combination of these groups. Here, $R^4$ and $R^5$ each represent a hydrogen atom, an alkyl group or an aralkyl group.

Specific examples of the compound represented by any one of the formulae (I) to (III) include the compounds described in JP-A-2-123350, on page 10 to page 17. Among these compounds, preferable and specific examples are listed in the following, though not limited to these compounds.

The silver halide photographic light-sensitive material of the present invention, preferably of the second embodiment of the present invention, contains the compound represented by any one of formulae (I) to (III) preferably in an amount ranging from $1.0\times10^{-6}$ to $5.0\times10^{-2}$ mol, more preferably in an amount ranging from $1.0\times10^{-5}$ to $1.0\times10^{-3}$ mol, per mol of the silver halide. As the time when the compound represented by any one of formulae (I) to (III) are introduced into the silver halide photographic light-sensitive material of the present invention, the period of time when a silver halide emulsion or a coating solution is prepared is preferable. In the case of introduction during preparation of a silver halide emulsion, it is preferable to add the compound to the silver halide emulsion in which chemical ripening has not finished after completion of the physical ripening. Preferable specific examples of the compound represented by any of formulae (I) to (III) are shown below, but the present invention is not limited to these examples.

(I-1)

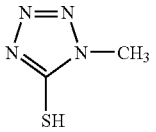

(I-2)

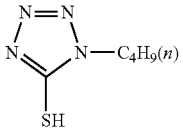

(I-3)

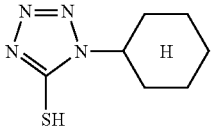

(I-4)

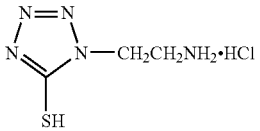

(I-5)

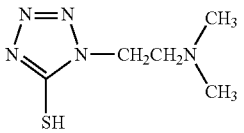

(I-6)

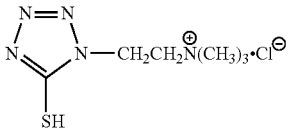

-continued (I-7)

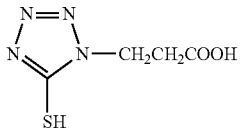

(I-8)

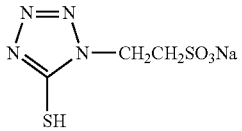

(I-9)

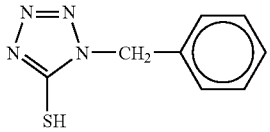

(I-10)

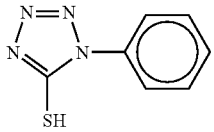

(I-11)

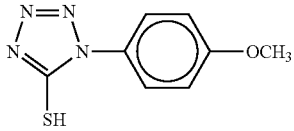

(I-12)

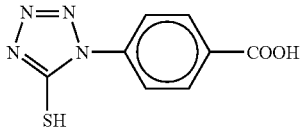

(I-13)

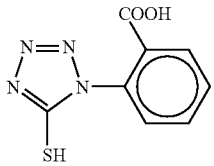

(I-14)

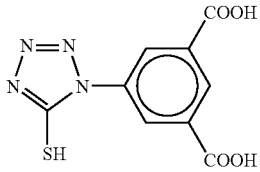

(I-15)

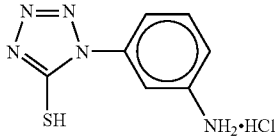

(I-16)

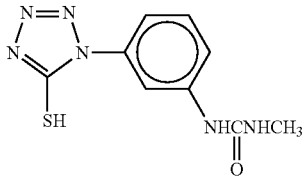

-continued
(I-17)
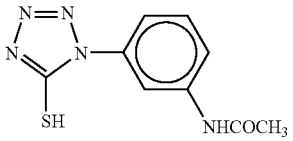
(I-18)
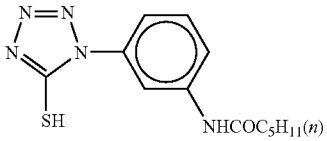
(I-19)
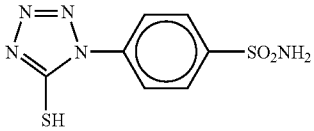
(I-20)
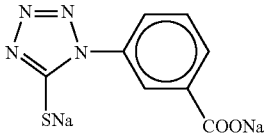
(I-21)
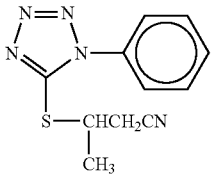
(I-22)
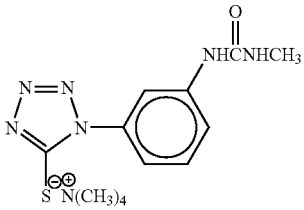
(II-1)
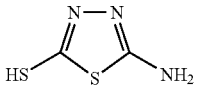
(II-2)
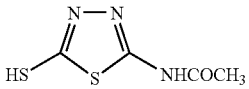
(II-3)
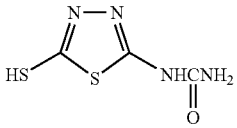
(II-4)
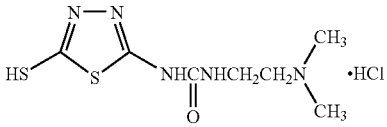
(II-5)
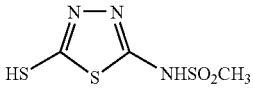
-continued
(II-6)
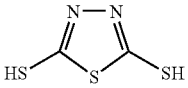
(II-7)
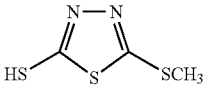
(II-8)
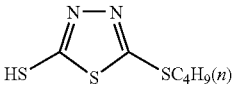
(II-9)
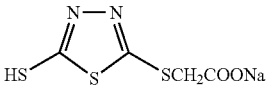
(II-10)
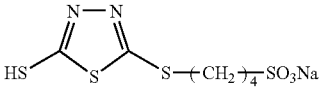
(II-11)
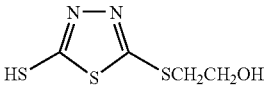
(II-12)
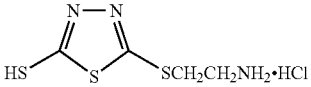
(II-13)
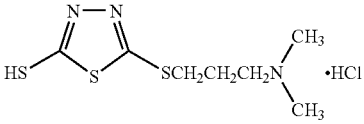
(II-14)
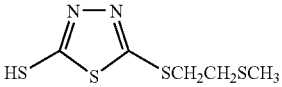
(II-15)
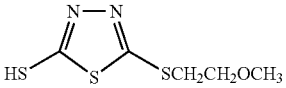
(II-16)
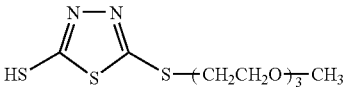
(II-17)
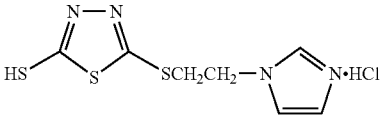
(II-18)
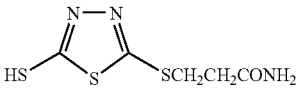
(II-19)
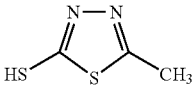
(II-20)
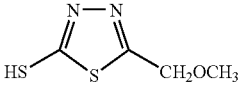

-continued
(II-21)
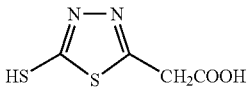
(II-22)
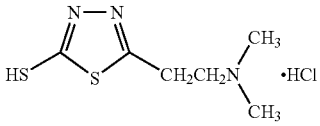
(III-1)
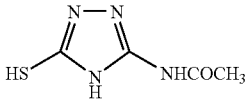
(III-2)
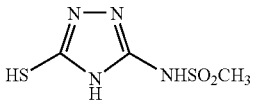
(III-3)
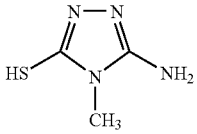
(III-4)
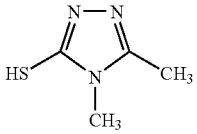
(III-5)
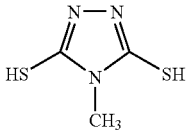
(III-6)
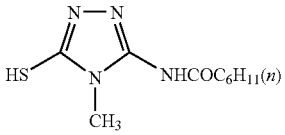
(III-7)
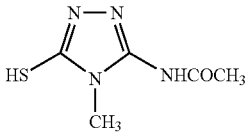
(III-8)
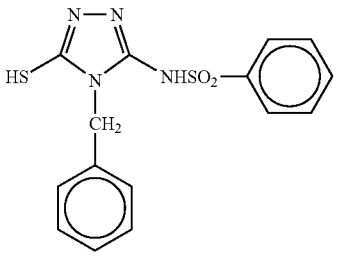
-continued
(III-9)
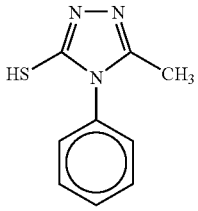
(III-10)
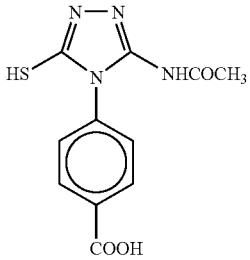
(III-11)
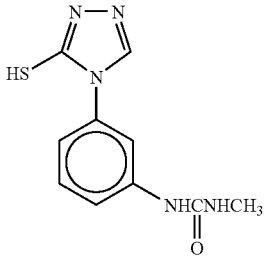
(III-12)
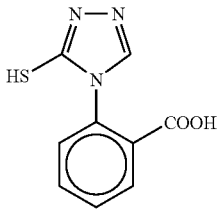
(III-13)
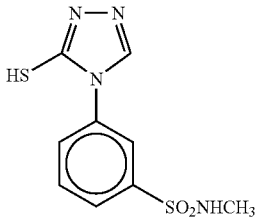
(III-14)
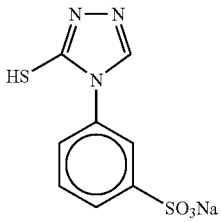
Further, to stabilize the values of ΔEY(0.05), ΔEM(0.06) and ΔEC(0.05) and/or the values of L*, a*, and b*, it is preferable that the silver halide photographic light-sensitive material of the present invention, preferably of the second embodiment of the present invention, contains an antioxidant.

The antioxidant may be any of an organic antioxidant and an inorganic antioxidant, and an organic antioxidant is preferable.

The antioxidant for use in the present invention, preferably in the second embodiment of the present invention, preferably has a molecular weight of 330 or less. There is no particular restriction in the lower limit of the molecular weight, but the molecular weight of 40 or more is preferable. The molecular weight of 200 to 330 is particularly preferable. These antioxidants are preferably water-soluble compounds.

Examples of the antioxidant that can be preferably used in the present invention include catechol derivatives, hydroquinone derivatives, trihydroxybenzene derivatives such as gallic acid derivatives, 1,2-, 2,3- or 1,4-dihydroxynaphthalene derivatives, reductones such as ascorbic acid derivatives, reductic acid derivatives, aminophenol derivatives, hydroxylamines, hydrazines, and 2-cyclopenten-1-one or 2-cyclohexen-1-one derivatives substituted with a group selected from a hydroxy group, amino group or substituted amino group (including a cyclic amino group) at both the second and third positions.

Among these compounds, the following compounds (1) or (2) are preferable.

(1) Compounds Represented by the Following Formula (IV)

Formula (IV)

Formula (IV)

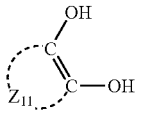

In the formula (IV), $Z_{11}$ represents a group of atoms necessary to complete a carbon ring or hetero ring together with the C═C, which may be substituted with a substituent.

(2) 2-Cyclopenten-1-one or 2-cyclohexen-1-one Derivatives Substituted with a Group Selected from a Hydroxy Group, Amino Group or Substituted Amino Group (Including a Cyclic Amino Group) at Both the 2- and 3-Positions (Provided that a Hydroxyl Group is not Present at the 2- and 3-Positions at the Same Time)

The compound represented by the formula (IV) in the above (1) will be further explained.

In the formula (IV), $Z_{11}$ represents a group of atoms necessary to form a carbon ring or hetero ring, together with the C═C. Specific and preferable examples of the carbon ring include a benzene ring and naphthalene ring. Specific and preferable examples of the hetero ring include five to seven-membered rings containing an oxygen atom as a hetero atom. Specific examples of a substituent with which these rings can be substituted include an alkyl group, alkoxy group, alkoxycarbonyl group, hydroxyl group and sulfonic acid group.

Among the compounds of the formula (IV), a compound having at least one sulfonic acid group (or a sulfonate group) on an aromatic carbon ring is particularly preferable. Particularly preferable and specific examples of the antioxidant include the specific examples IV-(19), IV-(22) and IV-(39) which will be shown below.

The 2-cyclopenten-1-one or 2-cyclohexen-1-one derivatives in the above (2) will be further explained.

As described above, two groups selected from a hydroxy group, amino group or substituted amino group are present at both the 2- and 3-positions, the case where a hydroxy group is present at one of the 2- and 3-positions and an amino group or substituted amino group is present at the other position is preferable, the case where a hydroxy group is present at the 2-position and an amino group or substituted amino group is present at the 3-position is more preferable, and the case where a hydroxy group is present at the 2-position and pyrrolidin-1-yl, piperidin-1-yl or morpholin-1-yl is present at the 3-position is still more preferable. The 2-cyclopenten-1one derivatives are preferable to the 2-cyclohexen-1-one derivatives. Specific examples include the exemplified compounds (IV)-(48) and (IV)-(49) which will be shown below.

Further, the antioxidant for use in the present invention, preferably in the second embodiment of the present invention, is preferably a compound having the oxidation potential (Eox) of: Eox≦1.5(V), more preferably Eox≦1.2(V), further preferably 0.3≦Eox≦0.8(V). The oxidation potential Eox of the antioxidant can be readily measured by one skilled in the art. The method of measurement is described, for example, by A. Stanienda, *Naturwissenschaften*, Vol. 47, pp.353 and 512 (1960), P. Delahay, *New Instrumental Methods in Electrochemistry* (1954), published by Interscience Publishers, and L. Mites, *Polarographic Techniques*, Second edition (1965), published by Interscience Publishers. The afore-mentioned value of Eox refers to a potential at which electrons of a test compound are pulled out on the anode in volt-ammetry. The potential primarily relates to the highest occupied electron energy level in the ground state of the compound.

The Eox referred to in the present invention is a value measured from the half-wave potential of polarograph under the conditions described below. Namely, using acetonitrile as a solvent for the antioxidant, 0.1N sodium perchlorate as a supporting electrolytic solution, an antioxidant in the concentration of from $10^{-3}$ mole to $10^{-4}$ mole per liter, and Ag/AgCl electrode as a reference electrode, the Eox was measured using a rotating platinum plate electrode, at 25° C.

It is particularly preferable that the antioxidant is directly added to a silver halide emulsion layer of the photosensitive material of the present invention, preferably of the second embodiment of the present invention, to incorporate it therein. Alternatively, the antioxidant may be added to a light-insensitive layer containing a hydrophilic colloid as a binder, such as an interlayer, a protective layer, a yellow filter layer and an anti-halation layer. Further, addition of the antioxidant to both the light-sensitive emulsion layer and the above-mentioned light-insensitive layer is also effective. The addition time of the antioxidant, when added to a light-sensitive emulsion layer, may be any time until coating process is completed, but preferably the period ranging from the beginning of chemical ripening to the completion of coating process, and more preferably after completion of chemical ripening. Further, the antioxidant may be added to a light-insensitive layer, thereby diffusing it over the photograph-constituting layers at the time of coating process.

The antioxidant may be added as a solution of the antioxidant dissolved in water, as well as in an organic solvent that is miscible with water and selected from lower alcohols, esters and ketones, or in a mixture of these solvents. Alternatively, the antioxidant may be dissolved in a high-boiling-point solvent and the like, and then added in the form of a dispersion of the antioxidant. The amount of the antioxidant to be added is preferably in the range of from $10^{-2}$ mole to $10^{-8}$ mole per mole of silver halide, especially preferably in the range of from $10^{-3}$ mole to $10^{-5}$ mole per mole of silver halide. The addition amount of the antioxidant may be properly selected depending on the kinds of silver halide and antioxidants, etc. Further, when the antioxidant is incorporated in a light-insensitive layer, good results can be obtained by coating an aqueous hydrophilic colloid solution containing the antioxidant in an amount of preferably from 0.01 g to 50 g, more preferably from 0.05 g to 10 g, per g of the hydrophilic colloid, respectively. The antioxidant may be used solely, or in combination of two or more of the antioxidants.

Specific examples of the antioxidant include the following compounds, but the present invention should not be construed as being limited to these compounds.

(IV)-(1)

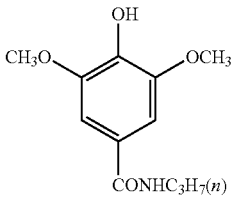

(IV)-(2)

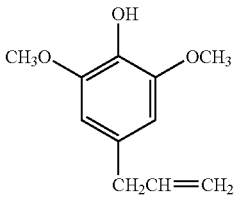

(IV)-(3)

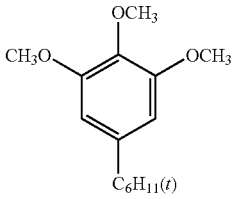

(IV)-(4)

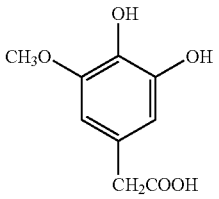

(IV)-(5)

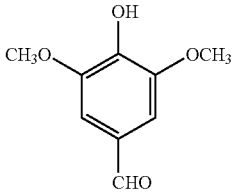

-continued (IV)-(6)

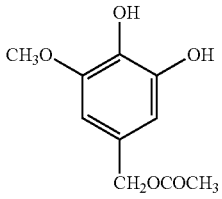

(IV)-(7)

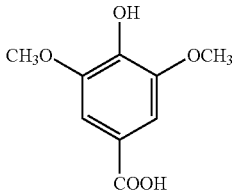

(IV)-(8)

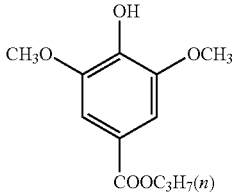

(IV)-(9)

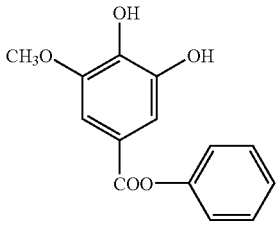

(IV)-(10)

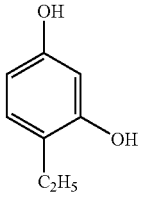

(IV)-(11)

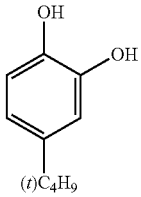

(IV)-(12)

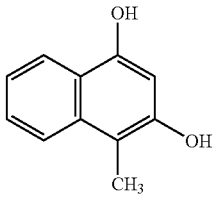

(IV)-(13)

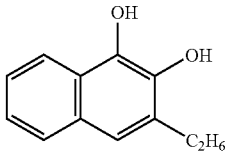

-continued
(IV)-(14)
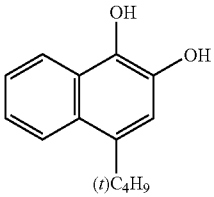
(IV)-(15)
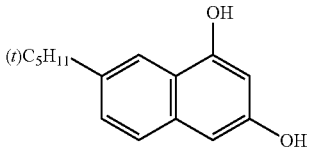
(IV)-(16)
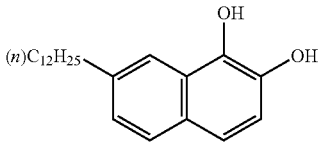
(IV)-(17) Sodium sulfite
(IV)-(18) Sodium bisulfite
(IV)-(19) Ascorbic acid
(IV)-(20)
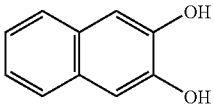
(IV)-(21)
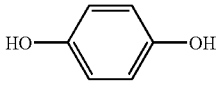
(IV)-(22)
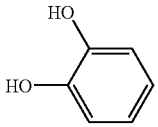
(IV)-(23) $NH_2OH \cdot HCl$
(IV)-(24)
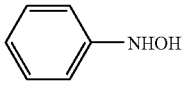
(IV)-(25)
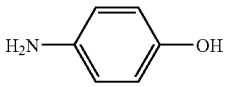
(IV)-(26) $CH_3NHNHCH_3$
(IV)-(27) $CH_3NHOH$
(IV)-(28)
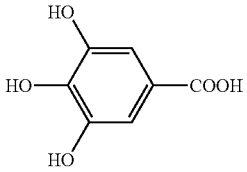
-continued
(IV)-(29)
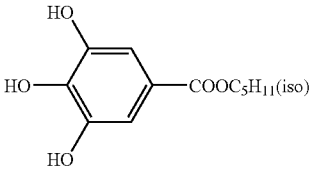
(IV)-(30)
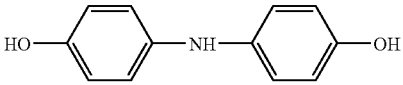
(IV)-(31)
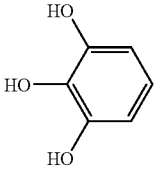
(IV)-(32)
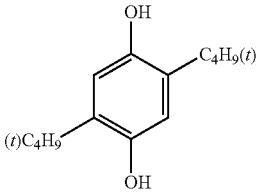
(IV)-(33)
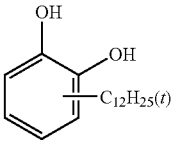
(IV)-(34)
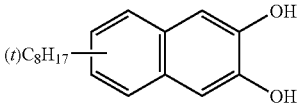
(IV)-(35)
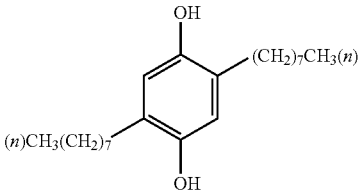
(IV)-(36)
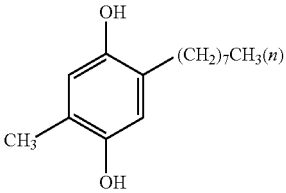
(IV)-(37)
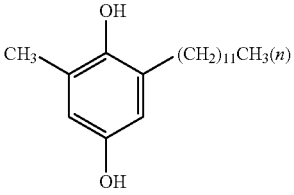

-continued
(IV)-(38)
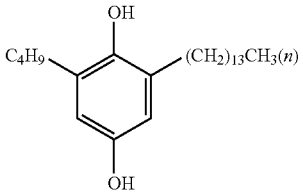
(IV)-(39)
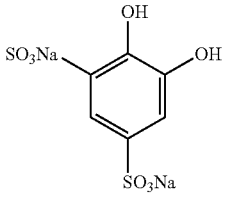
(IV)-(40)
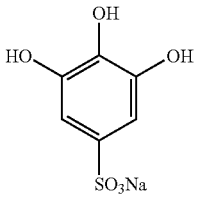
(IV)-(41)
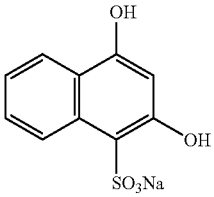
(IV)-(42)
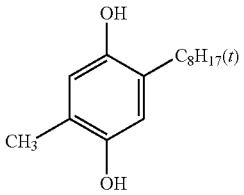
(IV)-(43)
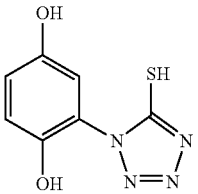
(IV)-(44)
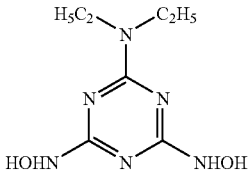
(IV)-(45)
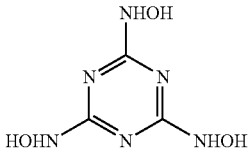
-continued
(IV)-(46)
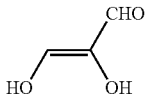
(IV)-(47)
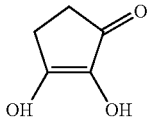
(IV)-(48)
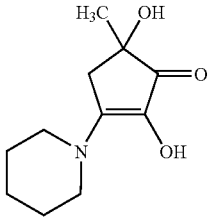
(IV)-(49)
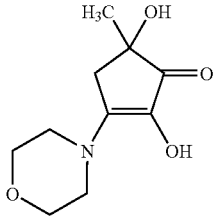
(IV)-(50)
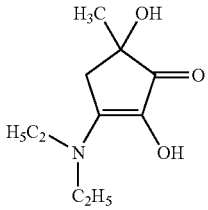
(IV)-(51)
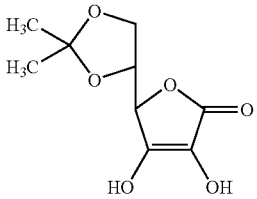
(IV)-(52)
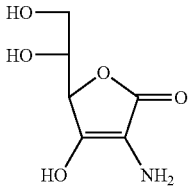
(IV)-(53)
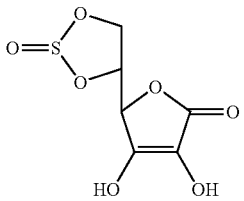

-continued
(IV)-(54)
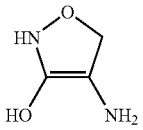
(IV)-(55)
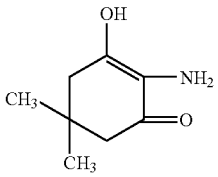
(IV)-(56)
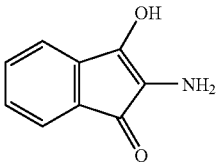
(IV)-(57)
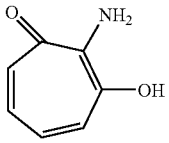
(IV)-(58)
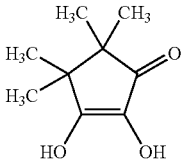
(IV)-(59)
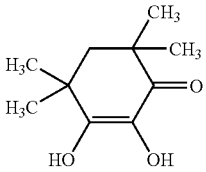
(IV)-(60)
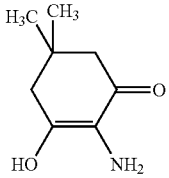
(IV)-(61)
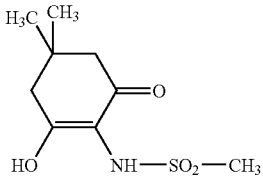
(IV)-(62)
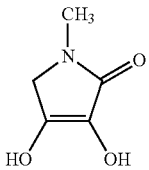
-continued
(IV)-(63)
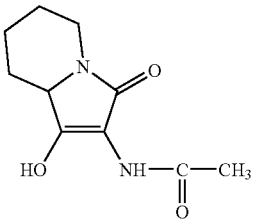
(IV)-(64)
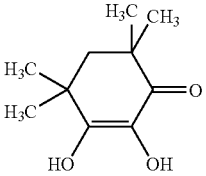
(IV)-(65)
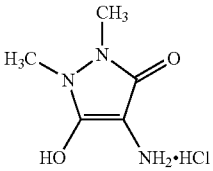
(IV)-(66)
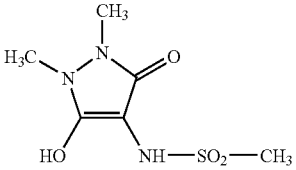
(IV)-(67)
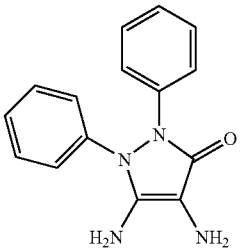
(IV)-(68)
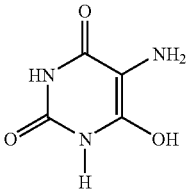
(IV)-(69)
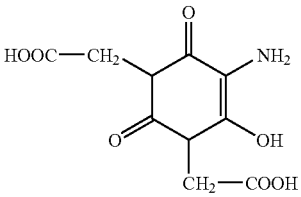
(IV)-(70)
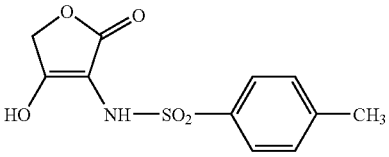

-continued (IV)-(71)

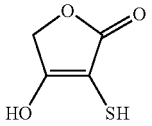

(IV)-(72)

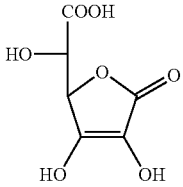

(IV)-(73)

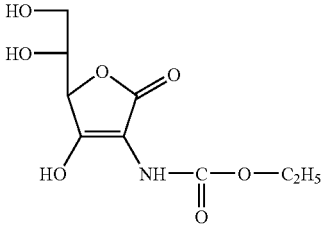

(IV)-(74)

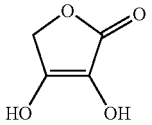

(IV)-(75)

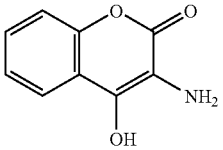

(IV)-(76)

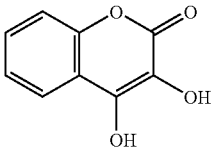

(IV)-(77)

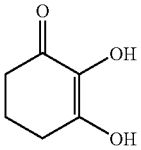

(IV)-(78)

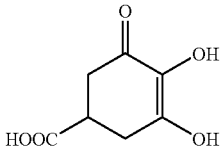

(IV)-(79)

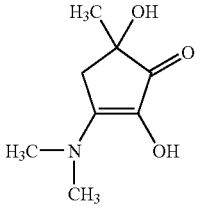

-continued (IV)-(80)

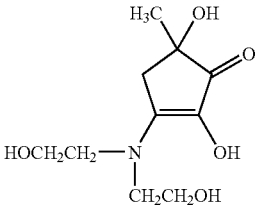

(IV)-(81)

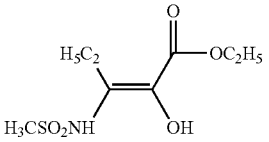

(IV)-(82)

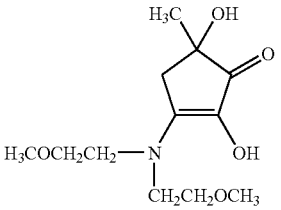

(IV)-(83)

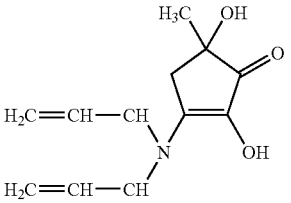

(IV)-(84)

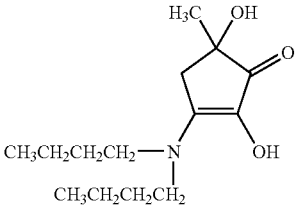

(IV)-(85)

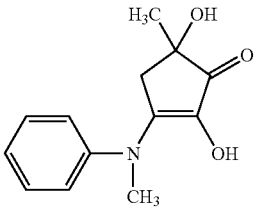

To adjust the values of ΔEY(0.05), ΔEM(0.06) and ΔEC (0.05) and/or the values of L*, a*, and b* in the present invention, preferably in the second embodiment of the present invention, for example, a coating amount of silver and/or couple may be controlled, and/or an oil-soluble coloring dye or pigment may be added to a photosensitive material. In the present invention, preferably in the second embodiment of the present invention, the oil-soluble coloring dye- or pigment-containing layer may be a light-sensitive layer containing a silver halide emulsion, or any light-insensitive layer, such as an interlayer disposed between silver halide emulsion layers, an ultraviolet-absorbing layer disposed on the silver halide emulsion layer, or an underlayer composed of gelatin. As for the silver halide emulsion layer, a coating flow rate is generally altered to adjust a characteristic curve. In view of the above, for regulation of toning, it is often preferable to introduce the pigment into a light-insensitive layer rather than a light-sensitive layer containing a silver halide emulsion.

Generally, yellow stain is conquered by blue-tinting. Such tinting is generally performed by adding a pigment in an amount sufficient to compete with yellow stain so as to form a neutral color which looks like white by a human eye. Further, it is possible to correct the yellow stain over the wide range, by using two or more kinds of pigment with different amounts to be used from each other. Generally a blue pigment which changes a resulting hue to the cyan side, and a red or violet pigment which changes a resulting hue to the magenta side, are used in combination. Such combination use enables to control the tint over the wide range.

The pigment for use in the present invention, preferably in the second embodiment, is not particularly limited, so long as it is water-insoluble. Particularly preferably, the pigment has a strong affinity to an organic solvent and moreover it is easily dispersed in the organic solvent.

Generally, in order to effectively tint, the particle size of the pigment is preferably 0.01 μm to 5 μm, more preferably 0.01 μm to 3 μm.

In the present invention, preferably in the second embodiment, the pigment is particularly preferably introduced as follows:

Similarly to the method in which a photographically useful substance such as an ordinary dye-forming coupler (also referred to as a coupler herein) is emulsified and dispersed, and the resulting dispersion is included in a light-sensitive material, the pigment for use in the present invention is added to a high-boiling-point organic solvent to form an uniform spontaneous dispersion composed of fine-particles of the pigment. The resulting dispersion is emulsified and dispersed together with a dispersing agent of a surface active agent, in a hydrophilic colloid (preferably an aqueous gelatin solution), by means of a known device such as ultrasonic, colloid mill, homogenizer, Manton-Gaulin, or high-speed DISOLVER, so that a dispersion of the pigment can be obtained in the form of fine particles of the pigment.

The high-boiling-point organic solvent that can be used in the present invention, preferably in the second embodiment, is not particularly limited, and ordinary ones can be used. Examples of the solvent include those described in U.S. Pat. No. 2,322,027 and JP-A-7-152129.

An auxiliary solvent may be used together with the high-boiling-point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, β-ethoxyethyl acetate, methyl cellosolve acetate, methyl carbitol acetate, and cyclohexanone.

The pigment that will be described in detail below, for use in the present invention, preferably in the second embodiment, is particularly preferably used as an emulsion which is prepared by including the pigment in an organic solvent having dissolved therein a photographically useful compound such as a coupler for use in the light-sensitive material of the present invention, and then subjecting the resulting mixture to co-emulsification.

The present invention, in particular, the second embodiment of the present invention in some cases, is explained in more detail with reference to the following some specific examples, but the present invention is not limited to those examples, unless otherwise specified.

In the present invention, any kind of pigment can be used without limitation, so long as the pigment enables to control the color tone as required and also can remain in a light-sensitive material without changing itself at the time of processing. Preferable pigments are explained with reference to specific examples below. The term "blue pigment" for use in the present invention refers to a pigment classified as the C.I. Pigment Blue in "Color Index" (The Society of Dyers and Colourists). Similarly, the term "red pigment" and the term "violet pigment" for use in the present invention refer to a pigment classified as the C.I. Pigment Red and a pigment classified as the C.I. Pigment Violet, in "Color Index", respectively.

Examples of the blue pigment for use in the present invention include organic pigments, such as azo pigments (e.g., C.I. Pigment Blue 25), phthalocyanine pigments (e.g., C.I. Pigment Blues 15:1, 15:3, 15:6, 16, 75), indanthrone pigments (e.g., C.I. Pigment Blues 60, 64, 21), basic dye lake pigments of triarylcarbonium series (e.g., C.I. Pigment Blues 1, 2, 9, 10, 14, 62), acidic dye lake pigments of triarylcarbonium series (e.g., C.I. Pigment Blues 18, 19, 24:1, 24:x, 56, 61), and indigo pigments (e.g., C.I. Pigment Blues 63, 66). Among these pigments, indanthrone pigments, basic dye lake pigments and acidic dye lake pigments of triarylcarbonium series, and indigo pigments are preferred in view of the resultant hue. Further, indanthrone pigments are particularly preferred from the viewpoint of fastness.

As the blue pigment, ultramarine and cobalt blue each of which is an inorganic pigment, can also be preferably used in the present invention.

Among indanthrone pigments for use in the present invention those having high affinity to an organic solvent are particularly preferred. Such pigments can be selected from commercially available products. For example, Blue A3R-KP (trade name) and Blue A3R-K (trade name), each of which is manufactured by Ciba Specialty Chemicals, can be used.

In order to control the hue in the present invention, red and/or violet pigments are preferably used in combination with the blue pigment. Preferable examples of the red pigment include azo pigments (e.g., C.I. Pigment Reds 2, 3, 5, 12, 23, 48:2, 48:3, 52:1, 53:1, 57:1, 63:2, 112, 144, 146, 150, 151, 166, 175, 176, 184, 187, 220, 221, 245), quinacridone pigments (e.g., C.I. Pigment Reds 122, 192, 202, 206, 207, 209), diketopyrrolopyrrol pigments (e.g., C.I. Pigment Reds 254, 255, 264, 272), perylene pigments (e.g., C.I. Pigment Reds 123, 149, 178, 179, 190, 224), perynone pigments (e.g., C.I. Pigment Red 194), anthraquinone pigments (e.g., C.I. Pigment Reds 83:1, 89, 168, 177), benzimidazolone pigments (e.g., C.I. Pigment Reds 171, 175, 176, 185, 208), basic dye lake pigments of triarylcarbonium series (e.g., C.I. Pigment Reds 81:1, 169), thioindigo pigments (e.g., C.I. Pigment Reds 88, 181), pyranthrone pigments (e.g., C.I. Pigment Reds 216, 226), pyrazoloquinazolone pigments (e.g., C.I. Pigment Reds 251, 252), and isoindoline pigments (e.g., C.I. Pigment Red 260). Among these pigments, azo pigments, quinacridone pigments, diketopyrrolopyrrol pigments and perylene pigments are more preferred. Azo pigments and diketopyrrolopyrrol pigments are particularly preferred.

Preferable examples of the violet pigment include azo pigments (e.g., C.I. Pigment Violets 13, 25, 44, 50), dioxazine pigments (e.g., C.I. Pigment Violets 23, 37), quinacridone pigments (e.g., C.I. Pigment Violets 19, 42), basic dye lake pigments of triarylcarbonium series (e.g., C.I. Pigment Violets 1, 2, 3, 27, 39), anthraquinone pigments (e.g., C.I. Pigment Violets 5:1, 33), perylene pigments (e.g., C.I. Pigment Violet 29), isoviolanthrone pigments (e.g., C.I.

Pigment Violet 31), and benzimidazolone pigments (e.g., C.I. Pigment Violet 32). Among these pigments, azo pigments, dioxazine pigments and quinacridone pigments are more preferred. Dioxazine pigments are particularly preferred.

Among dioxazine pigments for use in the present invention those having high affinity to an organic solvent are particularly preferred. Such pigments can be selected from commercially available products. For example, Violet B-K (trade name) and Violet B-KP (trade name), each of which are manufactured by Ciba Specialty Chemicals, can be used.

In order to control the hue in the present invention, other pigments (those classified into C.I. Pigment Yellow, C.I. Pigment Orange, C.I. Pigment Brown, C.I. Pigment Green, respectively) may be used in addition to the above-mentioned pigments.

Specific compounds are described in "Color Index" (The Society of Dyers and Colourists), and by W. Herbst and K. Hunger, *Industrial Organic Pigments* (VCH Verlagsgesellschaft mbH (1993)).

As the pigment recited above, one which has not been treated or one which has been surface-treated may be used in the present invention. As the surface treatment, for example, a method of surface-coating with a resin or wax, a method of adhering a surface active agent, a method of binding a reactive material (e.g., a silane coupling agent, an epoxy compound, a polyisocyanate) to the surface of pigment, and a method of employing a pigment derivative (synergist) are proposed, as described in the following literatures:

*Kinzoku Sekken no Seishitsu to Oyo* (*Properties and Applications of Metal Soap*)(Saiwai Shobo),

*Insatsu Inki Gijyutsu* (*Printing Ink Technology*) (CMC Shuppan, 1984), and

*Saishin Ganryo Oyo Gijyutsu* (*The newest Pigment Applied Technology*) (CMC Shuppan, 1986).

Of these pigments, easily dispersive pigments which are commercially available in the form of the pigment whose surface is previously coated with a resin or wax, are called instant pigments (for example, Microlith pigment, trade name, manufactured by Ciba Specialty Chemicals). Such an instant pigment is particularly preferred on account that when the pigment is introduced into a light-sensitive material, no dispersion is necessary, but the pigment is able to excellently disperse in a high boiling point organic solvent. In this case, the high boiling point organic solvent having the pigment dispersed therein may be further dispersed in a hydrophilic colloid such as gelatin.

In the present invention, as mentioned above, the pigment may be dispersed in a high boiling point organic solvent, followed by further dispersing of the resulting dispersion into a hydrophilic colloid such as gelatin. Alternatively, the pigment may be directly dispersed in a hydrophilic colloid. At this time, various kinds of dispersants, such as surfactant type-low molecular dispersants and high molecular dispersants, may be used, in accordance with a binder and a pigment to be used together. Employment of the high molecular-type dispersant is more preferred from the viewpoint of dispersion stability. Examples of the dispersant include those described in JP-A-3-69949 and European Patent No. 549 486.

A particle size after dispersion of the pigment for use in the present invention is preferably in the range of 0.01 μm to 10 μm, more preferably in the range of 0.02 μm to 1 μm.

In order to disperse the pigment in a binder, known dispersion methods which are applied for the production of ink, toner, and the like, may be used. Examples of the dispersing machine include sand mill, atliter, pearl mill, super mill, ball mill, impeller, disperser, KD mill, colloid mill, dynatron, three-leg roll mill, and pressure kneader. The details are described in *Saishin Ganryo Oyo Gijyutsu* (*The Newest Pigment Applied Technology*) (CMC Shuppan, 1986).

The total amount to be used of the pigments that can be used in the present invention is preferably in the range of 0.1 $mg/m^2$ to 20 $mg/m^2$, more preferably in the range of 1 $mg/m^2$ to 10 $mg/m^2$. Further, a blue pigment is preferably used in combination with other pigments having different hue from that of the blue pigment. A method in which a pigment is added to the hydrophilic colloidal layer forming the photographic structural layer is more preferable to a method in which a pigment is added to the polyolefin coating resin of the support, because the amount of the pigment required to adjust the same tint can be largely decreased, bringing about a large costly merit.

When the blue pigment is used in combination with the aforementioned red pigment and/or violet pigment in the present invention, they may be used, by dispersing in the same hydrophilic colloid layer or in different hydrophilic colloid layers. That is, the layer to which the blue pigment is added is not particularly limited.

In the present invention, it is also preferable to control the white background by using an oil-soluble dye for the photographic structural layer of the light-sensitive material. Typical specific examples of the oil-soluble dye include Compounds 1 to 27 described in JP-A-2-842, page (8) to page (9).

Also, in the present invention, it is possible to control the white background, by compounding a fluorescent whitening agent in the hydrophilic colloidal layer of the light-sensitive material, and allowing the fluorescent whitening agent to remain in the light-sensitive material after the light-sensitive material is processed. Also, a polymer catching a fluorescent whitening agent such as polyvinyl pyrrolidone may be compounded in the light-sensitive material.

The silver halide grains contained in the silver halide emulsion for use in the present invention, preferably in the first and third embodiments of the present invention, have an average grain size (the grain size herein means a diameter of the circle equivalent to the projected area of an individual silver halide grain, and the number average is taken as the average grain size) of preferably from 0.01 μm to 2 μm.

Alternatively, in the present invention, preferably in the second embodiment of the present invention, the grain size of a silver halide grain may be specified as a side length of a cube having the same volume as an individual silver halide grain. In this case, the average grain size is defined as a number average of the above grain size (volume equivalent-cubic side length) among silver halide grains. In this time, however, the average grain size must be calculated using solely silver halide grains capable of substantially contributing to dye formation resulting from a reaction with a coupler upon development. Accordingly, a fine grain emulsion having substantially no sensitivity must be neglected from calculation of the average grain size. In the present invention, preferably in the second embodiment of the present invention, the average grain size of silver halide grains in a yellow color-developable light-sensitive silver halide emulsion layer is preferably 0.70 μm or less, more preferably 0.65 μm or less, and further preferably 0.60 μm or less. The lower limit of the grain size of silver halide grains in a yellow color-developable light-sensitive silver halide emulsion layer is not set in particular. However, if the grain size is too small, there is a possibility to invite insufficiency of sensitivity and stain on the white ground resulting from an increase in a coating amount of a sensitizing dye. So long as the above-mentioned problem does not arise, the lower limit of the grain size may be set arbitrarily. Said lower limit is preferably 0.15 μm, more preferably 0.20 μm. The average grain size of silver halide grains in a magenta color-developable light-sensitive silver halide emulsion layer and a cyan color-developable light-sensitive silver halide emulsion layer is preferably 0.6 μm or less, more preferably 0.5 μm or less. The lower limit of the grain size of these silver halide grains is preferably 0.15 μm, more preferably 0.20 μm.

It is preferable that the grain size distribution of silver halide grains for use in the present invention is homogeneous. The grain size distribution is preferably a state of so-called "mono-dispersion" having coefficient of variation (the value obtained by dividing a standard deviation of grain size distribution by an average grain size) of generally 20% or less, preferably 15% or less, more preferably 10% or less. Further in order to attain wide latitude, two or more kinds of the above-mentioned mono-dispersion emulsions are preferably blended in the same layer, or coated to form separate layers (multi-coating layers).

In the present invention, any known method for measuring silver halide grain size can be used. Of these methods, preferred is a method of measuring a size of each of grains observed by an electron microscope.

In the present invention, preferably in the third embodiment of the present invention, the point gamma can be obtained from measuring the Status A density of a sample exposed through an optical wedge and developed to gray, and plotting the resulting densities to the logarithm of the exposure amount (to give a so-called sensitometry curve or characteristic curve). As for the sensitometry curve, there are detailed descriptions, for example, edited by T. H. James, *The Theory of the Photographic Process*, 4th edition, pp. 501 to 509. As defined on page 502 in this reference, the point gamma is:

$$\text{Point gamma}=dD/d\log E,$$

and represents a differential value at an arbitrary point on the sensitometry curve. The meaning (semantics) of the point gamma is discussed, for example, by R. Lutter, *Trans. Faraday Soc.*, Volume 19, p. 340 (1923).

Specifically, for example, the point gamma is measured as follows:

A sample is exposed through a wedge having an optical density ranging from 0 to 4, using a xenon flash light source. At this time, a CC filter (color correction filter) can be used to adjust the hue of the processed sample to gray. For color-development processing, a linear speed is adjusted so that a color-developing time (P1) would be 110 sec, with a processing solution CP-45X (trade name), manufactured by Fuji Photo Film Co., Ltd., and a CSR automatic processor (trade name), manufactured by Noritsu. The sample thus obtained is subjected to densitometry to measure a Status A density, using a densitometer X-rite 310 (trade name), manufactured by X-rite Company.

The term "gray hue", herein used means that the chromaticity is within the following calorimetric range, when the density in the vicinity of about the minimum density+1.5 is measured, and a fluorescent lamp for color evaluation is used as an observation light source in the L*a*b* colorimetric system.

$$|a^*|<3, \text{ and } |b^*|<3$$

The silver halide color display material (hereinafter sometimes referred to as a silver halide color photographic light-sensitive material) and the image-forming method of the present invention, preferably of the third embodiment of the present invention, are explained below.

The silver halide color display material of the present invention, preferably of the third embodiment of the present invention, has at least one blue-sensitive silver halide emulsion layer, at least one green-sensitive silver halide emulsion layer, and at least one red-sensitive silver halide emulsion layer, on a transparent or semi-transparent support. When a neutral gray image is formed by area exposure in an exposure time of $10^{-4}$ sec to said display material, through an optical wedge, using a xenon flash light source, a difference in density between the maximum color developed area and the non-color developed area of the dye image of each of cyan, magenta and yellow, is 3.0 or more. With regard to the point gamma of each dye image at the density of 90% as much as the lowest density among the maximum color densities of the each dye image, the relation between Pγmax and Pγmin is represented by the formula (B), wherein Pγmax represents the maximum point gamma, and Pγmin represents the minimum point gamma.

$$P\gamma\text{min}/P\gamma\text{max}\geqq 0.60 \qquad \text{Formula (B)}$$

In the present invention, preferably in the third embodiment of the present invention, a difference in density between the maximum color developed area and the non-color developed area of the dye image of each of cyan, magenta and yellow, is generally 3.0 or more respectively, preferably in the range of 3.0 to 4.0, more preferably in the range of 3.2 to 4.0, and furthermore preferably in the range of 3.3 to 3.8. If the difference in density is too small, it is difficult to obtain a satisfactory image quality in the points such as black depth. On the other hand, even though the difference in density is made too large, a further improvement effect on the image quality is small, but rather it is not preferable to increase the difference too higher, because problems, such as a delay of development in the lower layer(s) and unevenness in processing arise, due to that the coating amounts of emulsions and dye-forming couplers must considerably be increased so as to obtain high density.

Herein, the density at the non-color developed area is generally 0.00 to 0.05, and 0.02 to 0.05 in many cases, in terms of a transmission density.

The ratio Pγmin/Pγmax is preferably 0.65 or more, more preferably 0.70 or more, and further preferably 0.75 or more, and it is preferably 1.0 or less.

The image-forming method of the third embodiment of the present invention is a method, which comprises the steps of: subjecting the above-mentioned silver halide color display material to scanning exposure to light beam; and then, processing the thus-exposed display material, to carry out color-development. In this method, the scanning exposure is carried out by means of an apparatus, having functions of outputting an image for calibration that is used for calibrating exposure conditions for obtaining both a preset maximum transmission density by densitometric measurement of the image for calibration and a gray gradation up to the density; and said preset developed density (maximum developed density) is 3.0 or more.

Further, in the scan-exposing apparatus that can be preferably used in the image-forming method of the present invention, preferably of the third embodiment of the present invention, the preset maximum developed density for calibration in the present invention is preferably 3.0 or more, more preferably in the range of 3.0 to 4.0, further preferably in the range of 3.2 to 4.0, and most preferably in the range of 3.3 to 3.8.

Herein, with regard to the point gamma of each dye image of cyan, magenta and yellow in the maximum developed density of the image for calibration, it is preferable that the relation between Pγmax and Pγmin is represented by the formula (B), wherein Pγmax represents the maximum point gamma, and Pγmin represents the minimum point gamma.

$$P\gamma\min/P\gamma\max \geqq 0.60 \quad \text{Formula (B)}$$

The ratio of Pγmin/Pγmax is preferably 0.65 or greater, more preferably 0.70 or greater, and further preferably 0.75 or greater, and it is preferably 1.0 or less.

The silver halide color photographic light-sensitive material (hereinafter, sometimes referred to simply as "photosensitive material") of the present invention is explained in more detail below.

In the present invention, preferably in the third embodiment, the molar ratio of silver halide to a dye-forming coupler in each of silver halide emulsion layers except for the silver halide emulsion layer closest to the support, which is the ratio of (an amount of substance silver halide)/(an amount of substance dye-forming coupler), per unit area, is preferably 4.7 or less, more preferably in the range of 4.7 to 2.0, further preferably in the range of 4.7 to 2.5, and most preferably in the range of 4.7 to 3.0.

An amount (for example, a coating amount) of silver halide to be used in the silver halide color photographic light-sensitive material of the present invention is preferably in the range of 0.40 g/m$^2$ to 2.0 g/m$^2$, more preferably in the range of 0.60 g/m$^2$ to 1.7 g/m$^2$.

In the present invention, a ratio of the amount of an oil-soluble component to the amount of a hydrophilic binder in the photographic constituting layers may be arbitrarily set. The ratio in the photographic constituting layers other than a protective layer is preferably in the range of 0.05 to 1.50, more preferably in the range of 0.10 to 1.40, and particularly preferably in the range of 0.20 to 1.30, in terms of mass ratio. By optimization of the ratio in each layer, film strength, resistance to scratch, and anti-curl characteristics may be controlled.

It is preferable that the silver halide color photographic light-sensitive material of the present invention is defined in terms of total coating amount of gelatin. The total coating amount of gelatin is generally in the range of 5.0 to 25 g/m$^2$, preferably in the range of 8.0 to 18 g/m$^2$.

As a hydrophilic binder in the silver halide color photographic light-sensitive material of the present invention, gelatin can be used. If necessary, other hydrophilic colloids, such as gelatin derivatives, graft polymers of gelatin and other polymers, proteins other than gelatin, sugar derivatives, cellulose derivatives, and synthetic hydrophilic high molecular materials (for example, homo- or co-polymers), may be used in combination with gelatin. As the gelatin that can be used in the silver halide color photographic light-sensitive material of the present invention, either lime-treated gelatin or acid-treated gelatin may be used. Further, any kinds of gelatin produced using a raw material such as cattle bone, cattle skin and pigskin may be used. Among these, a lime-treated gelatin produced using cattle bone or pigskin as a raw material is preferable.

The silver halide photographic light-sensitive material of the present invention can be used for a black-and-white photography or a color photography. Preferably, the later-described silver halide emulsion according to the present invention is used in a silver halide color photographic light-sensitive material.

The silver halide color photosensitive material of the present invention has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler.

In the present invention, the silver halide emulsion layer containing a yellow dye-forming coupler functions as a yellow color-forming (color-developing) layer, the silver halide emulsion layer containing a magenta dye-forming coupler functions as a magenta color-forming layer, and the silver halide emulsion layer containing a cyan dye-forming coupler functions as a cyan color-forming layer. Preferably, the silver halide emulsions contained in the yellow color-developing layer, the magenta color-developing layer, and the cyan color-developing layer may have photo-sensitivities to mutually different wavelength regions of light (for example, light in a blue region, light in a green region and light in a red region).

In the present invention, a film thickness of the photographic constituting layer is preferably in the range of 22 μm to 3.0 μm, more preferably in the range of 20.0 μm to 4.0 μm, most preferably in the range of 18.0 μm to 8.0 μm. The film thickness of the photographic constituting layer in the present invention refers to a thickness of the photographic constituting layer that is provided on a support and has not been processed yet. Specifically, the film thickness can be measured by either one of the two methods described below. The first method is a process of cutting a silver halide color photographic light-sensitive material in the direction perpendicular to the support and measuring the resultant section observed by means of an electron microscopy. The second method is a process of calculating a film thickness based on a coating amount (g/m$^2$) and a specific gravity of each component in the photographic constituting layer. The specific gravities of gelatin and silver chloride grains that are representative components used for photography, are 1.34 g/ml and 5.59 g/ml, respectively. The specific gravities of other lipophilic additives can also be measured. Therefore, the film thickness can be calculated by the second method.

In addition to the yellow color-developing layer, the magenta color-developing layer, and the cyan color-developing layer, the photosensitive material of the present invention may have a hydrophilic colloid layer, an antihalation layer, an intermediate layer, and a coloring layer, if necessary, as described below.

The silver halide emulsion preferably used in the present invention will be described in detail hereinbelow.

Silver halide grains in the silver halide emulsion which can be used in the present invention are preferably cubic or tetradecahedral crystal grains substantially having {100} planes (these grains may be rounded at the apexes thereof and further may have planes of high order), or octahedral crystal grains. Alternatively, a silver halide emulsion in which the proportion of tabular grains having an aspect ratio of 2 or more and composed of {100} or {111} planes accounts for 50% or more in terms of the total projected area, can also be preferably used. The term "aspect ratio" refers to the value obtained by dividing the diameter of the circle having an area equivalent to the projected area of an individual grain by the thickness of the grain. In the present invention, cubic grains, or tabular grains having {100} planes as major faces, or tabular grains having {111} planes as major faces are preferably used.

As a silver halide emulsion which can be used in the present invention, for example, silver chloride, silver bromide, silver iodobromide, or silver chloro(iodo)bromide emulsion may be used. In the present invention, preferably in the second embodiment of the present invention, it is preferable for rapid processing to use a silver chloride, silver chlorobromide, silver chloroiodide, or silver chlorobromoiodide emulsion having a silver chloride content of 90 mol % or greater, more preferably said silver chloride, silver chlorobromide, silver chloroiodide, or silver chlorobromoiodide emulsion having a silver chloride content of 98 mol % or greater. Alternatively, in the present invention, preferably in the first and third embodiments of the present invention, it is preferable that at least one silver halide emulsion layer contains a silver halide emulsion having a silver chloride content of 95% by mole or more. In the present invention, preferably in the first and third embodiments of the present invention, it is more preferable that each silver halide emulsion layer contains a silver halide emulsion having a silver chloride content of 95% by mole or more. The silver halide emulsion for use in the present invention, preferably in the first and third embodiments of the present invention, is preferably a silver chloride, silver chlorobromide, silver iodochloride, or silver chloroiodobromide emulsion having a silver chloride content of 95% by mole or more, and more preferably a silver chloride, silver chlorobromide, silver iodochloride, or silver chloroiodobromide emulsion having a silver chloride content of 98% by mole or more.

Preferred of these silver halide emulsions are those having in the shell parts of silver halide grains, a silver iodochloride phase to give a silver iodide content of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide localized phase to give a silver bromide content of 0.2 to 5 mol %, more preferably 0.5 to 3 mol %, per mol of the total silver, since both high sensitivity and stabilization of photographic properties are attained. Further, a silver chloroiodebromide emulsion whose silver iodide content and silver bromide content are within the above ranges, respectively, is particularly preferably.

To a silver halide emulsion grain for use in the present invention, it is preferable that iodide ions are introduced to make the grain include silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as an alkali or alkali earth iodide salt. Alternatively, iodide ions may be introduced by cleaving the iodide ions from an organic molecule, as described in U.S. Pat. No. 5,389,508. As another source of iodide ion, fine silver iodide grains may be used.

The addition of an iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, an emulsion having higher sensitivity and lower fog can be obtained.

The distribution of an iodide ion concentration in the depth direction in a grain can be measured according to an etching/TOF-SIMS (Time of Flight-Secondary Ion Mass Spectrometry) method by means of, for example, a TRIFT II Model TOF-SIMS apparatus (trade name, manufactured by Phi Evans Co.). A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection-Secondary Ion Mass Spectrometry*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. It is preferred that the silver halide emulsion for use in the present invention when it contains silver iodide, has the maximum concentration of iodide ions at the surface of the grain, and the iodide ion concentration decreases inwardly in the grain, by analysis with the etching/TOF-SIMS method.

The silver halide emulsion grains to be used in the light-sensitive material of the present invention preferably have a silver bromide localized phase.

When the silver halide emulsion for use in the present invention contains a silver bromide localized phase, the silver bromide localized phase is preferably formed by epitaxial growth of the localized phase having a silver bromide content of at least 10 mol % on the grain surface. In addition, the emulsion grains preferably have the outermost shell portion having a silver bromide content of at least 1 mol % or more in the vicinity of the surface of the grains.

The silver bromide content of the silver bromide localized phase is preferably in the range of 1 to 80 mol %, and most preferably in the range of 5 to 70 mol %. The silver bromide localized phase is preferably composed of silver having population of 0.1 to 30 mol %, more preferably 0.3 to 20 mol %, to the molar amount of entire silver which constitutes silver halide grains for use in the present invention. The silver bromide localized phase is preferably doped with complex ions of a metal of the Group VIII, such as iridium ion. The amount of these compounds to be added can be varied in a wide range depending on the purposes, and it is preferably in the range of $10^{-9}$ to $10^{-2}$ mol, per mol of silver halide.

In the present invention, ions of a transition metal are preferably added in the course of grain formation and/or growth of the silver halide grains, to include the metal ions in the inside and/or on the surface of the silver halide grains. The metal ions to be used are preferably ions of a transition metal. Preferable examples of the transition metal are iron, ruthenium, iridium, osmium, lead, cadmium or zinc. Further, 6-coordinated octahedral complex salts of these metal ions which have ligands are more preferably used. The ligand to be used may be an inorganic compound. Among the inorganic compounds, cyanide ion, halide ion, thiocyanato, hydroxide ion, peroxide ion, azide ion, nitrite ion, water, ammonia, nitrosyl ion, or thionitrosyl ion are preferably used. Such ligand is preferably coordinated to any one of metal ions selected from a group consisting of the above-mentioned iron, ruthenium, iridium, osmium, lead, cadmium and zinc. Two or more kinds of these ligands are also preferably used in one complex molecule.

Among them, the silver halide emulsion for use in the present invention particularly preferably contains an iridium ion having at least one organic ligand for the purpose of improving reciprocity failure at a high illuminance.

It is common in the case of other transition metal, when an organic compound is used as a ligand, preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Among these compounds, 5-methylthiazole among thiazole ligands is particularly preferably used as the ligand preferable for the iridium ion.

Preferable combinations of a metal ion and a ligand are those of the iron and/or ruthenium ion and the cyanide ion. Preferred of these compounds are those in which the number of cyanide ions accounts for the majority of the coordination number (site) intrinsic to the iron or ruthenium that is the central metal. The remaining sites are preferably occupied by thiocyanato, ammonio, aquo, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver.

In case of the iridium complex, preferable ligands are fluoride, chloride, bromide and iodide ions, not only said organic ligands. Among these ligands, chloride and bromide ions are more preferably used. Specifically, preferable iridium complexes that can be used in the present invention include the following compounds, in addition to those that have said organic ligands:

$[IrCl_6]^{3-}$, $[IrCl_6]^{2}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$.

These iridium complexes are preferably added during grain formation in an amount of $1\times10^{-10}$ mol to $1\times10^{-3}$ mol, most preferably $1\times10^{-8}$ mol to $1\times10^{-5}$ mol, per mol of silver. In case of the ruthenium complex and the osmium complex, nitrosyl ion, thionitrosyl ion, or water molecule is also preferably used in combination with chloride ion, as ligands. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver.

In the present invention, the above-mentioned complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, these methods are preferably combined to incorporate the complex into the inside of the silver halide grains.

In case where these metal complex is doped to the inside of the silver halide grains, the metal complex is preferably uniformly distributed in the inside of the grains. On the other hand, as disclosed in JP-A-4-208936, JP-A-2-125245 and JP-A-3-188437, the metal complex is also preferably distributed only in the grain surface layer. Alternatively, the metal complex is also preferably distributed only in the inside of the grain, while the grain surface is covered with a layer free from the metal complex. Further, as disclosed in U.S. Pat. Nos. 5,252,451 and 5,256,530, it is also preferred that the silver halide grains are subjected to physical ripening in the presence of fine grains having the metal complex incorporated therein, to modify the grain surface phase. Further, these methods may be used in combination. Two or more kinds of metal complexes may be incorporated in the inside of an individual silver halide grain. There is no particular restriction on the halogen composition at the location where the above-mentioned metal complexes are incorporated, and therefore they are preferably incorporated in any layer selected from a silver chloride layer, a silver chlorobromide layer, a silver bromide layer, a silver iodochloride layer and a silver iodobromide layer.

In the present invention, the metal complex represented by formula (A) and the above-described iridium complex are preferable, and these complexes are more preferably used in combination.

Various compounds or precursors thereof can be included in the silver halide emulsion for use in the present invention to prevent fogging from occurring or to stabilize photographic performance, during manufacture, storage or photographic processing of the photosensitive material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0447647 can also be preferably used.

Further, in order to enhance storage stability of the silver halide emulsion for use in the present invention, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description at paragraph Nos. 0036 to 0071 of JP-A-11-327094 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); water-soluble reducing agents represented by formula (I), (II), or (III) of JP-A-11-102045.

Spectral sensitization can be carried out for the purpose of imparting spectral sensitivity in a desired light wavelength region to the light-sensitive emulsion in each layer of the photosensitive material of the present invention.

Examples of spectral sensitizing dyes, which can be used in the photosensitive material of the present invention, for spectral sensitization of blue, green and red light regions, include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like.

The amount of these spectral sensitizing dyes to be added can be varied in a wide range depending on the occasion, and it is preferably in the range of $0.5\times10^{-7}$ mole to $1.0\times10^{-2}$ mole, more preferably in the range of $1.0\times10^{-6}$ mole to $5.0\times10^{-3}$ mole, per mole of silver halide.

The silver halide emulsions for use in the present invention are generally chemically sensitized. Chemical sensitization can be performed by utilizing a sulfur sensitization, represented by the addition of an unstable sulfur compound, noble metal sensitization represented by gold sensitization, and reduction sensitization, each singly or in combination thereof. Compounds that are preferably used for chemical sensitization include those described in JP-A-62-215272, from page 18, right lower column to page 22, right upper column. Of these, gold-sensitized silver halide emulsion are particularly preferred, since a change in photographic properties which occurs when scanning exposure with laser beams or the like is conducted, can be further reduced by gold sensitization.

In order to conduct gold sensitization to the silver halide emulsion to be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand, the bis gold (I) mesoionic heterocycles described in JP-A-4-267249, for example, gold (I) tetrafluoroborate bis(1,4,5-trimethyl-1,2,4-triazolium-3-thiolate), the organic mercapto gold (I) complexes described in JP-A-11-218870, for example, potassium bis(1-[3-(2-sulfonatobenzamido)phenyl]-5-mercaptotetrazole potassium salt) aurate (I) pentahydrate, and the gold (I) compound with a nitrogen compound anion coordinated therewith, as described in JP-A-4-268550, for example, gold (I) bis(1-methylhydantoinate) sodium salt tetrahydrate may be used. Also, the gold (I) thiolate compound described in U.S. Pat. No. 3,503,749, the gold compounds described in JP-A-8-69074, JP-A-8-69075 and JP-A-9-269554, and the compounds described in U.S. Pat. No. 5,620,841, U.S. Pat. No. 5,912,112, U.S. Pat. No. 5,620,841, U.S. Pat. No. 5,939,245, and U.S. Pat. No. 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{-6}$ mole to $5\times10^{-4}$ mole, per mole of silver halide.

The silver halide emulsion for use in the present invention can be subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1996). Colloidal gold sulfide having various grain sizes are applicable, and even those having a grain diameter of 50 nm or less can also be used. The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide, in terms of gold atom.

In the present invention, gold sensitization may be used in combination with other sensitizing method, for example, sulfur sensitization, selenium sensitization, tellurium sensitization, reduction sensitization, or noble. metal sensitization using a noble metal compound other than gold compound.

The silver halide color photographic light-sensitive material of the present invention preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer, and the cyan color-forming silver halide emulsion layer.

However, another layer arrangement which is different from the above, may be adopted.

In the present invention, a yellow coupler-containing silver halide emulsion layer may be provided at any position on a support. In the case where silver halide tabular grains are contained in the yellow coupler-containing layer, it is preferable that the yellow coupler-containing layer be positioned more apart from a support than at least one of a magenta coupler-containing silver halide emulsion layer and a cyan coupler-containing silver halide emulsion layer. Further, it is preferable that the yellow coupler-containing silver halide emulsion layer be positioned most apart from a support than other silver halide emulsion layers, from the viewpoint of color-development acceleration, desilvering acceleration, and reducing residual color due to a sensitizing dye. Further, it is preferable that the cyan coupler-containing silver halide emulsion layer be disposed in the middle of other silver halide emulsion layers, from the viewpoint of reducing blix fading. On the other hand, it is preferable that the cyan coupler-containing silver halide emulsion layer be the lowest layer, from the viewpoint of reducing light fading. Further, each of the yellow-color-forming layer, the magenta-color-forming layer and the cyan-color-forming layer may be composed of two or three layers. It is also preferable that a color-forming layer be formed by providing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) for use in the present invention, photographic constitutional layers (arrangement of the layers or the like), and processing methods for processing the photographic materials and additives for processing, are disclosed in JP-A-62-215272, JP-A-2-33144 and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-

158431, JP-A-2-90145, JP-A-3-194539, JP-A-2-93641 and European Patent Publication No. 0520457 A2.

In particular, as the later-described support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye image stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following table are particularly preferably used in the present invention.

TABLE 1

| Element | JP-A-7-104448 | JP-A-7-77775 | JP-A-7-301895 |
|---|---|---|---|
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | | |

As cyan, magenta and yellow couplers which can be used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) described in JP-A-10-221825.

As the cyan dye-forming coupler (hereinafter also simply referred to as "cyan coupler") which can be used in the present invention, pyrrolotriazole-series couplers are preferably used, and more specifically, couplers represented by formula (I) or (II) in JP-A-5-313324, and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. Preferable examples of cyan couplers other than the foregoing cyan couplers, include pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, as the cyan coupler, use can also be made of a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in EP 0333185 A2; a cyclic active methylene-series cyan coupler (particularly couplers 3, 8, and 34 enumerated as specific examples are particularly preferable) described in JP-A-64-32260; a pyrrolopyrozole-type cyan coupler described in European Patent No. 0456226 A1; and a pyrroloimidazole-type cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference.

The magenta dye-forming couplers (which may be referred to simply as a "magenta coupler" hereinafter) that can be used in the present invention can be 5-pyrazolone-series magenta couplers and pyrazoloazole-series magenta couplers such as those described in the above-mentioned patent publications in the above table. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 0226849 A and 0294785 A, in view of the hue and stability of an image to be formed therefrom and color-forming property of the couplers. Particularly as the magenta coupler, pyrazoloazole couplers represented by formula (M-I) described in JP-A-8-122984 are preferred. The descriptions of paragraph Nos. 0009 to 0026 of the patent publication JP-A-8-122984 can be entirely applied to the present invention, and therefore are incorporated herein by reference. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as a "yellow coupler" herein), preferably use can be made, in the present invention, of acylacetamide-type yellow couplers in which the acyl group has a 3-membered to 5-membered cyclic structure, such as those described in European Patent No. 0447969 A1; malondianilide-type yellow couplers having a cyclic structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1 and 953875 A1; acylacetamide-type yellow couplers having a dioxane structure, such as those described in U.S. Pat. No. 5,118,599, in addition to the compounds described in the above-mentioned table. Above all, acylacetamide-type yellow couplers in which the acyl group is a 1-alkylcyclopropane-1-carbonyl group, and malondianilide-type yellow couplers in which one anilide constitutes an indoline ring are especially preferably used. These couplers may be used singly or in combination.

It is preferred that couplers for use in the present invention, are pregnated into a loadable latex polymer. (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic solvent-soluble polymer which can be preferably used, include the homopolymers and co-polymers as disclosed in U.S. Pat. No. 4,857,449, from column 7 to column 15, and WO 88/00723, from page 12 to page 30. The use of methacrylate-series or acrylamide-series polymers, especially acrylamide-series polymers are more preferable, in view of color-image stabilization and the like.

In the present invention, known color mixing-inhibitors may be used. Among these compounds, those described in the following patent publications are preferred.

For example, high-molecular-weight redact compounds described in JP-A-5-333501; phenidone- or, hydrazine-series compounds as described in, for example, WO 98/33760 and U.S. Pat. No. 4,923,787; and white couplers as described in, for example, JP-A-5-249637, JP-A-10-282615 and German Patent No. 19629142 A1, may be used. Particularly, in order to accelerate developing speed by increasing the pH of a developing solution, redox compounds described in, for example, German Patent No. 19,618,786 A1, European Patent Nos. 0,839,623 A1and 0,842,975 A1, German Patent No. 19,806,846 A1 and French Patent No. 2,760,460 A1, are also preferably used.

In the present invention, as an ultraviolet ray absorbent, it is preferred to use compounds having a high molar extinction coefficient and a triazine skeleton. For example, those described in the following patent publications can be used. These compounds are preferably added to the light-sensitive layer or/and the light-nonsensitive layer. For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As the binder or protective colloid which can be used in the light-sensitive material according to the present invention, gelatin is used advantageously, but another hydrophilic colloid can be used singly or in combination with gelatin. It is preferable for the gelatin that the content of heavy metals, such as Fe, Cu, Zn and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of the film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, mention can be made of anionic, cationic, betaine and nonionic surfactants. Examples thereof include those described in JP-A-5-333492. As the surface-active agent for use in the present invention, a fluorine-containing surface-active agent is particularly preferred. The fluorine-containing surface-active agent may be used singly, or in combination with known other surface-active agent. The fluorine-containing surfactant is preferably used in combination with known other surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention can form an image, via an exposure step in which the photosensitive material is irradiated with light according to image information, and a development step in which the photosensitive material irradiated with light is developed.

The light-sensitive material of the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green and blue, and fluorophoroes which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface (or plane) successive exposure, may be used. Generally, among these methods, the surface successive exposure is preferred from the viewpoint of high image quality enhancement, because a cathode ray tube having a high resolving power can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source (a second harmonic generation light source) obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in usual three wavelength regions of blue, green and red. The exposure time in such a scanning exposure is defined as the time period necessary to expose the size of the picture element (pixel) with the density of the picture element being 400 dpi, and a preferred exposure time is $10^{-4}$ sec or less, more preferably $10^{-6}$ sec or less.

As the transmission (transparent) support for use in the present invention, any support that is substantially transparent may be used. For example, transparent substrates, such as a cellulose nitrate film, a polyethylene terephthalate film, a polycarbonate film, a polystyrene film, and a polypropylene film, may be used. Of these films, a polyethylene terephthalate film is preferable.

As the semi-transmission (semi-transparent) support for use in the present invention, preferably in the third embodiment of the present invention, use can be made of a support having a white pigment coated on, or kneaded in the above-mentioned transmission support. The white pigment may be inorganic or organic, and may be a mixture of the inorganic pigment and the organic pigment. Examples of the white pigment include sulfuric acid salts of alkali earth metal such as barium sulfate; carboxylic acid salts of alkali earth metal such as calcium carbonate; silicas such as synthetic silicic acid, and fine powder of silicic acid; calcium silicate, alumina, alumina hydrate, titanium oxide, zinc oxide, talc, and clay. Among these, preferred are barium sulfate, calcium carbonate and titanium oxide, more preferably barium sulfate and titanium oxide.

Improved supports are described, for example, in U.S. Pat. Nos. 6,248,483 B1, 6,268,117 B1, 6,277,547 B1, and European patent publication No. 1130464 A2. These supports can also be preferably used in the present invention.

In case where a white pigment is coated on the surface of a support, a coating amount of the white pigment is generally in the range of 1.5 to 8.0 g/m$^2$ preferably in the range of 3.0 to 6.0 g/m$^2$. In case where a white pigment is incorporated in a support, the content of the white pigment is preferably in the range of 5 to 50% by mass to the support.

There is no particular restriction on the thickness of the transmission support or the semi-transmission support, but it is preferably in the range of 150 to 250 μm, more preferably in the range of 160 to 200 μm.

The transmission support for use in the present invention refers to a support having light transmittance of 90% or more. The semi-transmission support for use in the present invention refers to a support having light transmittance of 20% or more and less than 90%. The transmittance is described in detail in U.S. Pat. No. 6,248,483B1.

The support for use in the present invention may be coated with an antihalation layer on the side of light-sensitive emulsion layer and/or on the backside thereof. As the light-absorbing substance that is incorporated in the antihalation layer, there are various kinds of inorganic substances and dyes. As the inorganic substance, for example, colloidal metal may be used. Colloid silver and colloid manganese are preferable. Colloid silver is more preferable. As the dye, various conditions such as (1), (2) and (3) described below should be satisfied:

(1) Dyes with good spectral absorption characteristics in accordance with its individual purpose to use.

(2) Dyes capable of being completely decolored in a photographic processing solution.

(3) Dyes having no adverse affects such as fogging and desensitization upon a photographic emulsion.

Examples of these dyes include oxonole dyes, hemioxonole dyes, styryl dyes, merocyanine dyes, cyanine dyes and azo dyes. Of these dyes, oxonole dyes, hemioxonole dyes and merocyanine dyes are particularly useful.

In the silver halide color photographic light-sensitive material of the present invention, it is preferable for improvement of image sharpness, etc. that a hydrophilic colloid layer contains a dye capable of being decolored by processing (especially an oxonole-series dye), as described in European patent EP 0337490 A2, pp. 27 to 76.

The silver halide color photographic light-sensitive material of the present invention preferably contains, in its hydrophilic colloid layer, a dye (particularly an oxonole dye or cyanine dye) that can be discolored by processing, as described in European Patent No. 0337490 A2, pages 27 to 76, in order to prevent irradiation or halation or to enhance safelight safety (immunity) and the like. Further, dyes described in European Patent No. 0819977 are also preferably used in the present invention. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, preferably in the second embodiment of the present invention, it is possible to use a colored layer which can be discolored during processing, in place of the water-soluble dye, or in combination with the water-soluble dye. The colored layer that can be discolored with processing, to be used, may contact with a light-sensitive emulsion layer directly, or indirectly through an interlayer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, only one layer selected from them may be provided. In addition, it is possible to provide a colored layer subjected to coloring so as to match a plurality of primary-color regions. About the optical density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is within the range of 0.1 to 3.0, more preferably 0.1 to 2.5, and particularly preferably 0.1 to 2.0. Particularly in the present invention, it is preferable to satisfy the following conditions required for each of blue exposure, green exposure and red exposure.

That is, the transmission density to a blue light of 473 nm is preferably in the range of 0.35 to 1.0, especially preferably in the range of 0.50 to 0.80.

The transmission density to a green light of 532 nm is preferably in the range of 0.40 to 1.20, especially preferably in the range of 0.60 to 1.0.

The transmission density to a red light of 685 nm is preferably in the range of 0.60 to 1.40, especially preferably in the range of 0.80 to 1.20.

As a result of intensive studies by the present inventors, these values (conditions) were found by consideration of a balance between enhancement of sharpness obtained from the antihalation effect owing to a dye and a decoloring performance of the dye. Further, these values (conditions) are based on the preferable optical densities found by consideration of individual emission wavelength of blue- and green-solid lasers and a red semiconductor laser that are widely used in the art.

The colored layer described above may be formed by a known method. For example, can be mentioned a method in which a dye in a state of a dispersion of solid fine particles is incorporated in a hydrophilic colloid layer, with respect to dyes as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used as described in JP-A-1-239544. As to a method of dispersing fine-powder of a dye in solid state, for example, JP-A-2-308244, pages 4 to 13 describes a method in which fine particles of dye which is at least substantially water-insoluble at the pH of 6 or less, but at least substantially water-soluble at the pH of 8 or more, are incorporated. The method of mordanting an anionic dye in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the method of incorporating fine particles of dye, and the method of using colloidal silver.

The silver halide color photosensitive material of the present invention is preferably used in combination with the exposure and development systems described in the following known literatures. Example of the development system include the automatic print and development system described in JP-A-10-333253, the photosensitive material conveying apparatus described in JP-A-2000-10206, a recording system including the image reading apparatus, as described in JP-A-11-215312, exposure systems with the color image recording method, as described in JP-A-11-88619 and JP-A-10-202950, a digital photo print system including the remote diagnosis method, as described in JP-A-10-210206, and a photo print system including the image recording apparatus, as described in JP-A-2000-310822.

The preferred scanning exposure methods which can be applied to the present invention are described in detail in the publications listed in the table shown above.

It is preferred to use a band stop filter, as described in U.S. Pat. No. 4,880,726, when the photographic material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patent publications. listed in the above table can be preferably used.

As the color developing solution, a known or commercially available diaminostilbene-type fluorescent whitening agent may be used. As known bistriazinyldiaminostilbene-disulfonic acid compound, for examples, the compounds described in JP-A-6-329936, JP-A-7-140625 or JP-A-10-104809 are preferable. The commercially available compounds are described in, for example, "Senshoku Note (Notebook on Dyeing)", 19th edition (Shikisensha Co., Ltd.), pp. 165 to 168. Among the products described in this publication, Blankophor UWliq, Blankophor REU, or Hakkol BRK (each trade names) are preferred. Further, compounds (FL-1) to (FL-3) shown below can also be preferably used. Further, as the residual color-reducing agent, the following SR-1 is useful and preferably used.

FL-1

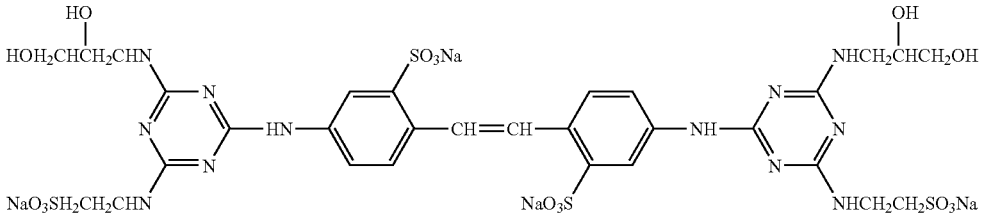

FL-2

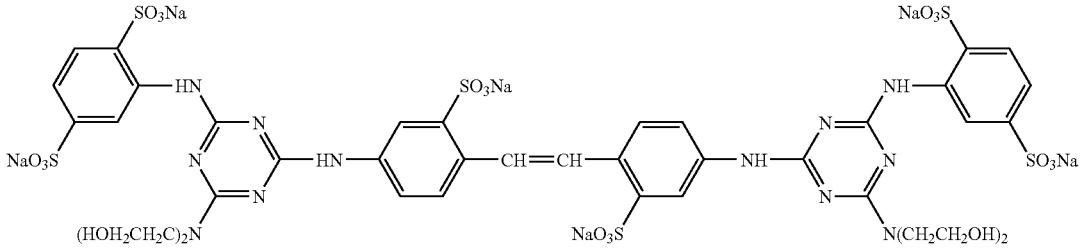

FL-3

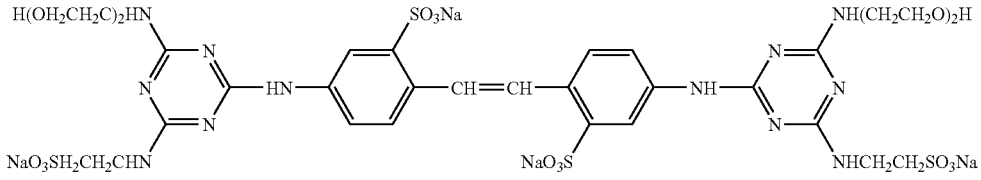

SR-1

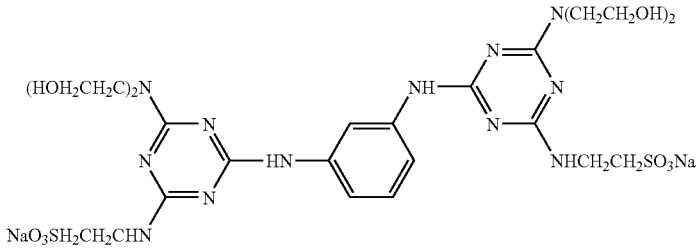

As the chemicals of processing agents, for example, CP45X, CP47L and CP48S (each trade name) manufactured by Fuji Photo Film Co., Ltd., and RA-100 and RA-4 (each trade name) manufactured by Eastman Kodak may be used.

The present invention can also be preferably applied to a light-sensitive material having rapid processing suitability. In the case of conducting rapid processing, the color-developing time is preferably 60 sec or less, more preferably from 50 sec to 6 sec, and further preferably from 30 sec to 6 sec. Likewise, the blix time is preferably 60 sec or less, more preferably from 50 sec to 6 sec, and further preferably from 30 sec to 6 sec. Further, the washing or stabilizing time is preferably 50 sec or less, and more preferably from 30 sec to 6 sec.

Herein, the term "color-developing time" as used herein means a period of time required from the beginning of dipping a light-sensitive material into a color developing solution until the light-sensitive material is dipped into a blix solution in the subsequent processing step. For example, when a processing is carried out using an autoprocessor or the like, the color developing time is the sum total of a time in which a light-sensitive material has been dipped in a color developing solution (so-called "time in the solution") and a time in which the light-sensitive material has left the color developing solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

In the present invention, the incorporation of halide ions, such as Br and I, in a bleach-fixing solution is particularly preferable, from the viewpoints that image unevenness that might occur at the shift of processing solution from a developing solution to a bleach-fixing solution can be prevented, a fixing ability can be improved, and a contamination due to silver sulfide, etc. on the white background of the non-color developed area can be also prevented. In the bleach-fixing solution for use in the present invention, it is preferable, from prevention of coloring contamination due to a residual silver thereby to exhibit the advantageous effects of the present invention, that a concentration of a bromide ion is preferably in the range of 0 to 1.0 mol/L, more preferably in the range of 0.01 to 0.3 mol/L. Further, it is preferable from the same reason as mentioned above that the bleach-fixing solution contains an iodide ion. A concentration of the iodide ion is preferably in the range of 0 to 0.1 mol/L, more preferably in the range of 0.001 to 0.01 mol/L.

Examples of a development method after exposure, applicable to the light-sensitive material of the present invention, include a conventional wet method, such as a development method using a developing solution containing an alkali agent and a developing agent, and a development method wherein a developing agent is incorporated in the light-sensitive material and an activator solution, e.g., a developing agent-free alkaline solution is employed for the development, as well as a heat development method using no processing solution. In particular, the activator method is preferred over the other methods, because the processing solutions contain no developing agent, thereby it enables easy management and handling of the processing solutions and reduction in waste solution disposal or processing-related load to make for environmental preservation.

The preferable developing agents or their precursors incorporated in the light-sensitive materials in the case of adopting the activator method, include the hydrazine-type compounds described in, for example, JP-A-8-234388, JP-A-9-152686, JP-A-9-152693, JP-A-9-211814 and JP-A-9-160193.

Further, the processing method in which the photographic material reduced in the amount of silver to be applied undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536-541 (September 1994), and JP-A-8-234388 can be used in the present invention.

The present invention can be applied to color photosensitive materials for digital direct color proof (hereinafter, also referred to as "proof photosensitive materials") in which a silver halide color photographic light-sensitive material is utilized, digital direct color proof systems, and image forming methods thereof.

The proof photosensitive material is generally a silver halide color photosensitive material that has, on a support, silver halide photosensitive layers forming at least a yellow dye, a magenta dye, and a cyan dye; has a hue resembling that of printing ink; and is exposed with using three or more light source units having wavelengths different from each other, based on dotted image information, to form an area modulated image. A fourth photosensitive layer may be provided, for the purpose of making black (chromaticity and Dmax) and single color solid print (chromaticity and Dmax) consist each other (improvement of color reproduction), and for the purpose of the discrimination of a black printer. In this case, three or four light sources with different wavelengths from each other are used as exposure light sources. The exposure light sources in many cases have a plurality (preferably 8 or more) of light source units for each color. LED, LD, or other devices can be used as the exposure light source. For the exposure light source, light sources of any desired wavelengths in visible light region, such as blue, green and red, and infrared region can be used. Also, these may be used in any desired combinations.

As the system, preferred are direct digital color proof system and image forming method, having the following features: A photosensitive material is automatically drawn out of a magazine (cartridge), cut into a form of a sheet, and the sheet is wound around an exposure outer drum and rotated. Then the sheets is subjected to scanning exposure based on dotted image information with using an exposure array light source that has eight or more light source units each unit having three or more types of light sources with different wavelengths, respectively, in combination, to record dot images by area gradation with dots of a resolution of 2,000 dpi or more. Thereafter, the exposed color photosensitive material is automatically developed with an automatic processor, to output a dot color proof image of A3 size or larger (also a system that outputs a B1 size image is also possible as needed). Adaptation of the present invention to color proof is not limited to the above-mentioned proof photosensitive material, system or image-formation method.

The present invention can also be adapted to those direct digital color proof systems, image-forming methods, and proof photosensitive materials, having one or more characteristics described below. That is, the resolution is 2,400 dpi or more and exposure beam diameter of one dot is 0.5 μm or more to 50 μm in terms of half width of light intensity; exposure time required to expose one dot by at least one exposure light source is $10^{-8}$ second or more and $10^{-2}$ second or less; the number of rotation of the outer drum is 100 rpm or more and 4,000 rpm or less; the wavelength of at least one exposure light source is 700 nm or more; the exposure amount of at least one exposure light source is of two stages or higher stages; the exposure energy of the exposure light source having the longest wavelength is equal to or more than 1.1 times that of the other light sources; after exposure, the photosensitive material is peeled off from the outer drum and conveyed so that the exposed side is facing downward; the photosensitive material is conveyed so that the silver halide emulsion side is turned in a downward direction in the color developer, bleach-fixer and washing bath in an automatic processor; the time required from completion of the exposure of a photosensitive material to entering of the tip thereof in the color developer is 20 seconds or more and 3 minutes or less; a difference between the time from completion of the exposure to entering of the head of an exposed photosensitive material in the direction of transport in the color developer and the time from completion of the exposure to entering of the end of the photosensitive material in the direction of transport in the color developer is 1 minute or more and 10 minutes or less, the processing times of color developer and bleach fixer are 10 seconds or more and 100 seconds or less, and a difference between these processing times is within 30 seconds; the volumes of processing tanks for color developer and bleach-fixer are each 8 liters or more and 20 liters or less; two or more and five or less washing tanks are provided; color developer and bleach-fixer are provided by an integrated kit, and the replenisher volume of the color developer is 50 ml or more and 300 ml or less per $m^2$ of photosensitive material to be processed, the replenisher volume of the bleach-fixer is 30 ml or more and 250 ml or less per $m^2$ of photosensitive material to be processed, and the replenisher volume of the wash water is 50 ml or more and 1,000 ml or less with respect to the whole wash water, with replenishment being performed by automatically sensing the area of the photosensitive material to be processed; the automatic processor has at least one automatic washing mechanism for washing air turn transport rollers; at least one guide plate that contacts the emulsion side of a photosensitive material is made of a poly(tetrafluoroethylene) (Teflon, trade name) material; the system has a calibration mechanism to correct changes in sensitivity that occur due to the lot-to-lot difference or change with lapse of time of the photosensitive material, temperature and humidity at the time of exposure, and change in the states of processing solutions, by writing a specific image in a proof print or in a separate output print, and measuring the density or chromaticity of the obtained image or visually comparing it with an objective image, so that calibration can be performed by a continuous gradation image having a density lower than Dmax of the photosensitive material; calibration of an even tone dot image of 20% or more and 80% or less can be performed by visual determination, density measurement, or color difference measurement; photosensitive material of the same size is fed from two or more magazines and when one of the magazines becomes empty, automatically the photosensitive material is fed from another magazine; photosensitive materials of two or more sizes are simultaneously fed from different magazines, respectively, and switch of size is automatically performed; the winding length of one photosensitive material is 30 m or more and 100 m or less; the time from completion of drawing the photosensitive material out of the magazine to start of exposure is 10 seconds or more and 100 seconds or less; black printer image is formed from yellow, magenta and cyan; a difference in dot gain between colors forming dots of a black printer is within 5%; the total thickness of the support used for the photosensitive material is 50 μm or more and 150 μm or less; the front side laminate of the support used for the photosensitive material has a thickness of 10 μm or more to 50 μm; the back side laminate of the support used for the photosensitive material has a thickness of 10 μm or more and 50 μm or less; a backing layer of a thickness of 0.1 μm or more and 30 μm or less is provided on the side of the photosensitive material opposite to the side where photosensitive layers are coated; the side of the photosensitive material having the photosensitive silver halide has a total film thickness of 3 μm or more and 30 μm or less; a difference between the total film thickness of the side of the photosensitive material having the photosensitive silver halide and the total film thickness of the back side thereof is within 10 μm; the photosensitive silver halide used in the photosensitive material has a silver chloride content of 90% or more; the photosensitive material processed into a form of a roll so that the emulsion side faces outside is used; the peak wavelength of maximal spectral sensitivity of at least one layer is 700 nm or more; the photosensitive material cut into a form of sheet by a squeeze roller is automatically wound around a drum; and the like.

Further, the shape of spot may be any one of circle, ellipse, and rectangle. The distribution of quantity of light of one spot may be a Gauss distribution or a trapezoid of relatively constant intensity. Although one light source is enough, a multi-channel array having a plurality of light sources is preferred.

The exposing method and image-forming method, using a laser, LED or array thereof, as a light source, are described in detail in JP-A-10-142752, JP-A-11-242315, JP-A-2000-147723, JP-A-2000-246958, JP-A-2000-354174, JP-A-2000-206654, EP 1048976 A, and the like. These methods may be preferably used in the present invention.

More specifically, the above-mentioned methods are as follows.

Preferred modes of the exposure light source are described in the paragraph 0022 of JP-A-2000-147723, and the paragraphs 0053, 0059 to 0061, and 0064 to 0067 of JP-A-2000-206654, and these can be preferably applied to the present invention.

Preferred modes of the beam form of exposure light source and preferred modes of exposure light source array are described in the paragraphs 0022 to 0023 of JP-A-2000-147723, and the paragraphs 0025 to 0030 of JP-A-2000-206654, and these can be preferably applied to the present invention.

To improve the productivity at the time of exposure, a method in which a photosensitive material is wound around a drum and is subjected to scanning exposure is advantageous. A preferred mode of light source for this method is the LED array, as described in JP-A-2000-246958, and the image recording apparatus described in JP-A-2000-246958 having the LED array can be preferably applied to the present invention. Furthermore, the method of winding a photosensitive material around a drum is described in the paragraphs 0057 to 0058 and 0062 to 0063 of JP-A-2000-206654, and in the same manner this method can be preferably applied to the present invention.

Furthermore, performing calibration by the method described in EP 1048976 A, to form an image stably, can also be preferably applied to the present invention.

For the method of converting digital image data to exposure image data and the method of exposure, which is preferably used in preparing a color proof, in the present invention, those described in JP-A-2000-354174 and JP-A-2000-147723 may be used as they are. More specifically, the color proof preparing apparatus shown in FIG. 1 of JP-A-2000-354174 may be used, and FIGS. 1 to 4 include said FIG. 1, and descriptions in paragraphs 0011 to 0021, the first sentence in paragraph 0022, and paragraphs 0034 to 0057 in JP-A-2000-354174 are preferably incorporated herein by reference.

According to the present invention, it is possible to provide a silver halide color photographic light-sensitive material that is preferable to prints for an advertising display. More specifically, according to the present invention, a silver halide color photographic light-sensitive material that is preferable to prints for an advertising display, by which high image density can be obtained upon digital exposure by means of a laser printer, etc., and the change of chromaticness at the jointing part is lessened in the preparation of a large-sized advertisement.

Further, according to the silver halide color photographic light-sensitive material and the image-forming method of the present invention, it is possible to obtain a vivid image owing to a high image density in particular, and the image being excellent in quality in a portion for jointing images, which is important to a print for the advertising display.

Further, according to the silver halide photosensitive material and the image-forming method using the same of the present invention, which is particularly preferred for a color display, high density and high saturation can be obtained stably regardless variation of compositions of processing solutions and/or processing conditions, as well as an image having reduced loss of letter- or image-edge definition can be also obtained.

Further, according to the present invention, it is possible to provide a silver halide color display material for scanning exposure that provides images with high quality, high contrast and rich gradation reproduction.

Further, according to the present invention, it is possible to provide a silver halide color display material that provides images with high quality resulting from a lessened loss of letter-edge definition, even though density is set at a high density by means of a scan-exposing apparatus, of the system in which calibration is carried out by setting a target density.

Further, according to the present invention, it is possible to provide an image-forming method for attaining the above-mentioned quality.

Further, according to the light-sensitive material of the present invention, it is possible to obtain various images (images incorporating letters or characters in particular) with high image quality, upon scanning exposure, particularly upon exposure using a scan-exposing apparatus having functions of conducting calibration in which the maximum developed color density is preset.

The present invention will be described in more detail based on the following examples, but the present invention is not limited thereto.

EXAMPLES

Example 1

Preparation of Blue-Sensitive Layer Emulsions

To 1.06 L of deionized distilled water containing 5.7 mass % of deionized gelatin, 46.3 ml of 10% NaCl solution, 46.4 ml of $H_2SO_4$ (1N), and then 0.012 g of Compound X were added in the above order. Thereafter, the temperature of the resulting solution was adjusted to 60° C. and immediately after this, 0.1 mol of silver nitrate and 0.1 mol of NaCl were added to the reaction vessel over 10 minutes, while performing rapid stirring. Subsequently, 1.5 mol of silver nitrate and a NaCl solution were added over 60 minutes by a flow rate acceleration method so that the final addition rate became 4 times the initial addition rate. Then, a 0.2-mol % silver nitrate solution and a NaCl solution were added over 6 minutes in a constant addition rate. On this occasion, $K_3IrCl_5(H_2O)$ was added to the NaCl solution in an amount sufficient to be $5\times10^{-5}$ mol to the total amount of silver, to dope aquated iridium in the grains.

Furthermore, solutions of 0.2 mol of silver nitrate, 0.18 mol of NaCl and 0.02-mol of KBr were added thereto, over 6 minutes. On this occasion, $K_4Ru(CN)_6$ and $K_4Fe(CN)_6$ in the amount corresponding to $0.5\times10^{-5}$ mol to the total amount of silver, respectively, were dissolved in the aqueous halogen solution and added to the silver halide grains.

Furthermore, during the last stage of the grain growth, an aqueous KI solution corresponding to 0.001 mol to the total amount of silver, was added to the reaction vessel over 1 minute. The addition was started at the point of time when 93% of all grain formation was completed.

Thereafter, compound Y, which is a settling agent, was added at 40° C., and the pH of the resulting solution was adjusted to about 3.5, and desalting and washing were performed.

Compound X

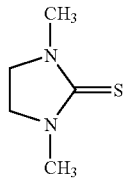

Compound Y

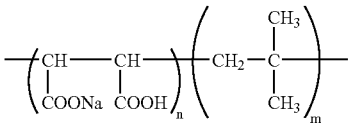

n and m each are an integer.

To the resultant emulsion thus desalted and washed, deionized gelatin, an aqueous NaCl solution and an aqueous NaOH solution were added and temperature was elevated to 50° C. Then, pAg and pH were adjusted to 7.6 and 5.6, respectively.

Thus, the emulsion containing silver halide cubic grains having a halogen composition of 98.9 mol % of silver chloride, 1 mol % of silver bromide and 0.1 mol % of silver iodide, an average grain size (in terms of a volume equivalent-cubic's side length) of 0.60 μm, and a variation coefficient of 8% in terms of the side length, was obtained.

While keeping the above-mentioned emulsion at 60° C., as a spectral sensitizer, Spectral sensitizing dye A (a mixture of Spectral sensitizing dyes-1, -2, -3 and -4, with a molar ratio of 5:3:1:1) was added in an amount of $5.2\times10^{-4}$ mol/mol Ag. Further, a thiosulfonic acid compound-1 was added thereto in an amount of $1.2\times10^{-5}$ mol/mol Ag, and an emulsion, which was composed of fine grains having a halogen composition of 90 mol % of silver bromide and 10 mol % of silver chloride and an average grain diameter of 0.05 μm and further having a hexachloro iridium complex doped therein, was added, followed by ripening for 10 minutes. Further, an emulsion composed of fine grains having a halogen composition of 40 mol % of silver bromide and 60 mol % of silver chloride and an average grain diameter of 0.05 μm, was added thereto, followed by ripening for 10 minutes. By dissolution of these fine grains, a silver bromide content of the host cubic grains increased up to 1.3 mol %. The amount of the above-described hexachloro iridium complex doped was $1\times10^{-7}$ mol/mol Ag.

Subsequently, sodium thiosulfate of $1.2\times10^{-5}$ mol/mol Ag and gold sensitizer-1 of $2.4\times10^{-5}$ mol/mol Ag were added, as chemical sensitizers, and immediately after that, the temperature was elevated to 60° C., and then the resultant emulsion was ripened for 40 minutes. Thereafter, the temperature was lowered to 50° C. Immediately after that, mercapto compounds-1 and -2 were added so as to become $7.2\times10^{-4}$ mol/mol Ag, respectively. Thereafter, the resultant emulsion was ripened for 10 minutes, and then an aqueous solution of KBr was added so as to become 0.008 mol per mol of silver. After ripening for 10 minutes, the temperature was lowered and the resultant emulsion was reserved. Thus, Emulsion A1-1 was prepared.

Emulsion A1-2 (average grain size 0.5 μm) and Emulsion A1-3 (average grain size 0.75 μm) were prepared in the same manner as Emulsion A1-1, except that the temperature for forming grains was changed and the amounts of additives were adjusted. In this time, using Emulsion A1-1 as a standard, adjustment of the amounts of additives was carried out in such a manner that spectral sensitizers and chemical sensitizers were added with the amounts proportional to the reciprocal of the grain size.

Further, a blue-sensitive Emulsion B1-2 was prepared in the same manner as Emulsion A1-2, except for adding a half amount of the fine grain emulsion having a hexachloro iridium complex doped therein.

Spectral Sensitizing Dye—1

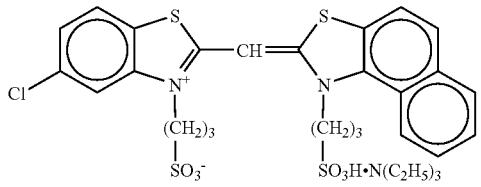

Spectral Sensitizing Dye—2

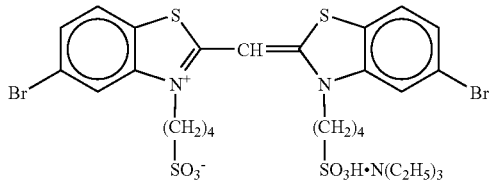

Spectral Sensitizing Dye—3

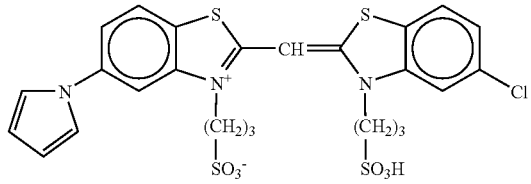

Spectral Sensitizing Dye—4

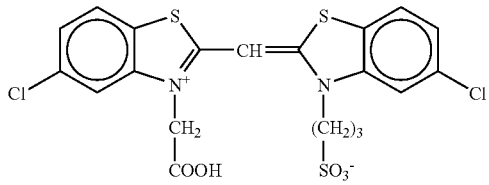

Thiosulfonic Acid Compound—1

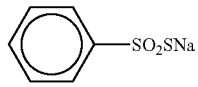

Gold Sensitizer—1

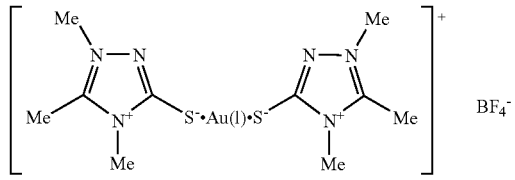

Mercapto Compound—1 Mercapto Compound—2

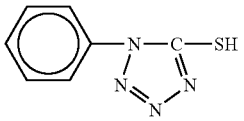

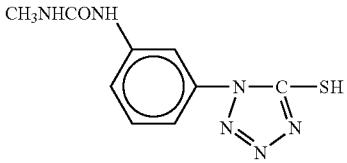

"Me" means a methyl group.

(Preparation of Green-Sensitive Layer Emulsions)

Green-sensitive emulsions C1-1 and C1-2 were prepared under the same preparation conditions for Emulsions A1-1 and A1-2, except that the temperature at the time of forming grains was lowered as compared to Emulsion A1-1, and that the kinds of sensitizing dyes were changed to these described below.

Sensitizing Dye D

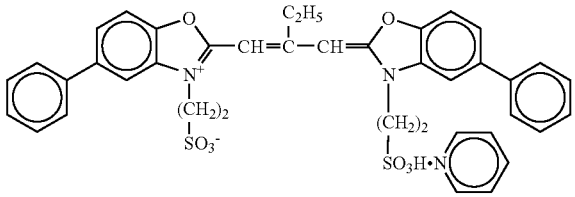

Sensitizing Dye E

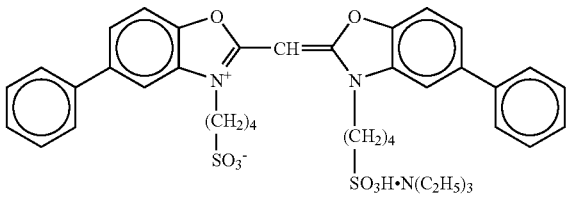

As for the grain size, the emulsion C1-1 had the average side length of 0.40 μm and the emulsion C1-2 had the average side length of 0.30 μm, each with the variation coefficient of average length of 8%.

Further, a green-sensitive Emulsion C1-3 having an average side length of 0.50 μm was prepared in the same manner as Emulsion C1-1, except for elevating the temperature at the time of grain formation. In addition, the amounts of the spectral sensitizers and the chemical sensitizers were changed to 0.8 time as much as those of Emulsion C1-1, respectively.

Further, a green-sensitive Emulsion D1-2 was prepared in the same manner as Emulsion C1-2, except for adding a half amount of the fine grain emulsion having a hexachloro iridium complex doped therein.

(Preparation of Red-Sensitive Layer Emulsions)

A red-sensitive emulsions E1-1 and E1-2 were prepared under the same preparation conditions for Emulsions A1-1 and A1-2, except that the temperature at the time of forming grains was lowered compared to Emulsion A1-1, and that the kind of sensitizing dyes was changed to those described below.

Sensitizing Dye G

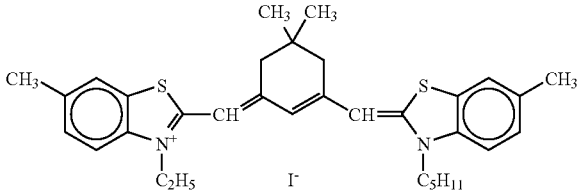

Sensitizing Dye H

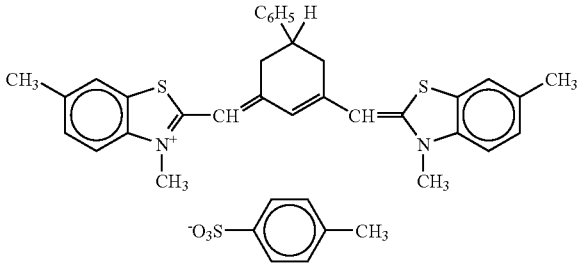

As for the grain size, the Emulsion E1-1 had the average side length of 0.38 μm and the Emulsion E1-2 had the average side length of 0.32 μm, and the variation coefficient of average side length were 9%, respectively.

Further, the following compound I was added to the red-sensitive emulsion layer in an amount of $3.0\times10^{-3}$ mol per mol of the silver halide.

Compound I

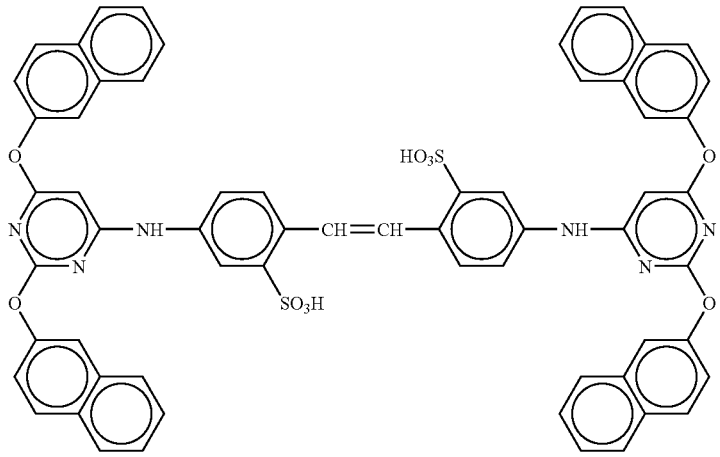

Further, a red-sensitive Emulsion E1-3 having an average side length of 0.48 μm was prepared in the same manner as Emulsion E1-1, except for elevating the temperature at the time of grain formation. In Emulsion E1-3, the amounts of the spectral sensitizers and the chemical sensitizers were changed to 0.8 time as much as those of Emulsion E1-1, respectively.

Further, a red-sensitive Emulsion F1-2 was prepared in the same manner as Emulsion E1-2, except for adding a half amount of the fine grain emulsion having a hexachloro iridium complex doped therein.

A coated sample having the following layer composition was prepared, using the silver halide emulsions thus prepared in the above.

(Preparation of a Coating Solution for the First Layer)

Into 21 g of a solvent (Solv-1) and 80 ml of ethyl acetate were dissolved 61.9 g of a yellow coupler (ExY-1), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 294 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions A1-1 and A1-2 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/M$^2$, 60.0 mg/m$^2$, 5.0 mg/m$^2$, and 10.0 mg/m$^2$, respectively.

(H-1)

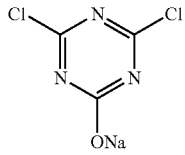

Hardner (used in 1.4% by mass per gelatin)

(H-2)

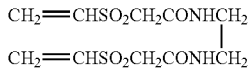

Hardner (H-3)

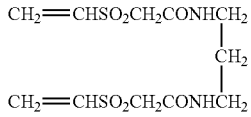

Hardner (Ab-1)

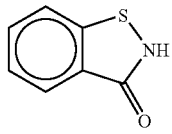

Antiseptic (Ab-2)

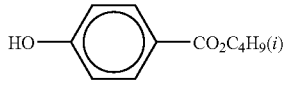

Antiseptic (Ab-3)

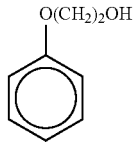

Antiseptic

-continued

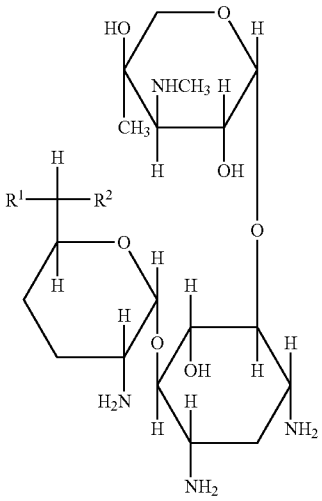

Antiseptic

A mixture in 1:1:1:1 (molar ratio) of a, b, c, and d

| | $R^1$ | $R^2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Further, to the second layer, the fourth layer, the sixth layer, and the seventh layer, was added 1-(3-methylureidophenyl)-5-mercaptotetrazole in amounts of 0.2 mg/$m^2$, 0.2 mg/$m^2$, 0.6 mg/$m^2$, and 0.1 mg/$m^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/$m^2$.

Disodium salt of catecol-3,5-disulfonic acid was added to the second layer, the fourth layer and the sixth layer so that coating amounts would be 6 mg/$m^2$, 6 mg/$m^2$ and 18 mg/$m^2$, respectively.

Further, in order to prevent irradiation, the following dyes (coating amounts are shown in parentheses) were added.

(Ab-4)

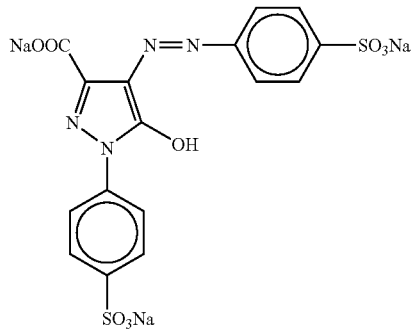

(15 mg/$m^2$)

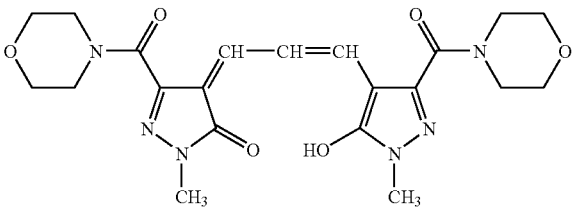

(6 mg/$m^2$)

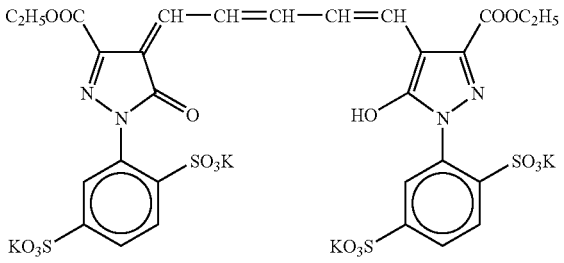

(20 mg/$m^2$)

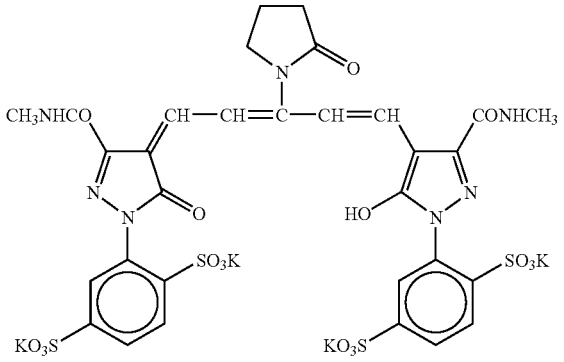

(3 mg/$m^2$)

(Layer Constitution)

The composition of each layer is shown below. The numbers show coating amounts ($g/m^2$). In the case of the silver halide emulsion, the coating amount is in terms of silver.

Support

As the support, used was a transparent 180 μm thick polyethylene terephthalate film having gelatin (6.2 $g/m^2$), the following dye-1 (0.07 $g/m^2$), dye-2 (0.04 $g/m^2$), dye-3 (0.095 $g/m^2$), ultraviolet-absorber (UV-B) (0.31 $g/m^2$), and surfactant (Cpd-13) (0.03 $g/m^2$), each coated on the film of the side opposite to the silver halide emulsion layer side.

Dye-1

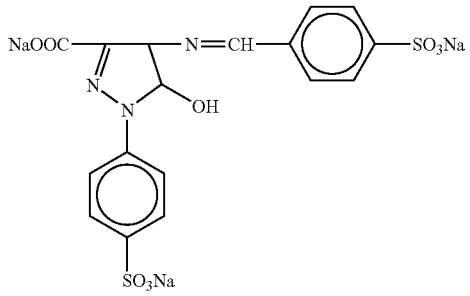

Dye-2

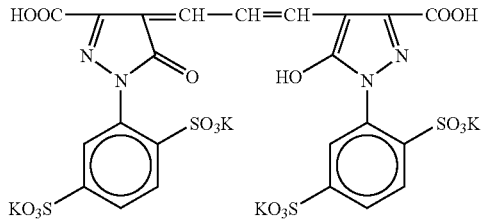

Dye-3

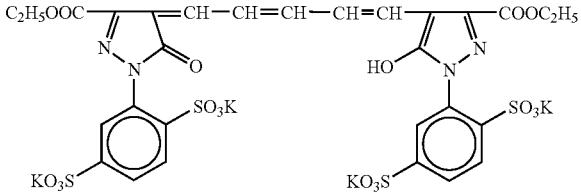

| First Layer (Blue-Sensitive Emulsion Layer) | |
|---|---|
| Silver chloroiodobromide emulsion A1 (gold-sulfur sensitized cubes, a 4:6 mixture of the large-size emulsion A1-1 and the small-size emulsion A1-2 (in terms of mol of silver)) | 0.73 |
| Gelatin | 3.21 |
| Yellow coupler (ExY-1) | 1.52 |
| Color-image stabilizer (Cpd-1) | 0.18 |
| Color-image stabilizer (Cpd-2) | 0.09 |
| Color-image stabilizer (Cpd-3) | 0.19 |

-continued

| | |
|---|---|
| Color-image stabilizer (Cpd-8) | 0.09 |
| Solvent (Solv-1) | 0.63 |
| Second Layer (Color-Mixing Inhibiting Layer) | |
| Gelatin | 1.15 |
| Color-mixing inhibitor (Cpd-4) | 0.10 |
| Color-image stabilizer (Cpd-5) | 0.018 |
| Color-image stabilizer (Cpd-6) | 0.13 |
| Color-image stabilizer (Cpd-7) | 0.007 |
| Solvent (Solv-1) | 0.04 |
| Solvent (Solv-2) | 0.12 |
| Solvent (Solv-5) | 0.13 |
| Third Layer (Green-Sensitive Emulsion Layer) | |
| Silver chloroiodobromide emulsion C1 (gold-sulfur sensitized cubes, a 4:6 mixture of the large-size emulsion C1-1 and the small-size emulsion C1-2 (in terms of mol of silver)) | 0.35 |
| Gelatin | 2.80 |
| Magenta coupler (ExM) | 0.40 |
| Ultraviolet absorbing agent (UV-A) | 0.50 |
| Color-image stabilizer (Cpd-2) | 0.03 |
| Color-image stabilizer (Cpd-4) | 0.006 |
| Color-image stabilizer (Cpd-6) | 0.24 |
| Color-image stabilizer (Cpd-8) | 0.11 |
| Color-image stabilizer (Cpd-9) | 0.03 |
| Color-image stabilizer (Cpd-10) | 0.01 |
| Color-image stabilizer (Cpd-11) | 0.0014 |
| Color-image stabilizer (Cpd-21) | 0.0047 |
| Solvent (Solv-4) | 0.52 |
| Solvent (Solv-9) | 0.30 |
| Fourth Layer (Color-Mixing Inhibiting Layer) | |
| Gelatin | 0.68 |
| Color-mixing inhibitor (Cpd-4) | 0.06 |
| Color-image stabilizer (Cpd-5) | 0.001 |
| Color-image stabilizer (Cpd-6) | 0.08 |
| Color-image stabilizer (Cpd-7) | 0.005 |
| Solvent (Solv-1) | 0.02 |
| Solvent (Solv-2) | 0.08 |
| Solvent (Solv-5) | 0.085 |
| Fifth Layer (Red-Sensitive Emulsion Layer) | |
| Silver chloroiodobromide emulsion E1 (gold-sulfur sensitized cubes, a 4:6 mixture of the large-size emulsion E1-1 and the small-size emulsion E1-2 (in terms of mol of silver)) | 0.49 |
| Gelatin | 2.15 |
| Cyan coupler (ExC-1) | 0.03 |
| Cyan coupler (ExC-2) | 0.14 |
| Cyan coupler (ExC-3) | 0.50 |
| Cyan coupler (ExC-4) | 0.03 |
| Cyan coupler (ExC-5) | 0.01 |
| Color-image stabilizer (Cpd-1) | 0.65 |
| Color-image stabilizer (Cpd-6) | 0.01 |
| Color-image stabilizer (Cpd-7) | 0.01 |
| Color-image stabilizer (Cpd-9) | 0.04 |
| Color-image stabilizer (Cpd-10) | 0.04 |
| Color-image stabilizer (Cpd-14) | 0.04 |
| Color-image stabilizer (Cpd-15) | 0.56 |
| Color-image stabilizer (Cpd-16) | 0.04 |
| Color-image stabilizer (Cpd-17) | 0.04 |
| Color-image stabilizer (Cpd-18) | 0.33 |
| Color-image stabilizer (Cpd-20) | 0.04 |
| Ultraviolet absorbing agent (UV-5) | 0.04 |
| Solvent (Solv-5) | 0.70 |
| Sixth Layer (Ultraviolet Absorbing Layer) | |
| Gelatin | 0.47 |
| Ultraviolet absorbing agent (UV-B) | 0.35 |
| Compound (S1-4) | 0.0015 |
| Solvent (Solv-3) | 0.18 |
| Seventh Layer (Protective Layer) | |
| Gelatin | 0.98 |
| Acryl-modified copolymer of polyvinyl alcohol (modification degree: 17%) | 0.4 |

-continued
| | |
|---|---|
| Liquid paraffin | 0.02 |
| Surface-active agent (Cpd-13) | 0.03 |
(ExY-1) Yellow Coupler
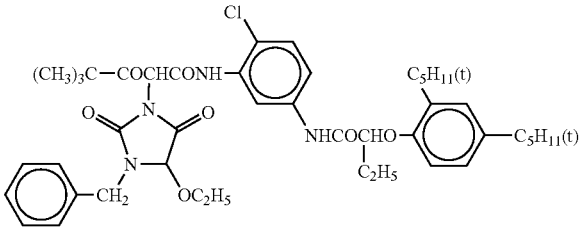
(E x M) Magenta Couple
A mixture in 25:75 (molar ratio) of
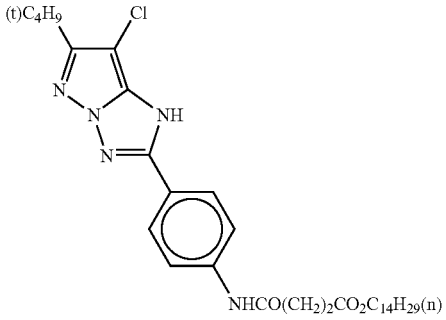
and
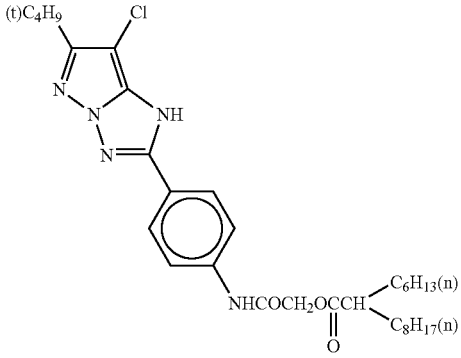
(E x C-1) Cyan Coupler
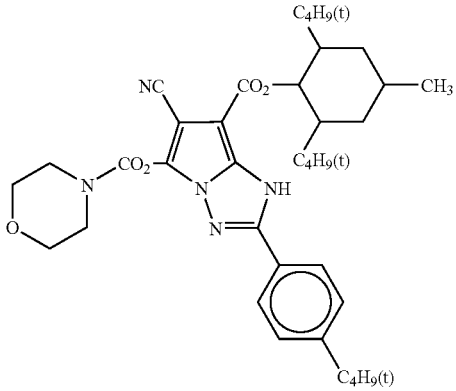
(E x C-2) Cyan Coupler
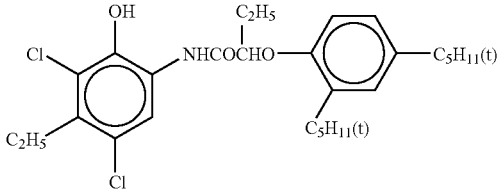
(E x C-3) Cyan Coupler
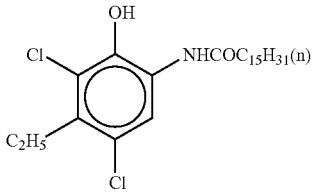
(E x C-4) Cyan Coupler
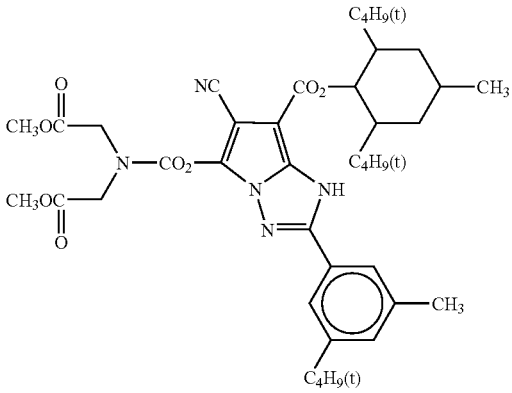

(E x C-5) Cyan Coupler

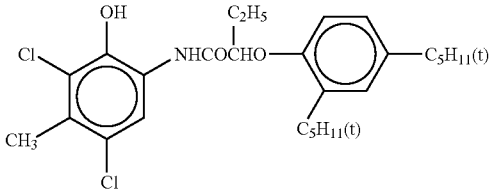

(Cpd-1)

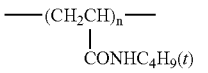

number-average molecular weight 60,000

Color-image stabilizer (Cpd-2)

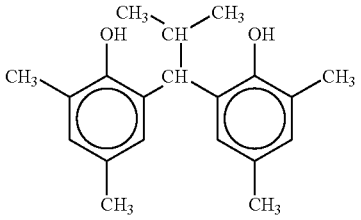

Color-image stabilizer (Cpd-3)

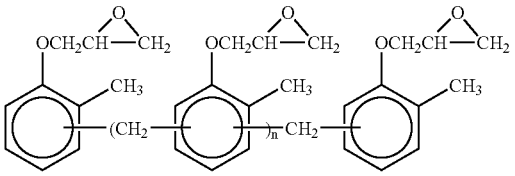

n = 7~8 (average value)

Color-image stabilizer (Cpd-4)

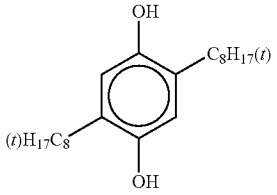

Color-mixing inhibitor (Cpd-5)

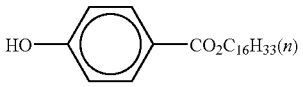

Color-imag stabilizer (Cpd-6)

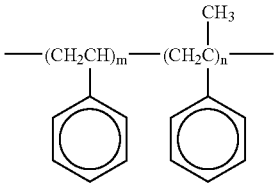

number-average molecular weight 600 m/n = 10/90

Color-image stabilizer

-continued (Cpd-7)

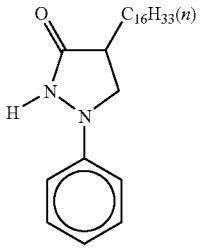

Color-image stabilizer (Cpd-8)

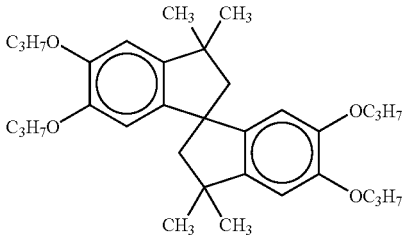

Color-image stabilizer (Cpd-9)

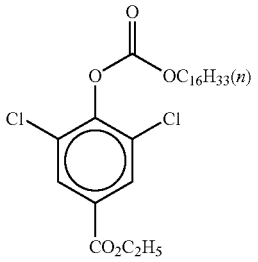

Color-image stabilizer (Cpd-10)

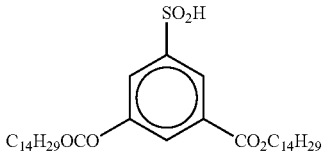

Color-image stabilizer (Cpd-11)

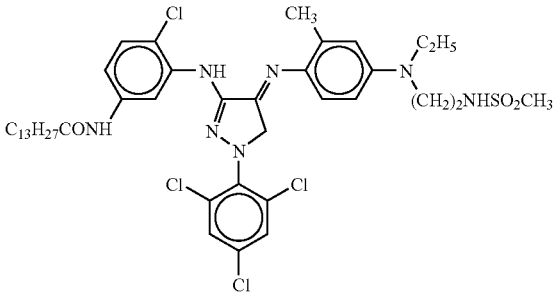

(Cpd-12)

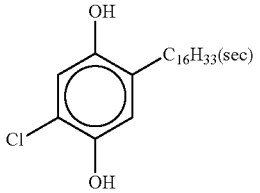

-continued
(Cpd-13)
Surfactant
A mixture in 60:10:30 (molar ratio) of
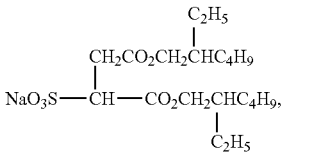
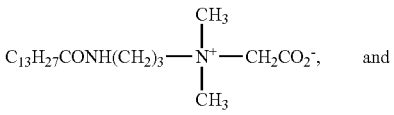
and
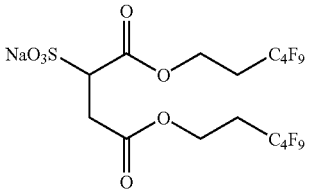
(Cpd-14)
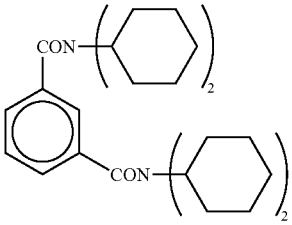
(Cpd-15)
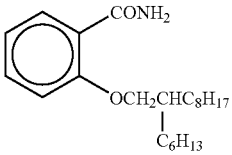
(Cpd-16)
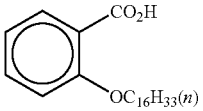
(Cpd-17)
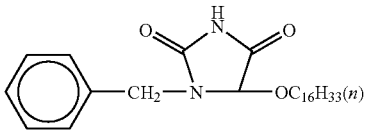
(Cpd-18)
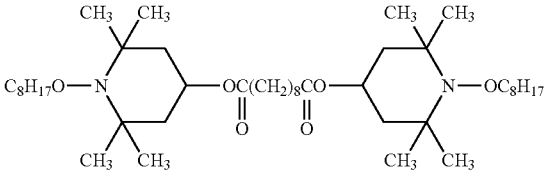
(Cpd-19)
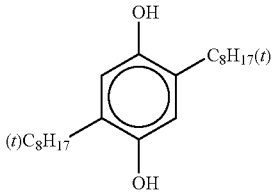
Color-mixing inhibitor
-continued
(Cpd-20)
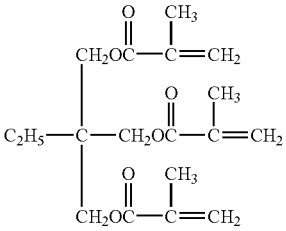
(Cpd-21)
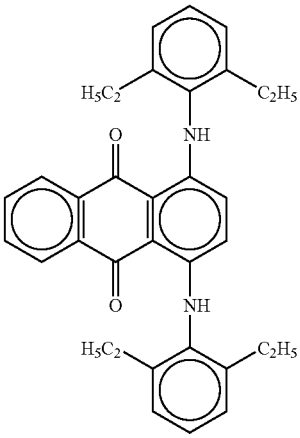
(Solv-1)
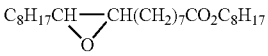
(Solv-2)
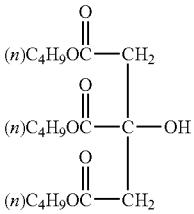
(Solv-3)
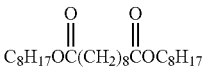
(Solv-4)
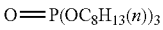
(Solv-5)
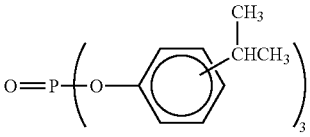
(Solv-7)
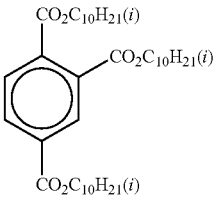
(Solv-8)
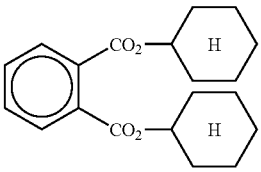

-continued (Solv-9)

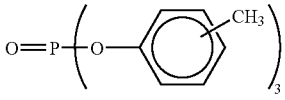

(S1-4)

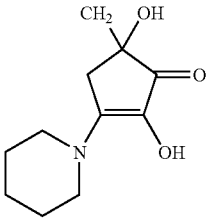

(UV-1)

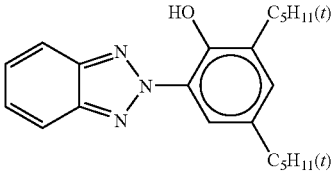

Ultraviolet absorbing agent (UV-2)

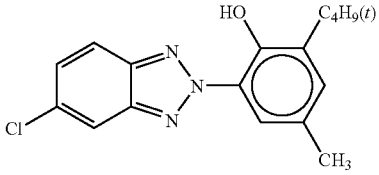

Ultraviolet absorbing agent

-continued (UV-3)

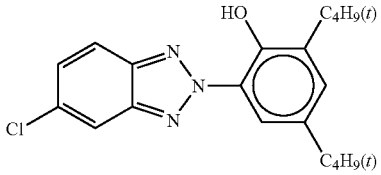

Ultraviolet absorbing agent (UV-4)

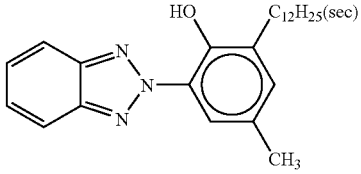

Ultraviolet absorbing agent (UV-5)

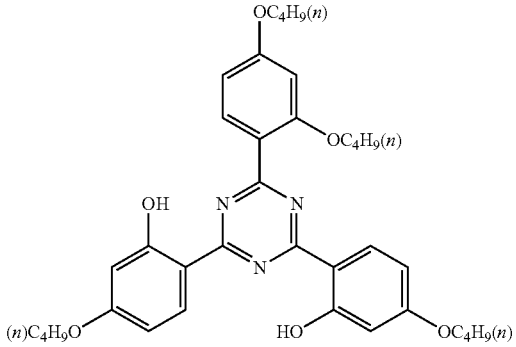

Ultraviolet absorbing agent

UV-A: A mixture of UV-1/UV-2/UV-3 = 7/2/2 (mass ratio)
UV-B: A mixture of UV-1/UV-2/UV-3/UV-4 = 4/3/3/15 (mass ratio)

According to the above, Sample 1011 was prepared.

Further, Samples 1012 to 1015 were prepared in the same manner as Sample 1011, except that the kind of silver halide emulsion, the coating amount of said emulsion (in terms of silver) and the coating amount of compounds to be used were changed, as shown in Table 2.

Each sample thus obtained was exposed through an optical wedge for sensitometry for the exposure time of $10^{-4}$ second, using a xenon flash light source. In this time, the processing was performed under the following conditions using CP-45X (trade name, processing process for color papers, manufactured by Fuji Photo Film Co., Ltd.). The exposure amount was controlled using a CC filter (color correction filter) so that the status-A transmission density of each of yellow, magenta and cyan after color development would be 1.0 with the same exposure amount. A color density of each sample after color development was measured. The values of ΔEY(3.0), ΔEM(3.0), ΔEC(3.0), ΔEY(0.05), ΔEM(0.06) and ΔEC(0.05) each defined in the present invention were measured. The results obtained are shown in Table 2.

TABLE 2

| Sample No. | Blue-Sensitive Emulsion Layer: Kind of emulsion | Blue-Sensitive Emulsion Layer: Coating amount of silver | Green-Sensitive Emulsion Layer: Kind of emulsion | Green-Sensitive Emulsion Layer: Coating amount of silver | Red-Sensitive Emulsion Layer: Kind of emulsion | Red-Sensitive Emulsion Layer: Coating amount of silver | ΔEY(3.0) ΔEM(3.0) ΔEC(3.0) | ΔEY(0.05) ΔEM(0.06) ΔEC(0.05) |
|---|---|---|---|---|---|---|---|---|
| 1011 | A-1 | 0.29 | C-1 | 0.14 | E-1 | 0.20 | 0.55 | 0.58 |
| | A-2 | 0.44 | C-2 | 0.21 | E-2 | 0.29 | 0.48 | 0.60 |
| | | | | | | | 0.43 | 0.59 |
| 1012 | A-1 | 0.29 | C-1 | 0.14 | E-1 | 0.20 | 0.82 | 0.61 |
| | B-2 | 0.44 | D-2 | 0.21 | F-2 | 0.29 | 0.78 | 0.63 |
| | | | | | | | 0.75 | 0.62 |
| 1013 | A-1 | 0.36 | C-1 | 0.18 | E-1 | 0.25 | 0.63 | 0.75 |
| | B-2 | 0.55 | D-2 | 0.26 | F-2 | 0.36 | 0.60 | 0.83 |
| | | | | | | | 0.56 | 0.72 |
| 1014 | A-3 | 0.29 | C-3 | 0.14 | E-3 | 0.20 | 0.58 | 0.73 |
| | A-2 | 0.44 | C-2 | 0.21 | E-2 | 0.29 | 0.55 | 0.81 |
| | | | | | | | 0.52 | 0.80 |
| 1015 | A-2 | 0.73 | C-2 | 0.35 | E-2 | 0.49 | 0.40 | 0.43 |
| | | | | | | | 0.26 | 0.45 |
| | | | | | | | 0.25 | 0.44 |

Unit of coating amount of silver is $g/m^2$.

Each sample thus obtained was subjected to scanning exposure by means of a laser exposure apparatus Lambda 76 (trade name) manufactured by Durst Co., and the processed image was evaluated using the image for evaluation as described below. Before exposure of the image for evaluation, the maximum transmission density of each sample that would be given by Lambda 76 was set so as to become 3.0 in each of yellow, magenta and cyan, and thereafter the sample was subjected to calibration using the image for the calibration containing 21-step gray patches. The calibration was repeated several times, thereby each of the 21-step gray patches being set to the target value.

As the image for evaluation, the following image pattern was prepared by means of computer graphics.

Image 1

To evaluate saturation of color at a high-density portion and naturalness of gradation (density variation) continuity of an image with gradation, a square image, whose density continuously increased primarily in proportion to distance, in both a main scanning direction and a sub (side) scanning direction, over the range of from density 0 to the maximum density set by the above-mentioned calibration, was prepared for each of yellow, magenta, and cyan.

Image 2

To evaluate loss of letter-edqe definition and density stability of the white portion (white letter), a square image having the maximum density set by the above-mentioned calibration, and having provided in it an "A" (capital letter of alphabet A) formed with the minimum density, was prepared for each of yellow, magenta and cyan. In this image pattern, the size of the letter was changed gradually, so that the edge definition loss with respect to letters having various line widths could be evaluated.

As for the evaluation, 20 members of researchers conducted a sensory evaluation of five-grade system, with respect to vividness of each color and naturalness of gradation (density variation) continuity using the above-mentioned image 1, and a reduction degree of the letter-edge definition loss and a favorite degree of the color of the white portion using the above-mentioned image 2. These items were evaluated by their average values, respectively. The larger numeral indicates the more favorite evaluation, for example, the lower level of letter-edge definition loss.

In the above-mentioned evaluation, two kinds of color-development processing described below were used, to evaluate fluctuation of each evaluation item resulting from variation of the processing conditions.

Processing 1

Sample 1011 was uniformly exposed to light so that the density obtained by the processing according to the aforementioned CP-45X (Fuji Photo Film Co., Ltd.) became about 1.0 (gray density). The sample thus exposed was subjected to continuous processing (running test) according to said CP-45X until the color-developing replenisher volume became twice as much as the volume of a color-developing replenisher tank, thereby a running solution (a processing solution in a running equilibrium state) was obtained. The replenishment rate in this running test was the same as mentioned above. The processing using the thus-obtained processing solution is referred to as Processing 1.

Processing 2

A running test was conducted in the same manner as the running test process for obtaining the color-developing solution of Processing 1, except for 1.2 time increase in a replenishment rate of the color-developing solution. The processing using the thus-obtained processing solution is referred to as Processing 2.

The results thus obtained are shown in Table 3.

TABLE 3

| Sample No. | Vividness of color | | Naturalness of gradation | | Reduction degree of letter-edge definition loss | | Favorite degree of color in white portion | | Remarks |
|---|---|---|---|---|---|---|---|---|---|
| | Processing 1 | Processing 2 | Processing 1 | Processing 2 | Processing 1 | Processing 2 | Processing 1 | Processing 2 | |
| 1011 | 4.8 | 4.3 | 4.3 | 4.3 | 4.7 | 4.5 | 4.5 | 4.3 | This invention |
| 1012 | 4.8 | 4.2 | 4.2 | 4.1 | 1.9 | 1.8 | 3.9 | 3.6 | Comparative example |
| 1013 | 3.3 | 2.4 | 4.3 | 4.3 | 3.2 | 2.8 | 2.4 | 2.0 | Comparative example |
| 1014 | 4.6 | 4.3 | 4.5 | 4.4 | 2.8 | 2.3 | 2.5 | 2.1 | Comparative example |
| 1015 | 4.8 | 4.1 | 2.6 | 2.2 | 4.6 | 4.4 | 4.5 | 4.3 | Comparative example |

From the results shown in Table 3, it is seen that the vividness of color, the naturalness of gradation (density variation), the reduction degree of letter-edge definition loss, and the favorite degree of a color of the white portion could be maintained within a preferable grade only by the material and method according to the present invention, regardless fluctuation of the processing conditions.

Example 2

Samples 1016 to 1017 were prepared in the same manner as Sample 1011 in the above Example 1, except that the coating amounts of dye image stabilizers Cpd-1 and Cpd-21 were changed, as shown in Table 4. Further, Samples 1018 and 1019 were prepared in the same manner as Sample 1011, except that the coating amounts of 1-(3-methylureidophenyl)-5-mercaptotetrazole added to the second layer, the forth layer, the sixth layer and the seventh layer were changed uniformly. The coating amounts of 1-(3-methylureidophenyl)-5-mercapto tetrazole in Samples 1018 and 1019 each are indicated, in Table 4, as a relative value, assuming that the coating amount of the compound in Sample 1011 be 1.

Each sample thus obtained was exposed through an optical wedge for sensitometry for the exposure time of $10^{-4}$ second, using a xenon flash light source. Further, the processing was performed under the above-mentioned conditions using CP-45X (processing process for color papers, manufactured by Fuji Photo Film Co., Ltd.). The exposure amount was controlled using a CC filter so that the status-A transmission density of each of yellow, magenta and cyan after color development described below became 1.0 with the identical exposure amount. A color density of each sample after color development was measured. The values of ΔEY(3.0), ΔEM(3.0), and ΔEC(3.0) each defined in the present invention were measured. Separately, after each sample was uniformly exposed with an exposure amount lower by 0.8 (log E) than the exposure amount necessary to give a transmission density of 1.0, color development was conducted in the same manner as above, to measure a hue after processing. The results obtained are shown in Table 4.

TABLE 4

| Sample No. | Coating amount of Cpd-11 | Coating amount of Cpd-21 | Coating amount of PMT | ΔEY(3.0) | ΔEM(3.0) | ΔEC(3.0) | L* | a* | B* |
|---|---|---|---|---|---|---|---|---|---|
| 1011 | 0.0014 g/m$^2$ | 0.0047 g/m$^2$ | 1.0 | 0.55 | 0.48 | 0.43 | 95.30 | 0.04 | 0.25 |
| 1016 | 0.0014 g/m$^2$ | 0.0016 g/m$^2$ | 1.0 | 0.55 | 0.48 | 0.43 | 95.60 | 0.10 | 0.90 |
| 1017 | 0.0040 g/m$^2$ | 0.0047 g/m$^2$ | 1.0 | 0.63 | 0.60 | 0.56 | 95.00 | 0.44 | 0.05 |
| 1018 | 0.0014 g/m$^2$ | 0.0047 g/m$^2$ | 2.0 | 0.70 | 0.65 | 0.59 | 95.80 | −0.05 | 0.15 |
| 1019 | 0.0014 g/m$^2$ | 0.0047 g/m$^2$ | 0.4 | 0.45 | 0.40 | 0.40 | 92.80 | 0.50 | 0.24 |

Note:

"Coating amount of PMT" means the relative coating amount of 1-(3-methylureidophenyl)-5-mercaptotetrazole as described above.

Similarly to Example 1, Sample 1011 and Samples 1016 to 1019 were subjected to calibration using Lambda 76, and then processed according to the above Processing 1 and Processing 2 using the same images for evaluation as in Example 1, thereby to evaluate the vividness of color, the naturalness of gradation (density variation), the reduction degree of letter-edge definition loss, and the favorite degree of a color of the white portion. The results obtained are shown in Table 5.

TABLE 5

| Sample No. | Vividness of color | | Naturalness of gradation | | Reduction degree of letter-edge definition loss | | Favorite degree of color in white portion | | Remarks |
|---|---|---|---|---|---|---|---|---|---|
| | Processing 1 | Processing 2 | Processing 1 | Processing 2 | Processing 1 | Processing 2 | Processing 1 | Processing 2 | |
| 1011 | 4.8 | 4.3 | 4.3 | 4.3 | 4.7 | 4.5 | 4.5 | 4.3 | This invention |
| 1016 | 4.8 | 4.4 | 4.2 | 4.3 | 4.6 | 4.5 | 3.2 | 2.8 | Comparative example |
| 1017 | 3.8 | 2.7 | 4.3 | 4.3 | 3.2 | 2.8 | 2.4 | 2.0 | Comparative example |
| 1018 | 4.6 | 4.4 | 4.5 | 4.4 | 2.5 | 2.3 | 3.4 | 3.2 | Comparative example |
| 1019 | 3.3 | 2.8 | 4.2 | 4.2 | 4.3 | 3.2 | 2.8 | 2.2 | Comparative example |

From the results shown in Table 5, it is seen that the vividness of color, the naturalness of gradation (density variation), the reduction degree of letter-edge definition loss, and the favorite degree of a color of the white portion could be maintained within a preferable grade only by the light-sensitive material and method according to the present invention, regardless the conditions of the processing.

Example 3

Preparation of Blue-Sensitive Layer Emulsions A2-1 and A2-2 for Use in the Present Invention To 1.06 L of deionized distilled water containing 5.7 mass % of deionized gelatin, 46.3 ml of 10% NaCl solution, 46.4 ml of $H_2SO_4$ (1N), and then 0.012 g of the above-described compound X were added in the above order. Thereafter, the temperature of the resulting solution was adjusted to 60° C., and immediately after this, 0.1 mol of silver nitrate and 0.1 mol of NaCl were added to the reaction vessel over 10 minutes, while performing rapid stirring. Subsequently, 1.5 mol of silver nitrate and a NaCl solution were added over 60 minutes, by a flow rate acceleration method so that the final addition rate became 4 times the initial addition rate. Then, a 0.2-mol % silver nitrate solution and a NaCl solution were added over 6 minutes in a constant addition rate. On this occasion, $K_3IrCl_5(H_2O)$ was added to the NaCl solution in an amount sufficient to be $5\times10^{-7}$ mol to the total amount of silver, to dope aquated iridium in the grains.

Furthermore, solutions of 0.2 mol of silver nitrate, 0.18 mol of NaCl, and 0.02 mol of KBr were added over 6 minutes. On this occasion, $K_4Ru(CN)_6$ and $K_4Fe(CN)_6$ in the amounts corresponding to $0.5\times10^{-5}$ mol to the total amount of silver, respectively, were dissolved in the aqueous halogen solution and added to the silver halide grains.

Furthermore, during the last stage of the grain growth, an aqueous KI solution corresponding to 0.001 mol to the total amount of silver, was added to the reaction vessel over 1 minute. The addition was started at the point of time when 93% of all grain formation was completed.

Thereafter, the above-described compound Y, which is a settling agent, was added at 40° C., and the pH of the resulting solution was adjusted to about 3.5, and desalting and washing were performed.

To the emulsion after the desalting and washing with water, deionized gelatin and an aqueous NaCl solution as well as an aqueous. NaOH solution were added, and the temperature of the obtained mixture was elevated to 50° C., and the mixture was adjusted to pAg 7.6 and pH 5.6.

Thus, a gelatin that contained silver halide cubic grains having the halide composition of 98.9 mol % of silver chloride, 1 mol % of silver bromide, and 0.1 mol % of silver iodide, and having the average side length of 0.70 μm with the variation coefficient of side length of 8%, was obtained.

The above-mentioned emulsion grains were maintained at 60° C., and the above-described Spectral sensitizing dye-1 and Spectral sensitizing dye-2 were added, to the emulsion, in the amounts of $2.5\times10^{-4}$ mol/Ag mol and $2.0\times10^{4}$ mol/Ag mol, respectively. Furthermore, $1\times10^{-5}$ mol/Ag mol of the thiosulfonic acid compound-1 was added, and then fine grain emulsion having 90 mol % of silver bromide and 10 mol % of silver chloride, having the average grain diameter of 0.05 μm, and doped with iridium hexachloride, was added, and the resulting mixture was ripened for 10 minutes. Furthermore, fine grains having 40 mol % of silver bromide and 60 mol % of silver chloride, and having the average grain diameter of 0.05 μm, were added, and the resulting mixture was ripened for 10 minutes. The fine grains were dissolved, thus the silver bromide content of host cubic grains increased to 1.3 mol %. The iridium hexachloride was doped in the grains in an amount of $1\times10^{-7}$ mol/Ag mol.

Subsequently, $1\times10^{-5}$ mol/Ag mol of sodium thiosulfate and $2\times10^{-5}$ mol of the gold sensitizer-1 were added to the mixture, and immediately the temperature of the mixture was elevated to 60° C., and subsequently ripened for 40 minutes. Thereafter, the temperature of the mixture was lowered to 50° C. Immediately thereafter, the mercapto compounds-1 and -2 were added to the mixture so that the amounts thereof each became $6\times10^{-4}$ mol/Ag mol. Thereafter, after 10 minutes of ripening, an aqueous KBr solution was added to the mixture so that KBr became 0.008 mol per mol of Ag. After 10 minutes of ripening, the temperature of the emulsion was decreased and the product was stored.

Thus, a blue-sensitive layer high-sensitivity emulsion A2-1 was prepared.

In the same manner as the above-mentioned emulsion preparation method, except for the temperature during grain formation, cubic grains having an average side length of 0.55 μm with a variation coefficient of side length of 9% were formed. The temperature during grain formation was 55° C.

Spectral sensitization and chemical sensitization were performed in the same manner as the above, except for correcting the sensitization amounts so as to meet specific surface area (according to the ratio of the side lengths 0.7/0.55=1.27 fold), to prepare a blue-sensitive layer low-sensitivity emulsion A2-2.

(Preparation of Blue-Sensitive Layer Emulsions B2-1 and B2-2 for Comparison)

Emulsion B2-1 (high-sensitivity) for comparison for a blue-sensitive layer, and Emulsion B2-2 (low-sensitivity) for comparison for a blue-sensitive layer, were prepared in the same manner as Emulsion A2-1, except for modifying the preparation conditions as described below.

In the preparation conditions of Emulsion A2-1, the temperature at the time of grain formation was set at 68° C., thereby the grain size in terms of the average side length would be 0.85 μm. A variation coefficient of the grain size in terms of the side length was 12%. Further, introduction of iodide ions at the final stage of grain formation was omitted and the iodide ions were replaced by chloride ions. Consequently, the halogen composition at the time of completion of the grain formation was silver chloride of 99% by mole and silver bromide of 1% by mole. The amounts of the above spectral sensitizing dye-1 and spectral sensitizing dye-2 added each were altered to 1.25 times as much as Emulsion A2-1. The thiosulfonic acid compound-1 was used in the same amount as Emulsion A2-1.

Further, chemical sensitization was altered as follows. After addition of an emulsion composed of fine grains having a halogen composition of 90 mol % of silver bromide and 10 mol % of silver chloride and an average grain diameter of 0.05 μm and further having a hexachloro iridium complex doped therein, the resulting host emulsion was ripened for 10 minutes. Further, fine grains having a halogen composition of 40% by mole of silver bromide and 60% by mole of silver chloride and an average grain diameter of 0.05 μm were added. Then, the host emulsion was ripened for 10 minutes, to dissolve the fine grains, thereby the silver bromide content of the host cubic grains increased to 2.0% by mole. The amount of the above-described hexachloro iridium complex doped was $2\times10^{-2}$ mol/mol Ag.

Subsequently, sodium thiosulfate of $1\times10^{-5}$ mol/mol Ag was added as a chemical sensitizer, and immediately after that, the temperature was elevated to 55° C. and then the resultant emulsion was ripened for 70 minutes. Thereafter, the temperature was lowered to 50° C. None of gold chemical sensitizer was added. Immediately after lowering of temperature, the above mercapto compounds-1 and -2 were added so as to become $4\times10^{-4}$ mol/mol of Ag, respectively. Thereafter, the emulsion was ripened for 10 minutes, and then an aqueous solution of KBr was added so as to become 0.010 mole per mole of silver. After ripening for 10 minutes, the temperature was lowered and the prepared emulsion was reserved.

Thus, Emulsion B2-1 (high-sensitivity) for comparison for a blue-sensitive layer was prepared.

Silver halide grains having an average side length of 0.68 μm and a variation coefficient of the grain size of 12% in terms of the side length, were prepared in the same manner as Emulsion B2-1, except for lowering the temperature at the time of grain formation. In view of a surface area of the grains, spectral sensitizers and chemical sensitizers were added in amounts of 1.25 times as much as Emulsion B2-1. Thus, Emulsion B2-2 (low-sensitivity) for comparison of a blue-sensitive layer was prepared.

(Preparation of Green Sensitive Layer Emulsions C2-1 and C2-2 According to the Present Invention)

Under the same preparation conditions for Emulsions A2-1 and A2-2, except that the temperature at the time of forming grains was lowered and that the kinds of sensitizing dyes were changed as described below, a green sensitive layer high-sensitivity emulsion C2-1 and a green sensitive layer low-sensitivity emulsion C2-2 were prepared.

As for the grain size, the high-sensitivity emulsion C2-1 had the average side length of 0.40 'm and the low-sensitivity emulsion C2-2 had the average side length of 0.30 μm, each with the variation coefficient of average length of 8%.

The above-described sensitizing dye D was added to the large-size emulsion (high-sensitivity emulsion C2-1) in an amount of $3.0\times10^{-4}$ mol, and to the small-size emulsion (low-sensitivity emulsion C2-2) in an amount of $3.6\times10^{-4}$ mol, per mol of the silver halide; and the above-described sensitizing dye E was added to the large-size emulsion in an amount of $4.0\times10^{-5}$ mol, and to the small-size emulsion in an amount of $7.0\times10^{-5}$ mol, per mol of the silver halide.

(Preparation of Green Sensitive Layer Emulsions D2-1 and D2-2 for Comparison)

Under the same preparation conditions for Emulsions B2-1 and B2-2, except that the temperature at the time of forming grains was lowered, and the kinds of sensitizing dyes were changed as described below, a green sensitive layer high-sensitivity emulsion D2-1 and a green sensitive layer low-sensitivity emulsion D2-2 each for comparison were prepared.

As for the grain size, the high-sensitivity emulsion D2-1 had the average side length of 0.50 μm and the low-sensitivity emulsion D2-2 had the average side length of 0.40 μm, each with the variation coefficient of average length of 10%.

The sensitizing dye D was added to the large-size emulsion (high-sensitivity emulsion D2-1) in an amount of $4.0\times10^{-4}$ mol, and to the small-size emulsion (low-sensitivity emulsion D2-2) in an amount of $4.5\times10^{-4}$ mol, per mol of the silver halide; and the sensitizing dye E was added to the large-size emulsion in an amount of $5.0\times10^{-5}$ mol, and to the small-size emulsion in an amount of $8.8\times10^{-5}$ mol, per mol of the silver halide.)

(Preparation of Red Sensitive Layer Emulsions E2-1 and E2-2 According to the Present Invention)

Under the same preparation conditions for Emulsions A2-1 and A2-2, except that the temperature at the time of forming grains was lowered and that the kinds of sensitizing dyes were changed as described below, a red sensitive layer high-sensitivity emulsion E2-1 and a red sensitive layer low-sensitivity emulsion E2-2 were prepared.

As for the grain size, the high-sensitivity emulsion E2-1 had the average side length of 0.38 μm and the low-sensitivity emulsion E2-2 had the average side length of 0.32 μm, and the variation coefficient of average side length were 9% and 10%, respectively.

The above-described sensitizing dyes G and H were added to the large-size emulsion (high-sensitivity emulsion E2-1) in an amount of $8.0\times10^{-5}$ mol, respectively, per mol of silver halide, and to the small-size emulsion (low-sensitivity emulsion E2-2) in an amount of $10.7\times10^{-5}$ mol, respectively, per mol of silver halide.

Further, the above compound I was added to the red-sensitive emulsion layer in an amount of $3.0\times10^{-3}$ mol per mol of the silver halide.

(Preparation of Red Sensitive Layer Emulsions F2-1 and F2-2 for Comparison)

Under the same preparation conditions for Emulsions B2-1 and B2-2, except that the temperature at the time of forming grains was lowered, and the kinds of sensitizing dyes were changed as described below, a red sensitive layer high-sensitivity emulsion F2-1 and a red sensitive layer low-sensitivity emulsion F2-2 each for comparison were prepared.

As for the grain size, the high-sensitivity emulsion F2-1 had the average side length of 0.57 μm and the low-sensitivity emulsion F2-2 had the average side length of 0.43 μm, and the variation coefficient of average side length were 9% and 10%, respectively.

The above-described sensitizing dyes G and H were added to the large-size emulsion (high-sensitivity emulsion F2-1) in an amount of $1.0\times10^{-4}$ mol, respectively, per mol of silver halide, and to the small-size emulsion (low-sensitivity emulsion F2-2) in an amount of $1.34\times10^{-4}$ mol, respectively, per mol of silver halide. Further, the above compound I was added to the red-sensitive emulsion layer in an amount of $3.0\times10^{-3}$ mol per mol of the silver halide.

(Preparation of Emulsions G2-1 and G2-2 for the Blue-Sensitive Layer According to the Present Invention)

Emulsion G2-1 (high-sensitivity) of the blue-sensitive layer and Emulsion G2-2 (low-sensitivity) of the blue-sensitive layer were prepared in the same manner as Emulsion A2-1 and Emulsion A2-2, respectively, except that an aqueous solution of $K_3[RhBr_6]$ was added at the step of from 60% to 80% addition of the entire silver nitrate amount, so that the Rh amount became $2.7\times10^{-9}$ mol per mol of the finished silver halide. The average side length of grains and the variation coefficient of the grain size in terms of the side length were the same as those of the corresponding Emulsions A2-1 and A2-2.

(Preparation of Emulsions H2-1 and H2-2 of the Green-Sensitive Layer According to the Present Invention)

Emulsion H2-1 (high-sensitivity) of the green-sensitive layer and Emulsion H2-2 (low-sensitivity) of the green-sensitive layer were prepared in the same manner as Emulsion C2-1 and Emulsion C2-2 respectively, except that an aqueous solution of $K_3[RhBr_6]$ was added at the step of from 60% to 80% addition of the entire silver nitrate amount, so that the Rh amount became $4.7\times10^{-9}$ mol per mol of the finished silver halide. The average side length of grains and the variation coefficient of the grain size in terms of the side length were the same as those of the corresponding Emulsions C2-1 and C2-2.

(Preparation of Emulsions I2-1 and I2-2 of the Red-Sensitive Layer According to the Present Invention)

Emulsion I2-1 (high-sensitivity) of the red-sensitive layer and Emulsion I2-2 (low-sensitivity) of the red-sensitive layer were prepared in the same manner as Emulsion E2-1 and Emulsion E2-2 respectively, except that an aqueous solution of $K_3[RhBr_6]$ was added at the step of from 60% to 80% addition of the entire silver nitrate amount, so that the Rh amount became $6.7\times10^{-9}$ mol per mol of the finished silver halide. The average side length of grains and the variation coefficient of the grain size in terms of the side length were the same as those of the corresponding Emulsions E2-1 and E2-2.

(Preparation of a Coating Solution for the First Layer)

The emulsified dispersion A prepared in the same manner as in Example 1, and the above Emulsions A2-1 and A2-2 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, the above-described 1-oxy-3,5-dichloro-s-triazine sodium salt (H-1), (H-2), and (H-3) were used. Further, to each layer, were added the above-described Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

Further, to the second layer, the fourth layer, the sixth layer, and the seventh layer, was added 1-(3-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively.

Further, in order to prevent irradiation, the same dyes as used in Example 1 were added.

(Layer Constitution)

The composition of each layer is shown below. The numbers show coating amounts (g/m$^2$). In the case of the silver halide emulsion, the coating amount is in terms of silver.

Support

As the support, used was a transparent 180 μm thick polyethylene terephthalate film having gelatin (6.2 g/m$^2$), the above-described dye-1 (0.07 g/m$^2$), dye-2 (0.04 g/m$^2$), dye-3 (0.095 g/m$^2$), ultraviolet-absorber (UV-B) (0.31 g/m$^2$), and surfactant (Cpd-13) (0.03 g/m$^2$), each coated on the film of the side opposite to the emulsion coated side.

| | |
|---|---|
| First Layer (Blue-Sensitive Emulsion Layer) | |
| Silver chloroiodobromide emulsion A2 (gold-sulfur sensitized cubes, a 3:7 mixture of the large-size emulsion A2-1 and the small-size emulsion A2-2 (in terms of mol of silver)) | 0.73 |
| Gelatin | 3.21 |
| Yellow coupler (ExY-1) | 1.52 |
| Color-image stabilizer (Cpd-1) | 0.18 |
| Color-image stabilizer (Cpd-2) | 0.09 |
| Color-image stabilizer (Cpd-3) | 0.19 |
| Color-image stabilizer (Cpd-8) | 0.09 |
| Solvent (Solv-1) | 0.63 |
| Second Layer (Color-Mixing Inhibiting Layer) | |
| Gelatin | 1.15 |
| Color-mixing inhibitor (Cpd-4) | 0.10 |

-continued

| | |
|---|---|
| Color-image stabilizer (Cpd-5) | 0.018 |
| Color-image stabilizer (Cpd-6) | 0.13 |
| Color-image stabilizer (Cpd-7) | 0.07 |
| Solvent (Solv-1) | 0.04 |
| Solvent (Solv-2) | 0.12 |
| Solvent (Solv-5) | 0.13 |
| Third Layer (Green-Sensitive Emulsion Layer) | |
| Silver chloroiodobromide emulsion C2 (gold-sulfur sensitized cubes, a 1:3 mixture of the large-size emulsion C2-1 and the small-size emulsion C2-2 (in terms of mol of silver)) | 0.35 |
| Gelatin | 2.80 |
| Magenta coupler (ExM) | 0.40 |
| Ultraviolet absorbing agent (UV-A) | 0.50 |
| Color-image stabilizer (Cpd-2) | 0.03 |
| Color-image stabilizer (Cpd-4) | 0.006 |
| Color-image stabilizer (Cpd-6) | 0.24 |
| Color-image stabilizer (Cpd-8) | 0.11 |
| Color-image stabilizer (Cpd-9) | 0.03 |
| Color-image stabilizer (Cpd-10) | 0.01 |
| Color-image stabilizer (Cpd-11) | 0.001 |
| Color-image stabilizer (Cpd-21) | 0.005 |
| Solvent (Solv-4) | 0.52 |
| Solvent (Solv-9) | 0.30 |
| Fourth Layer (Color-Mixing Inhibiting Layer) | |
| Gelatin | 0.68 |
| Color-mixing inhibitor (Cpd-4) | 0.06 |
| Color-image stabilizer (Cpd-5) | 0.001 |
| Color-image stabilizer (Cpd-6) | 0.08 |
| Color-image stabilizer (Cpd-7) | 0.005 |
| Solvent (Solv-1) | 0.02 |
| Solvent (Solv-2) | 0.08 |
| Solvent (Solv-5) | 0.085 |
| Fifth Layer (Red-Sensitive Emulsion Layer) | |
| Silver chloroiodobromide emulsion E2 (gold-sulfur sensitized cubes, a 5:5 mixture of the large-size emulsion E2-1 and the small-size emulsion E2-2 (in terms of mol of silver)) | 0.49 |
| Gelatin | 2.15 |
| Cyan coupler (ExC-1) | 0.03 |
| Cyan coupler (ExC-2) | 0.14 |
| Cyan coupler (ExC-3) | 0.50 |
| Cyan coupler (ExC-4) | 0.03 |
| Cyan coupler (ExC-5) | 0.01 |
| Color-image stabilizer (Cpd-1) | 0.65 |
| Color-image stabilizer (Cpd-6) | 0.01 |
| Color-image stabilizer (Cpd-7) | 0.01 |
| Color-image stabilizer (Cpd-9) | 0.04 |
| Color-image stabilizer (Cpd-10) | 0.04 |
| Color-image stabilizer (Cpd-14) | 0.04 |
| Color-image stabilizer (Cpd-15) | 0.56 |
| Color-image stabilizer (Cpd-16) | 0.04 |
| Color-image stabilizer (Cpd-17) | 0.04 |
| Color-image stabilizer (Cpd-18) | 0.33 |
| Color-image stabilizer (Cpd-20) | 0.04 |

-continued

| | |
|---|---|
| Ultraviolet absorbing agent (UV-5) | 0.04 |
| Solvent (Solv-5) | 0.70 |
| Sixth Layer (Ultraviolet Absorbing Layer) | |
| Gelatin | 0.47 |
| Ultraviolet absorbing agent (UV-B) | 0.35 |
| Compound (S1-4) | 0.0015 |
| Solvent (Solv-3) | 0.18 |
| Seventh Layer (Protective Layer) | |
| Gelatin | 0.98 |
| Acryl-modified copolymer of polyvinyl alcohol (modification degree: 17%) | 0.4 |
| Liquid paraffin | 0.02 |
| Surface-active agent (Cpd-13) | 0.03 |

The developing process was performed under the following conditions using CP-45X (processing process for color papers, manufactured by Fuji Photo Film Co., Ltd.).

Processing process for Fuji color papers CP-45X

| Processing steps | Processing temperature | Processing time | Replenishment rate |
|---|---|---|---|
| Color-development | 35 ± 0.3° C. | 110 sec | 370 ml/m$^2$ |
| Bleach-fixing | 33 to 37° C. | 110 sec | 494 ml/m$^2$ |
| Rinse | 24 to 34° C. | 220 sec | 3 to 10 L/m$^2$ |
| Drying | 50 to 70° C. | 3 min | |

As mentioned above, Sample 2011 was prepared. Further, other samples were prepared in the same manner as Sample 2011, except for altering kinds of emulsion and coating amounts of layers containing the emulsion, as shown in Table 6.

TABLE 6

| | Emulsions to be used | | | Coating amount of emulsion-containing layer (assuming that coating amount of Sample 2011 would be 100) | | | |
|---|---|---|---|---|---|---|---|
| Sample No. | Blue-Sensitive Layer | Green-Sensitive Layer | Red-Sensitive Layer | Blue-Sensitive Layer | Green-Sensitive Layer | Red-Sensitive Layer | Remarks |
| 2001 | B2-1/B2-2 | D2-1/D2-2 | F2-1/F2-2 | 100 | 100 | 100 | Comparative example |
| 2002 | B2-1/B2-2 | D2-1/D2-2 | F2-1/F2-2 | 85 | 85 | 85 | Comparative example |
| 2003 | B2-1/B2-2 | D2-1/D2-2 | F2-1/F2-2 | 70 | 70 | 70 | Comparative example |

TABLE 6-continued

| Sample No. | Emulsions to be used: Blue-Sensitive Layer | Green-Sensitive Layer | Red-Sensitive Layer | Coating amount of emulsion-containing layer (assuming that coating amount of Sample 2011 would be 100): Blue-Sensitive Layer | Green-Sensitive Layer | Red-Sensitive Layer | Remarks |
|---|---|---|---|---|---|---|---|
| 2011 | A2-1/A2-2 | C2-1/C2-2 | E2-1/E2-2 | 100 | 100 | 100 | This invention |
| 2012 | A2-1/A2-2 | C2-1/C2-2 | E2-1/E2-2 | 85 | 85 | 85 | Comparative example |
| 2013 | A2-1/A2-2 | C2-1/C2-2 | E2-1/E2-2 | 70 | 70 | 70 | Comparative example |
| 2021 | G2-1/G2-2 | H2-1/H2-2 | I2-1/I2-2 | 100 | 100 | 100 | This invention |
| 2022 | G2-1/G2-2 | H2-1/H2-2 | I2-1/I2-2 | 85 | 85 | 85 | Comparative example |
| 2023 | G2-1/G2-2 | H2-1/H2-2 | I2-1/I2-2 | 70 | 70 | 70 | Comparative example |

Exposure

Each sample thus prepared was exposed using a xenon flash light source, in which emitting time was controlled to $10^{-4}$ sec, and, at 5 minutes after the exposure, the exposed sample was processed according to the above-mentioned color-development process. At the time of exposure, a color density correction filter (CC filter) was used, as needed, so that the obtained image could contain densities ranging from the minimum density to the maximum density. Further, using the CC filter, as needed, the status A transmission densities of yellow, magenta, and cyan were each adjusted so as to become 1.0 in the equal exposure amount.

Separately, each sample exposed under the same exposure conditions as the above, was subjected to the color-development processing started in 30 minutes after the exposure. These samples were jointed so that the position of the same exposure amount adjoined each other, and they were used for a sensory evaluation. As for the evaluation, 10 members of researchers conducted a sensory evaluation of five-grade system (five grades from 5 (Excellent) to 1 (Poor), providing that the grades (average value) 4 or more are allowable) with respect to black depth of the high-density area and continuity at the jointing points. The results are shown in Table 7.

TABLE 7

| Sample No. | Maximum transmission density: Yellow | Magenta | Cyan | Transmission density obtained starting processing 30 minutes after exposure, in the exposure amount to give transmission density of 1.0 when processed 5 minutes after exposure: Yellow | Magenta | Cyan | Sensory evaluation of black depth | Sensory evaluation of continuity at the jointing points | Remarks |
|---|---|---|---|---|---|---|---|---|---|
| 2001 | 3.03 | 3.02 | 3.04 | 0.91 | 1.07 | 1.11 | 4.7 | 1.7 | Comparative example |
| 2002 | 2.59 | 2.61 | 2.61 | 0.93 | 1.07 | 1.08 | 3.0 | 3.3 | Comparative example |
| 2003 | 2.17 | 2.20 | 2.19 | 0.93 | 1.06 | 1.07 | 1.2 | 4.0 | Comparative example |
| 2011 | 3.02 | 3.04 | 3.05 | 0.97 | 1.03 | 1.04 | 4.8 | 4.1 | This invention |
| 2012 | 2.60 | 2.60 | 2.61 | 1.00 | 1.02 | 1.04 | 3.2 | 4.2 | Comparative example |
| 2013 | 2.19 | 2.18 | 2.19 | 0.99 | 1.03 | 1.03 | 1.5 | 4.3 | Comparative example |
| 2021 | 3.05 | 3.07 | 3.07 | 1.00 | 1.01 | 1.01 | 4.9 | 4.7 | This invention |
| 2022 | 2.61 | 2.59 | 2.61 | 0.99 | 1.00 | 1.01 | 3.2 | 4.8 | Comparative example |
| 2023 | 2.20 | 2.20 | 2.18 | 1.00 | 0.99 | 1.00 | 1.3 | 4.7 | Comparative example |

As is apparent from the results shown in Table 7, when compared to the samples for comparison, all the samples according to the present invention were excellent in both black depth and jointing suitability, and thereby both properties could be satisfied at the same time.

Example 4

Samples 2001, 2011, and 2021 as used in Example 3 were exposed as described below.

A scanning exposure was carried out by means of Lambda 76 (a laser exposing apparatus, manufactured by Durst Company). The maximum transmission density preset by a user was set, as shown in Table 8, and calibration was carried out using an image for calibration including 21-step gray patches. By repeating calibration of the number of times, as shown in Table 8, convergence to the target density shown in the exposing apparatus was achieved in each of 21-step gray patches. The calibration was carried out under the uniform condition such that color-development processing started 5 minutes after the exposure.

TABLE 8

| Sample No. | Number of the light-sensitive material sample used in this test* | Number of times of calibration until convergence to target value was achieved | Maximum density set at the time of calibration Yellow | Magenta | Cyan | Remarks |
|---|---|---|---|---|---|---|
| 2031 | 2001 | 5 | 3.00 | 3.00 | 3.00 | Comparative example |
| 2032 | 2001 | 3 | 2.80 | 2.80 | 2.80 | Comparative example |
| 2033 | 2001 | 4 | 2.50 | 2.50 | 2.50 | Comparative example |
| 2034 | 2011 | 4 | 3.00 | 3.00 | 3.00 | This invention |
| 2035 | 2011 | 4 | 2.80 | 2.80 | 2.80 | This invention |
| 2036 | 2021 | 3 | 3.00 | 3.00 | 3.00 | This invention |
| 2037 | 2021 | 4 | 2.80 | 2.80 | 2.80 | This invention |

Note)
*See Example 3

After completion of calibration, the image for image evaluation including a maximum density and a minimum density was exposed under the same exposure conditions as calibration. The maximum density of each sample obtained starting the color-development processing 5 minutes after the exposure was measured. 10 members of researchers conducted a sensory evaluation of five-grade system (five grades from 5 (Excellent) to 1 (Poor), providing that the grades 4 or more are allowable), with respect to black depth of the image using the high-density area. Besides, each sample was processed starting the color development 30 minutes after the exposure under the same exposure conditions as the above. Such sample and the above-mentioned sample processed 5 minutes after the exposure were jointed so that the gray patches of the same exposure amount adjoined each other. Using these samples, 10 members of researchers also conducted a sensory evaluation of five-grade system (five grades from 5 (Excellent) to 1 (Poor), providing that the grades 4 or more are allowable), with respect to the continuity at the jointing points. The results are shown in Table 9.

TABLE 9

| Sample No. | Transmission density obtained starting processing 30 minutes after exposure, in gray patches to give transmission density of 1.0 when processed 5 minutes after exposure Yellow | Magenta | Cyan | Sensory evaluation of black depth | Sensory evaluation of continuity at the jointing points | Remarks |
|---|---|---|---|---|---|---|
| 2031 | 0.89 | 1.09 | 1.10 | 4.7 | 1.9 | Comparative example |
| 2032 | 0.92 | 1.10 | 1.12 | 4.1 | 3.1 | Comparative example |
| 2033 | 0.90 | 1.08 | 1.09 | 2.8 | 3.8 | Comparative example |
| 2034 | 0.97 | 1.04 | 1.03 | 4.8 | 4.2 | This invention |
| 2035 | 0.97 | 1.05 | 1.04 | 4.0 | 4.2 | This invention |
| 2036 | 0.99 | 1.02 | 1.00 | 4.9 | 4.8 | This invention |
| 2037 | 1.00 | 1.00 | 1.02 | 4.2 | 4.9 | This invention |

As is apparent from the results shown in Table 9, it is seen that each of Samples 2034 to 2037 using the light-sensitive material sample 2011 or sample 2021 according to the present invention was excellent in both black depth and jointing suitability. In contrast with the above, it is seen that each of Samples 2031 to 2033 using the light-sensitive material sample 2001 for comparison was unsatisfactory in jointing suitability, and Samples 2031 and 2032 in particular were unsatisfactory in jointing suitability, even though calibration was carried out using a preset maximum transmission density of 2.80 or more.

Example 5

As each of the silver halide emulsions of blue-sensitive layer, green-sensitive layer, or red-sensitive layer, the emulsions prepared in the same manner as in the above Example 3, were used.

(Preparation of a Coating Solution for the First Layer)

Into 21 g of the solvent (Solv-1) and 80 ml of ethyl acetate were dissolved 57 g of the yellow coupler (ExY-1), 7 g of the color-image stabilizer (Cpd-1), 4 g of the color-image stabilizer (Cpd-2), 7 g of the color-image stabilizer (Cpd-3), and 2 g of the color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion Al.

Separately, the above emulsified dispersion Al and the Emulsions A2-1 and A2-2 prepared in the same manner as in Example 3 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, the above-described 1-oxy-3,5-dichloro-s-triazine sodium salt (H-1), (H-2), and (H-3) were used. Further, to each layer, were added the above-described Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

Further, to the second layer, the fourth layer, the sixth layer, and the seventh layer, was added 1-(3-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$ Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively.

Further, in order to prevent irradiation, the same dyes as used in Example 1 were added.

(Layer Constitution)

The composition of each layer is shown below. The numbers show coating amounts (g/m$^2$). In the case of the silver halide emulsion, the coating amount is in terms of silver.

Support

As the support, used was a transparent 180 μm thick polyethylene terephthalate film having gelatin (6.2 g/m$^2$), the above-described dye-1 (0.07 g/m$^2$), dye-2 (0.04 g/m$^2$), dye-3 (0.095 g/m$^2$), ultraviolet-absorber (UV-B) (0.31 g/m$^2$), and surfactant (Cpd-13) (0.03 g/m$^2$), each coated on the film of the side opposite to the emulsion coated side.

| | |
|---|---|
| First Layer (Blue-Sensitive Emulsion Layer) | |
| Silver chloroiodobromide emulsion A3 (gold-sulfur sensitized cubes, a 3:7 mixture of the large-size emulsion A2-1 and the small-size emulsion A2-2 (in terms of mol of silver)) | 0.59 |
| Gelatin | 2.40 |
| Yellow coupler (ExY-1) | 1.40 |
| Color-image stabilizer (Cpd-1) | 0.18 |
| Color-image stabilizer (Cpd-2) | 0.09 |
| Color-image stabilizer (Cpd-3) | 0.19 |
| Color-image stabilizer (Cpd-8) | 0.09 |
| Solvent (Solv-1) | 0.63 |
| Second Layer (Color-Mixing Inhibiting Layer) | |
| Gelatin | 1.15 |
| Color-mixing inhibitor (Cpd-4) | 0.10 |
| Color-image stabilizer (Cpd-5) | 0.018 |
| Color-image stabilizer (Cpd-6) | 0.13 |
| Color-image stabilizer (Cpd-7) | 0.007 |
| Solvent (Solv-1) | 0.04 |
| Solvent (Solv-2) | 0.12 |
| Solvent (Solv-5) | 0.13 |
| Third Layer (Green-Sensitive Emulsion Layer) | |
| Silver chloroiodobromide emulsion C3 (gold-sulfur sensitized cubes, a 1:3 mixture of the large-size emulsion C2-1 and the small-size emulsion C2-2 (in terms of mol of silver)) | 0.30 |
| Gelatin | 2.80 |
| Magenta coupler (ExM) | 0.35 |
| Ultraviolet absorbing agent (UV-A) | 0.50 |
| Color-image stabilizer (Cpd-2) | 0.03 |
| Color-image stabilizer (Cpd-4) | 0.006 |
| Color-image stabilizer (Cpd-6) | 0.24 |
| Color-image stabilizer (Cpd-8) | 0.11 |
| Color-image stabilizer (Cpd-9) | 0.03 |
| Color-image stabilizer (Cpd-10) | 0.01 |
| Color-image stabilizer (Cpd-11) | 0.001 |
| Color-image stabilizer (Cpd-21) | 0.005 |
| Solvent (Solv-4) | 0.52 |
| Solvent (Solv-9) | 0.30 |
| Fourth Layer (Color-Mixing Inhibiting Layer) | |
| Gelatin | 0.68 |
| Color-mixing inhibitor (Cpd-4) | 0.06 |
| Color-image stabilizer (Cpd-5) | 0.001 |
| Color-image stabilizer (Cpd-6) | 0.08 |
| Color-image stabilizer (Cpd-7) | 0.005 |
| Solvent (Solv-1) | 0.02 |
| Solvent (Solv-2) | 0.08 |
| Solvent (Solv-5) | 0.085 |
| Fifth Layer (Red-Sensitive Emulsion Layer) | |
| Silver chloroiodobromide emulsion E3 (gold-sulfur sensitized cubes, a 5:5 mixture of the large-size emulsion E2-1 and the small-size emulsion E2-2 (in terms of mol of silver)) | 0.45 |
| Gelatin | 2.20 |
| Cyan coupler (ExC-1) | 0.03 |
| Cyan coupler (ExC-2) | 0.12 |
| Cyan coupler (ExC-3) | 0.43 |
| Cyan coupler (ExC-4) | 0.03 |
| Cyan coupler (ExC-5) | 0.01 |
| Color-image stabilizer (Cpd-1) | 0.65 |
| Color-image stabilizer (Cpd-6) | 0.01 |
| Color-image stabilizer (Cpd-7) | 0.01 |
| Color-image stabilizer (Cpd-9) | 0.04 |
| Color-image stabilizer (Cpd-10) | 0.04 |
| Color-image stabilizer (Cpd-14) | 0.04 |

-continued

| | |
|---|---|
| Color-image stabilizer (Cpd-15) | 0.56 |
| Color-image stabilizer (Cpd-16) | 0.04 |
| Color-image stabilizer (Cpd-17) | 0.04 |
| Color-image stabilizer (Cpd-18) | 0.33 |
| Color-image stabilizer (Cpd-20) | 0.04 |
| Ultraviolet absorbing agent (UV-5) | 0.04 |
| Solvent (Solv-5) | 0.70 |
| Sixth Layer (Ultraviolet Absorbing Layer) | |
| Gelatin | 0.47 |
| Ultraviolet absorbing agent (UV-B) | 0.35 |
| Compound (S1-4) | 0.0015 |
| Solvent (Solv-3) | 0.18 |
| Seventh Layer (Protective Layer) | |
| Gelatin | 0.98 |
| Acryl-modified copolymer of polyvinyl alcohol (modification degree: 17%) | 0.4 |
| Liquid paraffin | 0.02 |
| Surface-active agent (Cpd-13) | 0.03 |

Thus, Sample 3101 was prepared.

Thus, Dample 3101 was prepared.

(Preparation of Samples 3102 to 3108)

Samples 3102 to 3108 were prepared in the same manner as Sample 3101 prepared above, except that the coating amount of silver and the molar ratio of silver halide emulsion to dye-forming coupler in the first layer, the third layer and the fifth layer were changed, respectively, as shown in Table 10 below. In this connection, at the time of change in the molar ratio of silver halide emulsion to dye-forming coupler, the amount of gelatin was adjusted so that a ratio of gelatin to the water-insoluble and organic solvent-soluble components including dye-forming couplers became the same as that of the corresponding layer of Sample 3101.

(Maximum Developed Color Density Upon Area Exposure and Evaluation of Point Gamma)

Each sample was subjected to exposure in an exposure time of $10^{-4}$ sec, through an optical wedge having 22-steps each differing by an optical density of 0.2 in tiers, using xenon flash light source. In this time, the CC filter was used so that a hue of the processed sample became gray. The term "gray" herein used means that a chromaticity in the area of the density closest to the density of 1.5 is within the following range in the L* a* b* colorimetric system, when a fluorescent lamp for color evaluation is used as an observation light source.

$|a|^*<3.0$, and $|b^*|<3.0$

Each sample thus exposed was subjected to color-development processing according to the following processing method.

The color-development processing was performed according to the following process, using CP-45X (trade name) (processing process for color papers, manufactured by Fuji Photo Film Co., Ltd.) and a roller transport-type automatic processor.

Processing process for Fuji color papers CP-45X

| Processing steps | Processing temperature | Processing time | Replenishment rate |
|---|---|---|---|
| Color-development | 35 ± 0.3° C. | 110 sec | 370 ml/m$^2$ |
| Bleach-fixing | 33 to 37° C. | 110 sec | 494 ml/m$^2$ |
| Rinse | 24 to 34° C. | 220 sec | 10 L/m$^2$ |
| Drying | 50 to 70° C. | 3 min | |

With respect to the Samples 3101 to 3108, each of the samples exposed to the degree of 30% gray was subjected to a so-called running processing, with the above-described processing solutions, until the replenisher volume of a color-developing bath became equal to the volume of a color-developing replenisher tank. Using the running solution thus obtained, the following evaluation of Samples 3101 to 3108 were carried out.

Densitometry of each sample thus obtained was conducted using a densitometer X-rite 310 (trade name) manufactured by X-rite Company, to obtain Status A density. Interpolation was carried out based on the results of densitometry of the 22 steps thus obtained. The difference, between the maximum density and the density at the unexposed area on the sensitometry curve obtained by the interpolation was designated as the maximum developed color density. The point gamma was measured from a curve obtained by primary differentiation of the sensitometry curve.

TABLE 10

| Sample No. | Ratio of Coating amount of Silver to that of Sample 3101 | | | Ratio of Silver to Coupler(s) | | | Maximum developed color density | | | Point γ ratio | Remarks |
|---|---|---|---|---|---|---|---|---|---|---|---|
| | First Layer | Third Layer | Fifth Layer | First Layer | Third Layer | Fifth Layer | B | G | R | Pγmin/Pγmax | |
| 3101 | 1.00 | 1.00 | 1.00 | 3.14 | 4.66 | 3.18 | 2.80 | 2.80 | 3.10 | 0.71 | Comparative example |
| 3102 | 1.10 | 1.10 | 1.00 | 3.14 | 4.66 | 3.18 | 3.10 | 3.10 | 3.10 | 0.66 | This invention |
| 3103 | 1.25 | 1.35 | 1.25 | 3.14 | 4.66 | 3.18 | 3.50 | 3.80 | 3.80 | 0.71 | This invention |
| 3104 | 1.25 | 1.35 | 1.00 | 3.14 | 4.66 | 3.18 | 3.50 | 3.80 | 3.10 | 0.60 | This invention |

TABLE 10-continued

| Sample No. | Ratio of Coating amount of Silver to that of Sample 3101 First Layer | Third Layer | Fifth Layer | Ratio of Silver to Coupler(s) First Layer | Third Layer | Fifth Layer | Maximum developed color density B | G | R | Point γ ratio Pγmin/Pγmax | Remarks |
|---|---|---|---|---|---|---|---|---|---|---|---|
| 3105 | 1.30 | 1.35 | 1.35 | 3.14 | 4.66 | 3.18 | 3.60 | 3.80 | 4.20 | 0.81 | This invention |
| 3106 | 1.10 | 1.10 | 1.00 | 3.14 | 5.04 | 3.18 | 2.90 | 3.20 | 3.10 | 0.66 | Comparative example |
| 3107 | 1.10 | 1.10 | 1.00 | 3.14 | 4.66 | 4.92 | 2.80 | 3.20 | 3.30 | 0.75 | Comparative example |
| 3108 | 1.40 | 1.35 | 1.25 | 3.14 | 5.04 | 3.18 | 3.30 | 3.80 | 3.80 | 0.68 | This invention |

(Method for Evaluation of Image Obtained Upon Scanning Exposure)

Each of Samples 3101 to 3108 was exposed to print two kinds of image described below, by means of a laser printer Lambda 76 (trade name) manufactured by Durst Company.

Image A

A picture image incorporating, in a black background, both a photographic image of a swimming tropical fish and a commentary on the fish written in white letters.

Image B

A picture image incorporating a multistory building that stands in a green tract of land, and black and red letters in the blue sky, which acts as a back ground.

Each sample thus exposed was color-developed according to the above-mentioned processing method. To evaluate the thus-obtained images, 20 members of researchers conducted a sensory evaluation. Specifically, with respect to each image made in each sample, each researcher evaluated such qualities as letter-edge definition loss, depth of black, three-dimensional depth, and textural quality, and gave a grade (score) according to a ten point evaluation system, assuming that the best score to be 10 points. Among image qualities on which the researchers relied to evaluate in the sensory evaluation, letter-edge definition loss and three-dimensional depth were considered to be the most important qualities by the researchers. The results thus obtained are shown in Table 11, together with the preset value of maximum developed color density used at the time of calibration, and the point gamma ratio at the preset value of maximum developed color density.

TABLE 11

| Test No. | Sample No. | Target density of calibration | Point γ ratio at target density | Image quality evaluation Image A | Image B | Remarks Sample | Exposing method*) |
|---|---|---|---|---|---|---|---|
| 3101 | 3101 | 2.5 | 0.7 | 3.7 | 4.5 | Comparative example | 01 |
| 3102 | 3101 | 2.8 | 0.6 | 5.7 | 4.2 | Comparative example | 01 |
| 3103 | 3102 | 2.8 | 0.7 | 6.1 | 5.6 | This invention | 01 |
| 3104 | 3102 | 3.0 | 0.6 | 7.2 | 7.6 | This invention | 11 |
| 3105 | 3103 | 3.0 | 0.8 | 7.5 | 9.0 | This invention | 11 |
| 3106 | 3103 | 3.2 | 0.8 | 8.8 | 9.2 | This invention | 11 |
| 3107 | 3103 | 3.4 | 0.55 | 8.0 | 6.1 | This invention | 10 |
| 3108 | 3104 | 3.0 | 0.6 | 6.8 | 4.5 | This invention | 11 |
| 3109 | 3105 | 3.0 | 0.9 | 7.5 | 8.3 | This invention | 11 |
| 3110 | 3105 | 3.4 | 0.8 | 9.2 | 9.6 | This invention | 11 |
| 3111 | 3105 | 3.6 | 0.55 | 8.7 | 4.2 | This invention | 10 |
| 3112 | 3106 | 2.8 | 0.6 | 4.7 | 3.9 | Comparative example | 01 |
| 3113 | 3107 | 2.8 | 0.7 | 5.1 | 4.7 | Comparative example | 01 |
| 3114 | 3108 | 3.0 | 0.7 | 7.4 | 7.9 | This invention | 11 |

TABLE 11-continued

| Test No. | Sample No. | Target density of calibration | Point γ ratio at target density | Image quality evaluation | | Remarks | |
|---|---|---|---|---|---|---|---|
| | | | | Image A | Image B | Sample | Exposing method*) |
| 3115 | 3108 | 3.2 | 0.55 | 8.0 | 5.5 | This invention | 10 |

NOTE:
*)01: The target density of calibration was less than 3.0, and the point γ ratio at the target density was 0.6 or more;
10: The target density of calibration was 3.0 or more, and the point γ ratio at the target density was less than 0.6;
11: The target density of calibration was 3.0 or more, and the point γ ratio at the target density was 0.6 or more; and
00: The target density of calibration was less than 3.0, and the point γ ratio at the target density was less than 0.6.

(Results of Evaluation)

As can be seen from the results in the above Table 11, regarding each image obtained using the light-sensitive material according to the present invention, the evaluation of both the images A and B was high. In detail, the evaluation of image A is approximately parallel to the target density of calibration in each sample. Accordingly, a light-sensitive material that is able to set a high calibration density, thereby to obtain a high maximum developed color density, is of advantage to this point. However, as seen in the relation between Test Nos. 3106 and 3107, the relation between Test Nos. 3110 and 3111, and the relation between Test Nos. 3114 and 3115, even when a target density is set higher, if the point γ ratio at the target density becomes small, the scores of evaluation becomes lower rather than higher. This tendency is conspicuous in the evaluation of image B. Further, as seen from the results of these Test Nos. 3106, 3110 and 3114, and others, the highest evaluation results could be obtained on both the images A and B, when the light-sensitive material of the present invention was exposed in which the target density of calibration was set at 3.0 or higher and the resultant point gamma ratio at the target density was 6.0 or higher. Accordingly, it is understood that the point γ ratio is also important, as well as the maximum developed color density, for obtaining various images with high image quality.

Further, as seen from the results of Sample Nos. 3106 to 3108 in the above Table 10, it is of disadvantage in the practical use to increase a ratio by amount of substance of silver to dye-forming coupler in the third layer and the fifth layer, because the increase of the ratio lowers color-forming efficiency in the first layer.

Having described our invention as related to the present embodiments, it is our intention that the invention not be limited by any of the details of the description, unless otherwise specified, but rather be construed broadly within its spirit and scope as set out in the accompanying claims.

We claim:

1. A silver halide color photographic light-sensitive material for a color display, having at least one yellow dye image-forming layer, at least one magenta dye image-forming layer, and at least one cyan dye image-forming layer, each of which is provided on a transparent support, which shows 3.0 or more of maximum transmission densities for the respective layers upon area exposure with an exposure time of $10^{-4}$ sec, and shows a transmission density in a range of 0.95 to 1.05 when color development is started in 30 minutes after exposure with an exposure amount that gives a transmission density of 1.0 when the light-sensitive material is subjected to color development started in 5 minutes after exposure, and in which silver halide grains of a silver halide emulsion contained in the image-forming layers each are cubic, tetradecahedral, or octahedral crystal grains.

2. An image-forming method, comprising:

subjecting the silver halide color photographic light-sensitive material claimed in claim 1 to scanning exposure to a light beam; and processing the exposed light-sensitive material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset maximum transmission density being 2.8 or more.

3. The silver halide color photographic light-sensitive material as claimed in claim 1, wherein at least one silver halide emulsion layer contains silver halide emulsion grains having a silver chloride content of 95 mol % or more, and having incorporated therein at least one metal complex represented by formula (A):

$$[MX^{I}_{n}L^{I}_{(6-n)}]^{m} \qquad \text{Formula (A):}$$

wherein M represents Cr, Mo, Re, Fe, Ru, Os, Co, Rh, Pd, or Pt; $X^1$ represents a halogen ion; $L^I$ represents an arbitrary ligand differing from $X^I$; n represents 3, 4, 5, or 6; and m represents 4−, 3−, 2−, 1−, 0, or 1+.

4. An image-forming method, comprising:

subjecting the silver halide color photographic light-sensitive material claimed in claim 3 to scanning exposure to a light beam; and processing the exposed light-sensitive material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset maximum transmission density being 2.8 or more.

5. A silver halide color photographic light-sensitive material for a color display, which is suitable for scanning exposure, and is capable of forming an image by color development after scanning exposure according to image-information, wherein the silver halide color photographic light-sensitive material has a transmission support, and at least one yellow color developable light-sensitive image-forming silver halide emulsion layer, at least one magenta color developable light-sensitive image-forming silver halide emulsion layer, at least one cyan color developable light-sensitive image-forming silver halide emulsion layer, and at least one light-insensitive hydrophilic colloid layer that develops no color, each of which is provided on the transmission support, and, in which silver halide grains of a silver halide emulsion contained in the image-forming layers each are cubic, tetradecahedral, or octahedral crystal grains, wherein the silver halide color photographic light-sensitive material satisfies condition (A), and at lease one of conditions (B) and (C):

Condition (A)

$0.30<\Delta EY(3.0)<0.65$, $0.30<\Delta EM(3.0)<0.65$ and $0.30<\Delta EC(3.0)<0.65$ Condition (B)

$0.50<\Delta EY(0.05)<0.80$, $0.50<\Delta EM(0.06)<0.80$ and $0.50<\Delta EC(0.05)<0.80$ Condition (C)

$94\leqq L^*$, $-0.2\leqq a^*\leqq 0.3$, and $-0.2\leqq b^*\leqq 0.8$ wherein, as to condition (A), $\Delta EY(3.0)$, $\Delta EM(3.0)$, and $\Delta EC(3.0)$ each represent a difference between an exposure amount necessary to give a transmission density of 1.0, and an exposure amount necessary to give a transmission density of 3.0, regarding yellow, magenta, and cyan, respectively, on characteristic curves that are obtained by color development of the light-sensitive material after exposure with an exposure time of $10^{-4}$ seconds;

as to condition (B), $\Delta EY(0.05)$ and $\Delta EC(0.05)$ each represent a difference between an exposure amount necessary to give a transmission density of 1.0, and an exposure amount necessary to give a transmission density of 0.05, regarding yellow and cyan, respectively, on the characteristic curves that are obtained by color development of the light-sensitive material after exposure with an exposure time of $10^{-4}$ seconds; and, $\Delta EM(0.06)$ represents a difference between an exposure amount necessary to give a transmission magenta density of 1.0, and an exposure amount necessary to give a transmission magenta density of 0.06, on the characteristic curve that is obtained by color development of the light-sensitive material after exposure with an exposure time of 10–4 seconds; and as to condition (C), L*, a* and b* each represent chromaticity of the light-sensitive material that is obtained by color development of said light-sensitive material after exposure with an exposure amount lower by 0.8 than the exposure amount necessary to give a transmission density of 1.0 regarding yellow, magenta and cyan, respectively, on the characteristic curves that are obtained by color development of said light-sensitive material after exposure with an exposure time of 10–4 seconds.

6. The silver halide color photographic light-sensitive materials as claimed in claim 5, which satisfies the condition (A) and the condition (B).

7. The silver halide color photographic light-sensitive materials as claimed in claim 5, which satisfies the condition (A) and the condition (C).

8. The silver halide color photographic light-sensitive materials as claimed in claim 5, which satisfies the condition (A), and the condition (B) and the condition (C).

9. An image-forming method, comprising:

scan-exposing, according to image information, a silver halide color photographic light-sensitive material having a transmission support, and at least one yellow color developable light-sensitive image-forming silver halide emulsion layer, at least one magenta color developable light-sensitive image-forming silver halide emulsion layer, at least one cyan color developable light-sensitive image-forming silver halide emulsion layer, and at least one light-insensitive hydrophilic colloid layer that develops no color, each of which is provided on the transmission support, and in which silver halide grains of a silver halide emulsion contained in the image-forming layers each are cubic, tetradecahedral, or octahedral crystal grains; and processing the exposed light-sensitive material to color-develop, thereby obtaining an image, wherein said silver halide color photographic light-sensitive material satisfies the condition (A) described in claim 5, and at least one of the condition (B) and (C) described in claim 5.

10. The image-forming method as claimed in claim 9, wherein the silver halide color photographic light-sensitive material satisfies the condition (A) and the condition (B).

11. The image-forming method as claimed in claim 9, wherein the silver halide color photographic light-sensitive material satisfies the condition (A) and the condition (C).

12. The image-forming method as claimed in claim 9, wherein the silver halide color photographic light-sensitive material satisfies the condition (A), the condition (B), and the condition (C).

13. A silver halide color display material, having, on a transparent or semitransparent support, at least one blue-sensitive silver image-forming halide emulsion layer, at least one green-sensitive silver image-forming halide emulsion layer, and at least one red-sensitive silver image-forming halide emulsion layer, in which silver halide grains of a silver halide emulsion contained in the image-forming layers each are cubic, tetradecahedral, or octahedral crystal grains, wherein, when a neutral gray image is formed by area exposure with an exposure time of $10^{-4}$ sec to the display material, through an optical wedge using a xenon flash light source, a difference in density between the maximum color developed area and a non-color developed area of a respective dye image of cyan, magenta, or yellow, is 3.0 or more; and wherein, on a point gamma of the respective dye image at a density of 90% as much as the lowest density among the maximum developed color densities of the respective dye image, the relation between Pγmax and Pγmin is represented by formula (B):

$$P\gamma min/P\gamma max\geqq 0.60 \qquad \text{Formula (B)}$$

in which Pγmax represents the maximum point gamma, and Pγmin represents the minimum point gamma.

14. The silver halide color display material as claimed in claim 13, wherein a molar ratio of silver halide to a dye-forming coupler in each of silver halide emulsion layers, except for the silver halide emulsion layer closest to the support, that is expressed by a ratio of an amount of substance silver halide/an amount of substance dye-forming coupler per unit area, is 4.7 or less.

15. An image-forming method, comprising:

subjecting the silver halide color display material claimed in claim 13 to scanning exposure to a light beam; and processing the exposed display material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset density being 3.0 or more.

16. An image-forming method, comprising:

subjecting the silver halide color display material claimed in claim 14 to scanning exposure to a light beam; and processing the exposed display material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset density being 3.0 or more.

17. The silver halide color display material as claimed in claim 13, wherein, on the point gamma of the respective dye image of cyan, magenta, or yellow at the maximum developed color density area of an image for calibration in the silver halide color display material, the relation between Pγmax and Pγmin is represented by formula (B):

$$P\gamma min/P\gamma max \geqq 0.60 \qquad \text{Formula (B)}$$

in which Pγmax represents the maximum point gamma and Pγmin represents the minimum point gamma, wherein the image for calibration is obtained, by carrying out calibration using a scanning exposure apparatus for outputting said image for calibration that is used for calibrating exposure conditions for obtaining both a preset transmission density by densitometric measurement of the image for calibration, and a gray gradation up to the density, the preset density being 3.0 or more.

18. The silver halide color display material as claimed in claim 17, wherein a molar ratio of silver halide to a dye-forming coupler in each of silver halide emulsion layers, except for the silver halide emulsion layer closest to the support, that is expressed by a ratio of an amount of substance silver halide/an amount of substance dye-forming coupler per unit area, is 4.7 or less.

19. An image-forming method, comprising:

subjecting the silver halide color display material claimed in claim 18 to scanning exposure to a light beam; and processing the exposed display material to color-development, wherein an apparatus to be used in the scanning exposure outputs an image for calibration that is used for calibrating exposure conditions for obtaining both a preset maximum transmission density by densitometric measurement of the image for calibration, and a gray gradation up to the maximum density, the preset density being 3.0 or more.

20. The silver halide color photographic light-sensitive material as claimed in claim 1, which is a silver halide color photographic light-sensitive material for scanning exposure.

21. The silver halide color photographic light-sensitive material as claimed in claim 1, which silver halide color photographic light-sensitive material is processed by a wet method using a developing solution containing an alkali agent and a developing agent.

22. The silver halide color photographic light-sensitive material as claimed in claim 5, which silver halide color photographic light-sensitive material is processed by a wet method using a developing solution containing an alkali agent and a developing agent.

23. The silver halide color display material as claimed in claim 13, which is a silver halide color display material for scanning exposure.

24. The silver halide color display material as claimed in claim 13, in which the silver halide color display material is processed by a wet method using a developing solution containing an alkali agent and a developing agent.

* * * * *